US007329170B2

(12) United States Patent
Ono et al.

(10) Patent No.: US 7,329,170 B2
(45) Date of Patent: Feb. 12, 2008

(54) METHOD OF PRODUCING POLISHING PAD

(75) Inventors: Koichi Ono, Ohtsu (JP); Tetsuo Shimomura, Ohtsu (JP); Masahiko Nakamori, Ohtsu (JP); Takatoshi Yamada, Ohtsu (JP); Shigeru Komai, Ohtsu (JP); Masayuki Tsutsumi, Ohtsu (JP)

(73) Assignee: Toyo Tire & Rubber Co., Ltd., Osaka (JP)

( * ) Notice: Subject to any disclaimer, the term of this patent is extended or adjusted under 35 U.S.C. 154(b) by 0 days.

(21) Appl. No.: 11/366,238

(22) Filed: Mar. 2, 2006

(65) Prior Publication Data

US 2006/0148392 A1 Jul. 6, 2006

Related U.S. Application Data

(62) Division of application No. 10/432,410, filed as application No. PCT/JP01/10363 on Nov. 28, 2001, now Pat. No. 7,192,340.

(30) Foreign Application Priority Data

| | | |
|---|---|---|
| Dec. 1, 2000 | (JP) | 2000-367468 |
| Dec. 1, 2000 | (JP) | 2000-367469 |
| Jan. 22, 2001 | (JP) | 2001-13405 |
| Mar. 6, 2001 | (JP) | 2001-61221 |
| Apr. 2, 2001 | (JP) | 2001-103699 |
| Jul. 26, 2001 | (JP) | 2001-225568 |
| Aug. 2, 2001 | (JP) | 2001-234577 |
| Sep. 6, 2001 | (JP) | 2001-269928 |
| Sep. 10, 2001 | (JP) | 2001-274011 |
| Sep. 28, 2001 | (JP) | 2001-302939 |
| Sep. 28, 2001 | (JP) | 2001-302940 |
| Sep. 28, 2001 | (JP) | 2001-302941 |

(51) Int. Cl.
*B24B 1/00* (2006.01)

(52) U.S. Cl. ..... 451/28; 451/526

(58) Field of Classification Search ..... 451/526, 451/41, 285–288, 28
See application file for complete search history.

(56) References Cited

U.S. PATENT DOCUMENTS

| | | | |
|---|---|---|---|
| 3,504,457 | A | 4/1970 | Jacobsen et al. |
| 3,875,730 | A | 4/1975 | Clemente |
| 4,331,453 | A | 5/1982 | Dau et al. |
| 5,110,668 | A | 5/1992 | Minnick |
| 5,257,478 | A | 11/1993 | Hyde et al. |

(Continued)

FOREIGN PATENT DOCUMENTS

| | | | |
|---|---|---|---|
| CN | 1076152 | A | 9/1993 |

(Continued)

*Primary Examiner*—Lee D. Wilson
(74) *Attorney, Agent, or Firm*—Knobbe Martens Olson & Bear, LLP

(57) ABSTRACT

A method of producing a polishing pad having a polishing layer is characterized in that the polishing layer is produced by a photolithographic method including: forming a sheet molding from a curing composition containing at least an initiator and an energy ray-reactive compound to be cured with energy rays; exposing the sheet molding to energy rays to induce modification thereof, to change the solubility of the sheet molding in a solvent; and developing the sheet molding after irradiation with energy rays, to partially remove the curing composition with a solvent thereby forming a concave and convex pattern at least one surface.

7 Claims, 4 Drawing Sheets

U.S. PATENT DOCUMENTS

| | | | | |
|---|---|---|---|---|
| 5,624,304 | A | 4/1997 | Pasch et al. | |
| 5,632,668 | A | 5/1997 | Lindholm et al. | |
| 5,674,122 | A | 10/1997 | Krech | |
| 5,681,217 | A | 10/1997 | Hoopman et al. | |
| 5,704,952 | A | 1/1998 | Law et al. | |
| 5,709,598 | A | 1/1998 | Nishio et al. | |
| 5,807,761 | A | 9/1998 | Coronel et al. | |
| 5,908,476 | A * | 6/1999 | Nishio et al. | 51/297 |
| 5,913,716 | A * | 6/1999 | Mucci et al. | 451/59 |
| 5,921,855 | A | 7/1999 | Osterheld et al. | |
| 5,984,769 | A | 11/1999 | Bennett et al. | |
| 6,083,606 | A | 7/2000 | Okada et al. | |
| 6,095,900 | A | 8/2000 | Fruitman et al. | |
| 6,102,779 | A * | 8/2000 | Cesna et al. | 451/41 |
| 6,234,875 | B1 | 5/2001 | Pendergrass, Jr. | |
| 6,362,107 | B1 | 3/2002 | Shiro et al. | |
| 6,406,363 | B1 | 6/2002 | Xu et al. | |
| 6,454,634 | B1 | 9/2002 | James et al. | |
| 6,616,520 | B1 | 9/2003 | Kawahara et al. | |
| 7,192,340 | B2 | 3/2007 | Ono et al. | |
| 2001/0003358 | A1 | 6/2001 | Terase et al. | |
| 2002/0010232 | A1 | 1/2002 | Ogawa et al. | |
| 2002/0068513 | A1 | 6/2002 | Xu et al. | |
| 2006/0148391 | A1 | 7/2006 | Ono et al. | |

FOREIGN PATENT DOCUMENTS

| | | |
|---|---|---|
| JP | 6-21028 | 1/1994 |
| JP | 6-77185 | 3/1994 |
| JP | 8-19965 | 1/1996 |
| JP | 8-500622 | 1/1996 |
| JP | 10-156724 | 6/1998 |
| JP | 10-249709 | 9/1998 |
| JP | 10-249709 A | 9/1998 |
| JP | 10-296643 | 11/1998 |
| JP | 11-48129 | 2/1999 |
| JP | 11-48131 | 2/1999 |
| JP | 11-58219 | 3/1999 |
| JP | 11-70462 | 3/1999 |
| JP | 2000-190232 | 7/2000 |
| JP | 2000-190235 | 7/2000 |
| JP | 2000-202763 | 7/2000 |
| JP | 2000-237962 | 9/2000 |
| JP | 2000-354950 | 12/2000 |
| JP | 2001-105300 | 4/2001 |
| TW | 430893 | 4/2001 |
| WO | WO 94/04599 | 3/1994 |
| WO | WO 98/30356 | 7/1998 |
| WO | WO 99/24218 | 5/1999 |

* cited by examiner

METHOD OF PRODUCING POLISHING PAD

CROSS-REFERENCE TO RELATED APPLICATIONS

This is a divisional application of U.S. patent application Ser. No. 10/432,410, filed Sep. 15, 2003, now U.S. Pat. No. 7,192,340 the disclosure of which is herein incorporated by reference in its entirety and which is the U.S. National Phase under 35 U.S.C. § 371 of International Application PCT/JP01/10363, filed Nov. 28, 2001, which claims priority to Japanese Patent Application Nos. 2000-367468 filed Dec. 1, 2000, 2000-367469 filed Dec. 1, 2000, 2001-13405 filed Jan. 22, 2001, 2001-61221 filed Mar. 6, 2001, 2001-103699 filed Apr. 2, 2001, 2001-225568 filed Jul. 26, 2001, 2001-234577 filed Aug. 2, 2001, 2001-269928 filed Sep. 6, 2001, 2001-274011 filed Sep. 10, 2001, 2001-302939 filed Sep. 28, 2001, 2001-302940 filed Sep. 28, 2001, and 2001-302941 filed Sep. 28, 2001. The International Application was published under PCT Article 21(2) in a language other than English.

BACKGROUND OF THE INVENTION

1. Field of the Invention

This invention relates to a polishing pad which can be utilized as a polishing pad characterized by being capable of industrially easily fine surface processing and usable as a polishing pad effecting stable planarizing processing, at high polishing rate, materials requiring surface flatness at high level, such as a silicon wafer for semiconductor devices, a memory disk, a magnetic disk, optical materials such as optical lens and reflective mirror, a glass plate, metal etc. The polishing pad of this invention is suitable for use in the step of planarizing particularly a silicon wafer, a device (multi-layer substrate) having an oxide layer, metal layer etc. formed on a silicon wafer, or a silicon wafer before lamination and formation of such layers.

This invention also relates to a method of producing the polishing pad and to a cushion layer for the polishing pad.

2. Description of the Related Art

Typical materials requiring surface flatness at high level include a single-crystal silicon disk called a silicon wafer for producing semiconductor integrated circuits (IC, LSI). The surface of the silicon wafer should be flattened highly accurately in a layer-forming step in order to provide reliable semiconductor connections among various layers used in manufacturing circuits in a producing step of IC, LSI and the like.

Generally, a polishing pad is stuck on a rotatable supporting plate called a platen, while a semiconductor wafer is held on a plate called a polishing head capable of self-rotation. By rotational movement of the two, a relative speed is generated between the platen and the polishing head, and while a solution (slurry) having very fine silica- or ceria-based particles (abrasive grains) suspended in an alkali solution or in an acidic solution is allowed to flow through a gap between the polishing pad and the wafer, to effect polishing and planarizing process. When the polishing pad moves on the surface of the wafer, abrasive grains are pushed at contact points against the surface of the wafer. Accordingly, the surface of the wafer is polished by the sliding dynamic frictional action between the surface of the wafer and the abrasive grains, to reduce the unevenness and surface roughness of the wafer. Such polishing process is usually called CMP (chemical mechanical polishing).

<[I] Polishing Pad>

The known polishing pad for the mirror surface of a semiconductor wafer used in the polishing step include a polishing pad of polyurethane foam type, a polishing pad of polishing cloth type having a polyester nonwoven fabric impregnated with polyurethane resin, and a polishing pad of stacked type having the above 2 pads laminated therein.

As the polishing pad of polyurethane foam type, a polyurethane foam sheet having a void volume of about 30 to 35% is used. Techniques described in Japanese Patent Application National Publication (Laid-Open) No. 8-500622 disclosing a polishing pad comprising fine hollow particles or water-soluble polymer particles dispersed in a matrix resin such as polyurethane are also known.

Among these polishing pads are those formed grooves or holes on the surface of their polishing layer for the purpose of improving the fluidity of slurry and maintaining the slurry. As known techniques of forming surface pattern of a polishing layer in the polishing pad, known techniques of forming surface pattern by a worker with a device such as a cutter, a chisel, or a diamond lathe are disclosed in JP-A 11-48129, JP-A 11-58219 and JP-A 11-70462.

The known polyurethane foam sheet having a void volume of about 30 to 35% as described above is excellent in a local planarization, but exhibits compressibility as low as about 0.5 to 1.0% and is thus poor in cushioning characteristics, to make it difficult to give uniform pressure onto the whole surface of a wafer. Accordingly, polishing processing is carried out usually after the backside of a polyurethane foam sheet is provided separately with a soft cushion layer.

The polishing pad of polyurethane foam type or the polishing pad descried in Japanese Patent Application National Publication (Laid-Open) No. 8-500622 constitutes a polishing layer by itself, and when the polishing surface is worn, the surface is renewed to constitute a polishing layer. That is, the whole of the polishing pad is uniformly elastic and thus has a problem with polishing rate, the uniformity of a material polished, and a difference in step height. That is, there is a problem that when a material constituting a polished surface has a difference in hardness, a softer region is polished in a larger amount, thus failing to achieve flatness at the microscopic level. For polishing, the polishing pad should be provided at the backside (i.e. platen attachment side) with a cushion layer having a polyester nonwoven fabric impregnated with polyurethane resin, thus requiring an additional step of sticking the cushion layer in the method of producing the polishing pad, to make it difficult to cope with demand for reduction in costs.

In these polishing pads, abrasive grains, polished dust etc. are accumulated in voids on the surface of the polishing layer during polishing to reduce the polishing rate, thus periodically necessitating the dressing step of polishing the surface with a head having abrasive grains of diamond deposited thereon, to renew the polishing surface during polishing, but there is a problem that because voids in the polishing pad are not uniformly dispersed and the size and shape of the voids are irregular, the surface renewed by the dressing step is not the same as previous one, to give rise to a difference in polishing characteristics. Further, polishing cannot be conducted during the dressing step to cause a reduction in the efficiency of production. Furthermore, the pad is polished in the dressing step, and thus there is a problem that the pad is consumed in the dressing step in addition to the polishing step.

For fluidizing and maintaining slurry used in polishing, the polishing surface is formed grooves, concentric circles or holes thereon. This processing means include cutting with a chisel, cutting device etc. or pressing with a specified mold, but the cutting means suffer from difficulty in preventing quality variation depending on worker's individual variation, difficulty in changing manufactured patterns, limit to form fine patterns, and generation of burrs to mar the surface of a material polished, while the pressing means has problems such as an increase in costs due to manufacture of a mold and a change, by pressing, in physical properties of a region surrounding the processed region.

As a method of solving the problems in pressing, there is proposed manufacture of a polishing surface by coating a substrate with a liquid photosensitive resin and subsequent photolithography, as described in WO9830356, wherein a photosensitive composition is irradiated with UV rays or laser light to cure irradiated regions in order to remove non-irradiated regions.

When a pad having a certain thickness is manufactured by application of the above liquid photosensitive resin, the liquid resin spreads with time on a substrate, to causes a problem in thickness accuracy. Production of a pad using a spacer etc. to solving this problem causes a reduction in industrial efficiency. Further, the resin is liquid before light exposure, product control (temperature control etc.) is difficult in the process from light exposure to solidification, and the stock of the product is also difficult, to cause a reduction in industrial efficiency. Further, the problem of necessity for the periodical dressing step in the polishing step is still not solved.

An object of this invention is to provide a polishing pad which can be easily subjected to surface processing to form a sheet and grooves, is excellent in thickness accuracy, attains a high polishing rate and achieves a uniform polishing rate.

In a polishing pad of stacked type laminated with a cushion layer, a middle layer is divided into segments to make the elastic characteristics different from those of the polishing layer to improve polishing characteristics, as described in JP-A 11-48131, and in this case too, there are the problems described above. To improve the polishing characteristics of the polishing pad, the polishing layer and other layers are provided with various embossed patterns, but still not solve the above problems.

Another object of this invention is to provide a method of producing a polishing pad which solves the problems described above, is free of quality variation resulting from an individual variation, easily enables a change in processed patterns, enables fine processing, is compatible with various materials to be polished, and is free of burrs upon forming patterns, as well as a method of producing the same.

A still other object of this invention is to provide a polishing pad having a high polishing rate, being excellent in uniformity of a material to be polished and in a difference in step height, and not necessitating stacking a cushion layer on the attachment side for a platen.

The polishing pad of foam type described above is a relatively soft pad of low elastic modulus so that as shown in FIG. 6, the polishing layer 31 itself is deflected so as to follow the shape of a circuit pattern 32 in a semiconductor wafer, and the insulating layer 34 between patterns 33 is polished in excess, to cause a problem with planarizing characteristics at the microscopic level of a material to be polished. In the polishing pad of foam type, there is a limit to an increase in the elastic modulus of the polishing layer, and there is also a limit to improvement in planarizing characteristics.

Some polishing pads with an improvement in elastic modulus out of physical properties of the polishing layer include: (1) a polishing pad having a hydraulic module of 250 psi upon compression of 1 psi when the polishing layer is compressed with 4 to 20 psi (JP-A 6-21028), (2) a polishing pad using a polishing layer having a tensile elastic modulus of 1 MPa to 500 MPa (JP-A 2000-202763), and (3) a polishing pad having an bending elastic modulus of 3500 to 40000 kg/cm$^2$ (JP-A 2001-105300). The polishing pads described in these literatures have improved planarizing characteristics to a certain extent, but it cannot be said that those polishing pads having satisfactory planarizing characteristics are obtained.

A still further object of this invention is to provide a polishing pad excellent in planarizing characteristics of a material to be polished.

A polishing pad using a conventional polyurethane sheet provided with a cushion layer has the following problems.

(1) A nonwoven fabric having continuous pores impregnated with resin is widely used as the cushion layer, but there are problems such as variation among nonwoven fabrics and a change in compression characteristics due to immersion in slurry.

(2) A foamed urethane foam having independent pores comes to be used, but there are still problems such as difficult stabilization of a foamed state in production, significant residual strain resulting from the pores subjected to repeated loading, etc.

A still other problem of this invention is to provide a cushion layer which can reduce variations in compression characteristics, a change in compression characteristics due to immersion in slurry, and the influence of residual strain of the polishing layer upon repeated loading.

<[II] Slurry-Free Polishing Pad>

For the polishing pad used in CMP, the following techniques are known:

1) A polishing pad having a synthetic leather layer as a polishing layer laminated on an elastic polyurethane layer (U.S. Pat. No. 3,504,457).

2) A polishing pad structured by laminating a foamed polyurethane layer with a nonwoven fabric impregnated with polyurethane (JP-A 6-21028).

3) A polishing pad provided with a polishing surface and a rigid element of selected rigidity and thickness adjacent to the polishing surface and with an elastic element adjacent to the rigid element to endow the rigid element with substantially uniform strength, characterized in that the rigid element and the elastic element give elastic flex strength to the polishing surface to induce the controlled flex of the polishing surface so as to fit it to the whole shape of the surface of the material polished and to maintain rigidity controlled for the local shape of the surface of the material polished (JP-A 06-077185).

4) A polishing cloth comprising a surface layer A having high longitudinal elastic coefficient EA and a lower layer B having low longitudinal elastic coefficient EB, characterized by being provided with a middle layer M having higher longitudinal elastic coefficient than that of the layer B between the layers A and B (JP-A 10-156724).

5) A pad composed of a polishing layer, a middle layer having higher elasticity than that of the polishing layer, and a soft lower layer, wherein the middle layer is divided (JP-A 11-48131).

The polishing pads 1) to 5) described have the following problems:

1) For the uniformity of the whole surface, the elastic polyurethane layer in this system plays a role in making loading applied to a wafer uniform, and since a soft synthetic leather is used as the outermost polishing layer, there is no problem such as scratches, but there is the problem of poor planarizing characteristics in finite regions.

2) In the stacked type of polyurethane and a nonwoven fabric, the nonwoven fabric layer acts the same role as the elastic polyurethane layer in the above-mentioned 1), to achieve uniformity. Further, the polishing layer has a rigid foamed polyurethane layer and is thus superior to the synthetic leather in planarizing characteristics, but does not reach levels required in recent years for improving planarizing characteristics in finite regions and for polishing metal layers. Further, the planarizing characteristics can be improved by further increasing the hardness of the rigid urethane layer, but in this case, scratches occur frequently, thus making this prior art pad unpractical.

3) The structure having a polishing layer, a rigid layer and an elastic layer is constituted so as to have suitable hardness not causing scratches on the polishing layer as the surface layer and to permit the second rigid layer to improve planarizing characteristics deteriorated due to low rigidity. This is to solve the problem in the system in the above-mentioned 2), but in this case, the thickness of the polishing layer is specified to be 0.003 inch or less, and with this thickness given, the polishing layer is also shaved to reduce the longevity of the product.

4) The basic idea in this system is the same as in the above-mentioned 3), and the range of the elastic modulus of each layer is limited to achieve a more efficient range, but in this system, there is no substantial realizing means, thus making production of the polishing pad difficult.

5) The basic idea in this system is also the same as in the above-mentioned 3), but the middle rigid layer is divided in a certain predetermined size to further improve uniformity in the surface of a wafer. However, the step for dividing the layer costs much, thus failing to provide an inexpensive polishing pad.

Further, these polishing pads in 1) to 5) requires expensive slurry to flow during polishing, thus leading to an increase in production costs. Accordingly, a fixed abrasive polishing pad containing abrasive grains in a polishing layer has been developed. Unlike the polishing pad in a free abrasive grain system, the fixed abrasive polishing pad does not require expensive slurry to flow during the polishing step.

As the fixed abrasive polishing pad, for example 6) a polishing pad constituted by mixing cerium oxide particles with foamed urethane resin is disclosed (JP-A 2000-354950, JP-A 2000-354950). In this polishing pad, however, there is a problem that since the density of abrasive grains in the polishing layer is not so high, slurry should be used simultaneously in order to increase the polishing rate.

Further, 7) a polishing pad produced by dispersing abrasive grains in a binder solution in a solvent and coating the dispersion onto a film is disclosed (JP-A 2000-190235). However, there is a problem that this polishing pad comprises the resin and abrasive grains mixed merely in a solvent, thus undergoing aggregation of the grains to generate scratches easily.

Further, 8) a polishing pad produced by secondarily aggregating primary abrasive grains of 0.5 μm or less so as not to contain a binder resin and fixing the resulting granulated particles of 1 to 30 μm via binder resin onto a substrate (JP-A 2000-237962). In this polishing pad, abrasive grains are positively aggregated to introduce the abrasive grains efficiently into the resin, but there is a problem that the aggregates cause scratches easily.

Further, 9) a polishing pad produced by mixing abrasive grains having the maximum particle diameter of 2 μm with a resin material whose particles having an average particle diameter of 50 μm or less are solid at ordinary temperature, then introducing the mixed material into a mold and compression molding it under heating is disclosed (JP-A 2000-190232). However, this polishing pad has a problem that the resin powder is hardly uniformly mixed with the abrasive grains at an initial stage, and when the density of grain particles in the polishing pad is increased, the binder resin is decreased to make molding difficult.

As described above, there is no satisfactory pad in the fixed abrasive polishing pad at present.

A further object of this invention is to provide a polishing pad which is used as a pad for semiconductor wafers in the polishing step of planarizing fine unevenness on a fine pattern on a semiconductor wafer, is excellent in polishing characteristics without using slurry, and generates few scratches.

A still further object of this invention is to provide a polishing pad for semiconductor wafers, which is used as a pad in the polishing step of planarizing fine unevenness on a fine pattern on a semiconductor wafer, can have abrasive grains mixed at very high density without using slurry, and generates few scratches in spite of dispersion of abrasive grains at high density.

SUMMARY OF THE INVENTION

<[I] Polishing Pad>

The present invention relates to a polishing pad having a polishing layer, characterized in that the polishing layer is formed from a curing composition to be cured by energy rays, and the patterns of the surface of the polishing layer is formed by photolithography.

The polishing pad can be easily processed to form a sheet or grooves etc. on the surface, is excellent in thickness accuracy, and achieves a high and uniform polishing rate.

Preferably, the polishing pad has a static friction coefficient of 1.49 or less and a dynamic friction coefficient of 1.27 or less on a glass under a loading of 4400 gf.

In the polishing pad, the curing composition preferably contains a solid polymer compound.

The polishing pad may be used as such by using its polishing layer as the polishing pad, or the polishing pad may have a cushion layer laminated at the back thereof (other side than the polishing surface).

In the polishing pad having a polishing layer, it is preferable that the polishing layer is free of pores and has a storage elastic modulus of 200 MPa or more, and the storage elastic modulus of the cushion layer is lower than that of the polishing layer.

Conventionally, an elastic modulus of a polishing layer, such as hydraulic module, tensile elastic modulus or bending elastic modulus, is determined under static conditions. In actual polishing, however, a semiconductor wafer to be polished and the polishing pad are rotated, and the polishing pad is repeatedly and periodically pressurized and released. In this invention, therefore, a difference in deformation of the surface of the polishing layer in the polishing pad was examined from the viewpoint of storage elastic modulus considered to correspond to elastic modulus under dynamic conditions. As a result, the present inventors found that the problems related to the planarizing characteristics of a polished object, caused by the conventional polishing pad having a polishing layer of low storage elastic modulus, can be solved by using a material having a higher storage elastic modulus (that is, at least 200 MPa) than that of the conventional polishing layer.

The storage elastic modulus referred to in this invention is comparable with elastic modulus in dynamic viscoelasticity, and indicates the rigidity of a material subjected to dynamic vibration or deformation. As shown in FIG. 5, a polishing pad 31 having such high storage elastic modulus undergoes less deformation upon periodical deformation and is excellent in the flatness of an insulating layer 34 between patterns 33 in a circuit pattern 32 in a semiconductor wafer.

The storage elastic modulus of the polishing layer is preferably 200 MPa or more, and the upper limit of the storage elastic modulus of the polishing layer is not particularly limited, but when the storage elastic modulus is too high, the semiconductor wafer may be scratched, and thus the storage elastic modulus is preferably 2 GPa or less, more preferably 1.5 GPa or less, still more preferably 1 GPa or less. In particular, the storage elastic modulus is preferably 200 MPa to 2 GPa, more preferably 200 MPa to 1 GPa. The polishing layer is preferably a layer free of pores. For increasing the storage elastic modulus of the polishing layer to 200 MPa or more, the polishing layer is made preferably of a layer free of pores such as those in a foam etc.

In addition to the polishing layer having a storage elastic modulus of 200 MPa or more, the polishing pad preferably has a cushion layer having lower storage elastic modulus than that of the polishing layer. When the polishing layer has high storage elastic modulus, the undulation and warp of a material to be polished are increased, but by arranging a cushion layer, the highly rigid polishing layer improves fitness for a material to be polished, and the cushion layer absorbs the undulation of the material to be polished. Accordingly, even if a polishing layer having high storage modulus is used, the uniformity (planarizing characteristics) of the polished surface of the material to be polished is not deteriorated. The storage elastic modulus of the cushion layer is not particularly limited insofar as it is lower than the storage modulus of the polishing layer, and the storage modulus is preferably about 0.1 to 100 MPa, more preferably 0.1 to 50 MPa, still more preferably 0.1 to 30 MPa, in order to improve planarizing characteristics.

In the polishing pad of this invention, the polishing layer preferably comprises a polishing surface layer and a backside layer, and the backside layer is formed from an energy ray-curing composition to be cured with energy rays, and the backside layer is a cushion layer formed patterns by photolithography.

The action of the polishing pad having the constitution described above is that the polishing pad is free of a variation in qualities due to an individual variation, easily enables a change in formed patterns, enables to form fine pattern, is compatible with various materials to be polished, and is free of burrs upon forming pattern.

In the polishing pad, the backside layer is formed preferably from a curing composition to be cured with energy rays, and the backside layer is a cushion layer formed pattern by photolithography.

The action of the polishing pad thus constituted is that pressure received by the polishing surface can be relieved without separately laminating a cushion layer, and the polishing characteristics can be improved. Further, the polishing pad can be produced at low costs without necessity for the step of laminating a cushion layer, and the polishing pad has a cushion layer adhering strongly to and integrated with the polishing layer.

In the polishing pad of this invention, it is preferable that the polishing layer comprises a polishing surface layer and a backside layer, and the hardness of the polishing surface layer is higher than the hardness of the backside layer, and the difference in hardness in Shore D hardness is 3 or more.

According to such constitution, there can be obtained a polishing pad having a high polishing rate, being excellent in uniformity of a material polished and in a difference in step height, and not necessitating sticking a cushion layer made of another material on the attachment side for a platen. That is, the polishing pad does not necessitate arranging a cushion layer separately between the polishing pad and a platen by forming a backside layer of low hardness at the side of the polishing layer to which a platen is attached. When the difference in hardness is less than 3, the resulting pad necessitates lamination with a cushion layer made of another material, as required in the prior art.

The backside layer may be formed such that its hardness is decreased continuously from the polishing layer to the side attached to the platen, or the backside layer may be constituted to be a multi-layer structure in which the hardness of the surface of the backside layer serving as the side attached to the platen is higher than that of the middle region, or the backside layer may be constituted to be a two-layer structure in which the hardness of the surface of the backside layer is the same as that of the middle region, that is, the backside layer has uniform hardness. The difference in hardness defines as a difference from the region of lowest hardness in the backside layer. In the case of the multi-layer structure, the polishing surface of the polishing pad and the surface of the backside layer may have almost the same hardness, and in this case, either the front or back of the polishing pad can be used as a polishing surface. When the outermost surface layer and the outermost backside layer have the almost the same hardness while the hardness of the middle layer is lower than that of the two, the difference in hardness defines as a difference in hardness between the outermost surface or backside layer and the middle layer.

It is preferable that the above-described polishing pad attains the above difference in hardness by applying energy rays and/or heat to a sheet having the polishing layer and the backside layer each formed from a curing composition, so that the polishing pad having the predetermined difference in hardness can be easily produced.

The phrase "applying energy rays and/or heat" refers to irradiating energy rays or heat to the sheet of an unreacted curing composition, to cure it so as to attain the predetermined difference in hardness depending on each region. The difference in hardness is attained by control of energy volume. The control of energy volume is conducted by controlling temperature, time etc. in the case of heating or by controlling irradiation conditions such as intensity of energy rays, irradiation time etc., regulating the transparency of the curing composition, selecting components such as a photoinitiator, or regulating the amounts of the components in the case of energy rays.

In the polishing pad of this invention, it is preferable that the polishing layer and the backside layer are formed continuously into one body from the same curing composition.

Such a polishing pad having the polishing layer and the cushion layer formed into one body can be easily produced.

The compressibility of the polishing layer in the polishing pad is preferably 0.5% or more in consideration of the cushioning characteristics of the polishing layer. It is more preferably 1.5% or more. The compression recovery of the polishing layer is preferably 50% or more in consideration of the cushioning characteristics of the polishing layer.

The polishing layer can be foamed by mechanical foaming or chemical foaming to improve its elastic modulus.

Preferably, the surface of the polishing layer is formed grooves through which slurry used in polishing flows.

Preferably, the surface of the polishing layer is formed grooves in which slurry used in polishing is stored.

Preferably, the material polished is a semiconductor wafer or a glass substrate for precision instruments.

This invention relates to a method of producing a polishing pad having a polishing layer, characterized in that the polishing layer is produced by a photolithographic method comprising:

(1) the step of forming a sheet molding from a curing composition containing at least an initiator and an energy ray-reactive compound to be cured with energy rays, (2) the step of exposing the sheet molding to energy rays to induce modification thereof, to change the solubility of the sheet molding in a solvent, and (3) the step of developing the sheet molding after irradiation with energy rays, to partially remove the curing composition with a solvent thereby forming an surface pattern at least one side.

Such a production method is a photolithographic method, and according to the photolithographic method, there can be produced a polishing pad which is free of quality variation resulting from an individual variation, easily enables a change surface patterns, enables to form fine surface pattern, is compatible with various materials to be polished, and is free of burrs in forming a surface pattern.

The method of producing the polishing pad comprising the polishing surface layer and the backside layer formed continuously into one body from the curing composition to be cured with energy rays is characterized by having the steps of forming a sheet of the curing composition, exposing the sheet via a masking material to energy rays, and developing the sheet to dissolve and remove the unexposed curing composition to form a surface pattern thereon.

By the method having such constitution, the pattern on the surface of the polishing layer and the backside layer having a cushion part can be produced in one step, to give the polishing pad at low costs.

The step of exposing the polishing layer to light and the step of exposing the backside layer to light may be carried out separately, or both sides may be simultaneously exposed to light.

In the method of producing the polishing pad comprising the polishing layer and the backside layer formed continuously formed into one body wherein the hardness of the polishing layer is higher than the hardness of the backside layer, and the difference in hardness in Shore D hardness is 3 or more, it is preferable that the difference in hardness is given preferably by applying energy rays and/or heat to the sheet molding of the curing composition.

The polishing pad of this invention can be used alone without a cushion layer, but can be laminated with a sheet, a nonwoven fabric or a woven fabric having compression characteristics different from those of the polishing layer.

Another aspect of this invention relates to a polishing pad comprising at least a polishing layer and a cushion layer, characterized in that the polishing layer is free of pores and has a storage elastic modulus of 200 MPa or more, and the storage elastic modulus of the cushion layer is lower than that of the polishing layer.

In a preferable mode of the polishing pad, the surface of the polishing layer is provided with grooves through which slurry used in polishing flows. In another preferable mode of the polishing pad, the surface of the polishing layer is provided with grooves in which slurry used in polishing is stored. The material to be polished is preferably a semiconductor wafer or a glass substrate for precision instruments.

A still another aspect of this invention relates to a polishing pad comprising a polishing layer and a backside layer, characterized in that the polishing layer and the backside layer are formed continuously into one body, and the hardness of the polishing layer is higher than the hardness of the backside layer, and the difference in hardness in Shore D hardness is 3 or more.

In the polishing pad, it is preferable that the surface of the polishing layer is formed with grooves through which slurry used in polishing flows.

In the polishing pad, it is preferable that the surface of the polishing layer is formed with grooves in which slurry used in polishing is stored.

In the polishing pad, it is preferable that the material to be polished is preferably a semiconductor wafer or a glass substrate for precision instruments.

<[I] Cushion Layer for the Polishing Pad>

The cushion layer for the polishing pad of the present invention is a cushion layer for the polishing pad consisting of a polishing layer and a cushion layer, characterized in that the compression recovery is 90% or more.

In the cushion layer, there is less variation in compression characteristics, and the change of compression characteristics due to immersion in slurry is low, and the influence of residual strain caused by repetitive loading on the polishing layer can be reduced.

The cushion layer for the polishing pad preferably comprises a compound having rubber elasticity.

The surface (at the platen attachment side) of the cushion layer for the polishing pad is preferably formed pattern.

By subjecting the platen attachment side to forming to form protrusions, grooves etc., its area is reduced. Strain loaded can thereby be increased to increase compression strain, thus increasing compressibility.

The surface pattern is conducted preferably to form a groove structure or a half-tone dot structure.

If the Shore D hardness of the polishing surface side of the pad is less than 50, the hardness of the polishing surface is too low, while if the compressibility is 2.0% or more, there may arise the problem of a reduction in planarization accuracy. 50% or less compression recovery is not preferable because non-recovery deformation may be caused.

On one hand, the planarization accuracy is improved by increasing the rigidity of the polishing surface, but the surface uniformity is lowered. Accordingly, the pad provided with a cushion layer to increase the compressibility and compression recovery is required.

The cushion layer for the polishing pad of this invention preferably has 90% or more compression recovery.

<[II] Slurry-Free Polishing Pad>

The slurry-free polishing pad of this invention is as follows:

A polishing pad having a polishing layer having abrasive grains dispersed in a resin, characterized in that the resin is a resin contains ionic groups in the range of 20 to 1500 eq/ton.

The resin forming the polishing layer constituting the polishing pad of this invention has ionic groups in an amount of 20 to 1500 eq/ton and can incorporate abrasive grains in a stably dispersed state to form a composite, and even if abrasive grains are contained at high density, the resin can reduce scratches resulting from aggregation of the abrasive grains. Further, the ionic groups of the resin are water-soluble or water-dispersible, and by water supplied in the polishing process, the affinity for a material to be polished is improved to increase the polishing rate and to exhibit polishing characteristics excellent in planarization and uniformity. From this viewpoint, the amount of ionic groups possessed by the resin is preferably 20 eq/ton or more, more preferably 100 eq/ton or more, still more preferably 200 eq/ton or more. When the ionic groups are increased, the water solubility or water dispersibility becomes too strong, and thus the amount of ionic groups possessed by the resin is preferably up to 1500 eq/ton, more preferably up to 1200 eq/ton, still more preferably up to 1100 eq/ton.

In the polishing pad, the resin forming the polishing layer is a polyester resin, and the ratio of aromatic dicarboxylic acids in the whole carboxylic acid components constituting the polyester resin is preferably 40 mol-% or more.

The resin forming the polishing layer is not particularly limited, and various resins can be used, but the polyester resin is preferable in that ionic groups can be easily introduced. In consideration of the polishing properties of the surface of the polishing layer, the glass transition temperature of the resin forming the polishing layer is preferably 10° C. or more, more preferably 20 to 90° C. For example, when the content of aromatic dicarboxylic acids in the whole carboxylic acid component constituting the polyester resin is 40 mol-% or more, the glass transition temperature can be in the above-defined range. The content of the aromatic dicarboxylic acids is more preferably 60 mol-% or more.

The polishing pad of this invention is a polishing pad having a polishing layer having abrasive grains dispersed in a resin, characterized in that the main chain of the resin is a polyester containing at least 60 mol-% aromatic dicarboxylic acid in the whole carboxylic acid component, and the side chain of the resin is a polymer of radical polymerizable monomers containing hydrophilic functional groups.

The polishing pad of this invention is a polishing pad having polishing layer having abrasive grains dispersed in a resin, characterized in that the main chain of the resin is polyester polyurethane based on a polyester containing at least 60 mol-% aromatic dicarboxylic acid in the whole carboxylic acid component, and the side chain of the resin is a polymer of radical polymerizable monomers containing hydrophilic functional groups.

Preferably, the specific gravity of the resin forming the polishing layer in the polishing pad is in the range of 1.05 to 1.35, and the glass transition temperature is 10° C. or more.

For producing a viscosity polishing surface to achieve good polishing, it is preferable that the specific gravity of the resin forming the polishing layer is in the range of 1.05 to 1.35, and the glass transition temperature is 10° C. or more.

In the polishing pad, the resin forming the polishing layer is preferably a mixture of a resin having a glass transition temperature of 60° C. or more and a resin having a glass transition temperature of 30° C. or less.

The resin dispersing abrasive grains used in this invention is composed preferably of a mixture of at least two kinds of resins, that is, a resin having a glass transition temperature of 60° C. or more and a resin having a glass transition temperature of 30° C. or less. When only the resin having a glass transition temperature of 60° C. or more is used, its coating may be shrunk at the time of drying, and the coating cannot endure the shrinkage stress, to generate wrinkles on the surface. When only the resin having a glass transition temperature of 30° C. or less is used, its coating surface is excellent but it is a sticky surface to increase the frictional resistance significantly during polishing, thus failing to achieve stable polishing. Accordingly, at least two resins having different glass transition temperatures should be mixed with good balance.

One of the two resins preferably has a glass transition temperature of 50° C. or more, and the other resin preferably has a glass transition temperature of 20° C. or less. When the polishing layer is formed from only the resin having a glass transition temperature of 50° C. or more, the surface of its coating undergoes cracking during drying to fail to give a good coating.

The average diameter of abrasive grains in the polishing pad is preferably 5 to 1000 nm.

The abrasive grains are preferably fine abrasive grains whose average particle diameter is 5 to 1000 nm. When the average particle diameter of the abrasive grains is decreased, the dispersibility thereof in the resin having ionic groups may be deteriorated to make mixing thereof in the resin difficult, and thus the average particle diameter of the abrasive grains is preferably 5 nm or more, more preferably 10 nm or more, still more preferably 20 nm or more. When the polishing layer containing abrasive grains having a large average particle diameter is used in polishing, large mars may be given to a material polished, and thus the average particle diameter of the abrasive grains is preferably 1000 nm or less, more preferably 500 nm or less, still more preferably 100 nm or less.

In the polishing pad, the abrasive grains are made preferably of at least one material selected from silicon oxide, cerium oxide, aluminum oxide, zirconium oxide, ferric oxide, chrome oxide and diamond.

In the polishing pad, the content of abrasive grains in the polishing layer is preferably 20 to 95% by weight.

Because the content of abrasive grains in the polishing layer is decreased, a sufficient polishing rate cannot be achieved, and thus the content of the abrasive grains is preferably not less than 20% by weight, more preferably not less than 40% by weight, still more preferably not less than 60% by weight, in order to increase the polishing rate. On the other hand, when the content of the abrasive grains is increased, the ability to form the polishing layer may be deteriorated, and thus the content of the abrasive grains is preferably not higher than 95% by weight, more preferably not higher than 90% by weight, still more preferably not higher than 85% by weight.

In the polishing pad, the polishing layer preferably has voids. The average diameter of the voids is preferably 10 to 100 μm.

The polishing pad having voids in the polishing layer can achieve a stable and high polishing rate. The void diameter (average diameter) is not particularly limited, but for achieving a stable polishing rate, the void diameter is preferably 10 μm or more, more preferably 20 μm or more. Further, when the void diameter is increased, the substantial area of the polishing layer in contact with a material to be polished tends to be decreased, and for achieving a high polishing rate, the void diameter is preferably 100 μm or less, more preferably 50 μm or less. The proportion of the voids in the polishing layer can be determined suitably depending on the material to be polished, and generally the content is about 5 to 40% by volume, preferably 10 to 30% by volume based on the polishing layer.

The polishing pad of this invention preferably comprises the polishing layer formed on a polymer substrate.

The polymer substrate is preferably a polyester sheet, acryl sheet, ABS resin sheet, polycarbonate sheet or vinyl chloride resin sheet. The polymer substrate is particularly preferably a polyester sheet.

The polishing pad comprising the polishing layer formed on a polymer substrate can be used. The polymer substrate is not particularly limited, but those described above are preferable, and particularly the polyester sheet is preferable in respect of adhesion, strength and environmental stress.

In the polishing pad, the thickness of the polishing layer is preferably 10 to 500 μm.

The polishing pad of this invention is characterized in that a cushion layer of softer material than the polishing layer is laminated on a polymer substrate having the polishing layer formed thereon.

In the polishing pad, the cushion layer is preferably 60 or less in terms of Asker C hardness.

In the polishing pad, the cushion layer to be laminated is preferably a nonwoven fabric of polyester fibers, the nonwoven fabric impregnated with polyurethane resin, a polyurethane resin foam, or a polyethylene resin foam.

In this invention, the polymer substrate supporting the resin layer (polishing layer) having abrasive grains dispersed therein is further laminated with a softer cushion layer, whereby the uniformity of the polishing rate on the whole surface of a silicon wafer after polishing is improved. The cushion layer used in this invention is preferably 60 or less in terms of Asker C hardness in order to secure the uniformity of the wafer. The cushion layer of this invention can be a nonwoven fabric of preferably polyester fibers or the nonwoven fabric impregnated with polyurethane resin in order to realize an Asker C hardness of 60 or less. In particular, the polyurethane resin foam or polyethylene resin foam is preferably used. The thickness of the cushion layer also affects the uniformity of polishing, and thus the thickness is preferably in the range of 0.5 to 2 mm.

In the polishing pad, the thickness of the polishing layer is preferably 250 μm to 2 mm.

When the adhesion strength between the polishing layer and the polymer substrate in the polishing pad is examined in a crosscut test, the number of remaining regions is preferably 90 or more.

In the polishing pad, the polymer substrate and the cushion layer are stuck preferably via an adhesive or a double-coated tape.

The adhesion strength between the polymer substrate and the cushion layer in the polishing pad is preferably a strength of 600 g/cm or more in a 180° peeling test.

The polishing pad of this invention is formed preferably with grooves on the polishing layer.

The grooves are preferably lattice-shaped. The groove pitch is preferably 10 mm or less. The grooves are preferably concentric circle-shaped. The depth of the groove is preferably 300 μm or more.

The polishing layer in the polishing pad of this invention can be processed to form grooves. When the polishing layer do not have grooves, a wafer sticks during polishing to the polishing layer to generate very large frictional force, and there is the case where the wafer cannot be maintained, thus making polishing impossible. The shape of the manufactured grooves in this invention includes, but is not limited to, shapes such as those of punched hole-shaped, radial grooves, latticed grooves, concentric circle-shaped grooves, spiral grooves, arc-shaped grooves etc., preferably latticed or concentric circle-shaped grooves. The depth of grooves in this invention is preferably 300 μm or more from the viewpoint of drainage, abrasion dust discharge etc. When latticed grooves are formed in this invention, the groove pitch is preferably 10 mm or less. When the grove pitch is greater than 10 mm, the effect of the grooves formed is decreased, and the wafer sticks as described above. The method of making grooves in this invention is not particularly limited, and for example, formation of grooves by grinding with abrasive grains, formation of grooves by cutting with a metal bite, formation of laser grooves by e.g. a $CO_2$ gas laser, formation of grooves by pressing, before drying, the resin layer mixed with abrasive grains against a mold, and formation of grooves by forming a complete coating layer and then pressing it against a grooved mold.

DETAILED DESCRIPTION OF THE PREFERRED EMBODIMENT

<[I] Polishing Pad>

Figure 1:
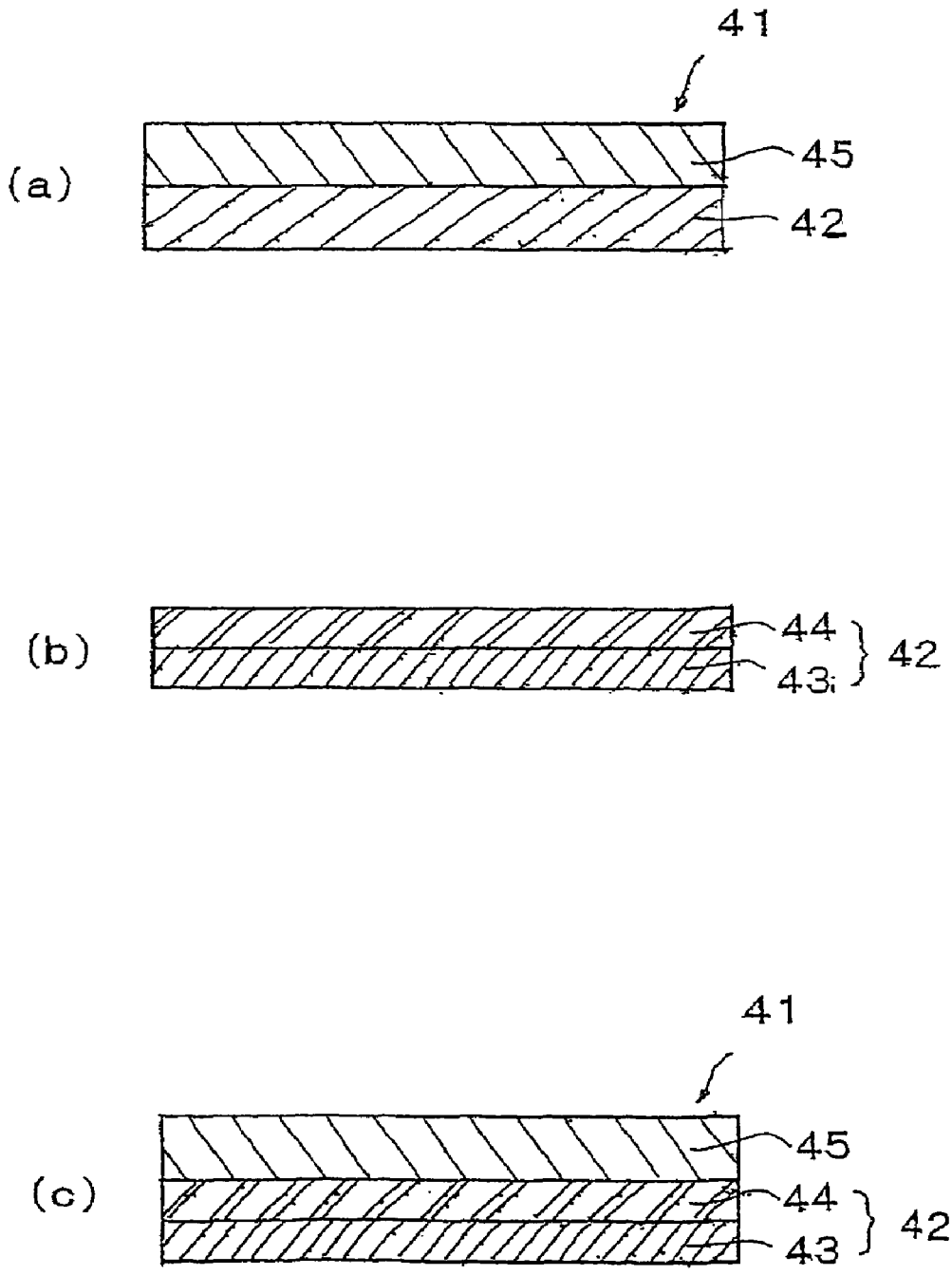
FIG. 1 is a section showing the constitution of the polishing pad.

The constitution of the polishing pad is shown in FIG. 1.

FIG. 1(*a*) shows a polishing pad 41 having a general constitution consisting of a polishing layer 42 and a cushion layer 45. FIG. 1(*b*) shows a polishing layer 42 having a polishing surface layer 43 and a backside layer 44 formed from a sheet molding of a curing composition to be cured by irradiation with energy rays, and the polishing layer 42 can be used as a polishing pad when the backside layer 44 has characteristics as a cushion layer. FIG. 1(*c*) shows an example of a polishing pad having a cushion layer 45 laminated at the side of the backside layer 44 in the polishing layer 42 shown in FIG. 1(*b*).

In formation of the polishing layer or the polishing pad in this invention by using an energy ray-reactive composition, the energy ray-reactive composition contains an initiator and an energy ray-reactive compound. The energy ray-reactive compound may be either a solid energy ray-reactive polymer compound or a liquid energy ray-reactive compound, and preferably the liquid energy ray-reactive compound further contains a solid polymer compound (polymer resin). When it is rendered insoluble in a solvent by energy rays, both the solid energy ray-reactive polymer compound and the liquid energy ray-reactive compound are used preferably as the energy ray-reactive compound in order to achieve rapid reaction with energy rays. (Hereinafter, the energy ray-reactive compound is also referred to as photosetting compound.)

The solid mentioned in this invention refers to the one which is not fluidic at 25° C., and fluidity refers to the one causing a material to spread with time on a flat surface. Rubber and viscoelastic substance do not spread with time and thus fall under the scope of solid in this invention.

The solid energy ray-curing composition of this invention is a composition free of fluidity at room temperature and causing chemical reaction particularly polymerization reaction by energy rays. The energy rays referred to in this invention include visible rays, UV rays, electron beam, ArF laser light, KrF laser light etc.

As the energy ray curing compound especially the photosetting compound, compounds capable of polymerization and crosslinking reaction by light can be used without limitation, and monomers, oligomers, polymers or mixtures thereof can be used. Such compounds include polyvalent alcohol (meth)acrylate (acrylate and/or methacrylate), epoxy(meth)acrylate, (meth)acrylate having a benzene ring in the molecule thereof, and polyoxyalkylene polyol(meth) acrylate, and these are used alone or in combination thereof. The (meth)acrylates include, for example, the following compounds:

The polyvalent alcohol acrylate or methacrylate includes, for example, diethyleneglycol dimethacrylate, tetraethylene glycol diacrylate, hexapropyleneglycol diacrylate, trimethylol propane triacrylate, pentaerythritol triacrylate, 1,6-hexanediol diacrylate, 1,9-nonanediol diacrylate, dipentaerythritol pentaacrylate, trimethylolpropane trimethacrylate, oligobutadienediol diacrylate, lauryl methacrylate, polyethyleneglycol diacrylate, N,N-dimethyl aminopropyl methacrylamide, trimethylolpropane triacrylate and trimethylolpropane trimethacrylate, etc.

The epoxy acrylates include, for example, 2,2-bis(4-methacryloxyethoxyphenyl)propane, 2,2-bis(4-acryloxyethoxyphenyl)propane, trimethylolpropane monoglycidyl ether or diglycidylether acrylate or methacrylate, or derivatives produced by esterifying a hydroxyl group of or bisphenol A/epichlorohydrin-based epoxy resin (bisphenol-based epoxy resin) with acrylic acid or methacrylic acid, etc.

The (meth)acrylate having a benzene ring in the molecule thereof includes, for example, low-molecular unsaturated polyesters such as condensates of phthalic anhydride-neopentyl glycol-acrylic acid, etc.

The polyoxyalkylene polyol(meth)acrylate includes, for example, methoxypolyethyleneglycol acrylate, methoxy polypropyleneglycol acrylate, methoxypolypropylene glycol methacrylate, phenoxypolyethyleneglycol acrylate, phenoxy polyethyleneglycol methacrylate, phenoxypolypropylene glycol acrylate, phenoxypolypropyleneglycol methacrylate, nonylphenoxypolyethyleneglycol acrylate, nonylphenoxy polypropyleneglycol methacrylate, nonylphenoxypropylene glycol acrylate and nonylphenoxypolypropyleneglycol methacrylate, etc.

In a preferable mode, urethane-based curing compounds, particularly urethane-based (meth)acrylate compounds are used in place of, or together with, the above-mentioned (meth)acrylates. The urethane-based curing compounds are obtained by reacting a multifunctional active hydrogen compound with a polyisocyanate compound and a vinyl polymerizable compound having an active hydrogen group.

As the polyisocyanate compound constituting the urethane-based curing compound, compounds known in the field of polyurethane can be used without limitation. Examples thereof include aromatic diisocyanates such as 2,4-toluene diisocyanate (TDI) and 4,4'-diphenylmethane diisocyanate (MDI), aliphatic or alicyclic diisocyanate such as hexamethylene diisocyanate and isophorone diisocyanate, and xylylene diisocyanate.

The vinyl polymerizable compound having an active hydrogen group constituting the urethane-based curing compound includes, for example, compounds having a hydroxyl group and an ethylenically unsaturated group, such as 2-hydroxyethyl acrylate and 2-hydroxypropyl acrylate.

The multifunctional active hydrogen compound constituting the urethane-based curing compound includes, for example, a low-molecular polyol such as ethylene glycol and propylene glycol, a polyoxypropylene polyol having a molecular weight of 400 to 8000, polyether polyols such as polyoxyethylene glycol and polyoxytetramethylene polyol obtained by ring-opening of a cyclic ether such as ethylene oxide, propylene oxide or tetrahydrofuran, a polyester polyol composed of a dicarboxylic acid such as adipic acid, azelaic acid or phthalic acid with a glycol, and polyester polyols and polycarbonate polyols as polymers produced by ring-opening of lactones such as ε-caprolactone. Among these polyol compounds, the polyether-based polyol is used preferably because of its higher effect on improvement in compression characteristics. These urethane-based curing compounds may be used alone or as a mixture of two or more compounds different in characteristics.

The urethane-based curing compounds can be produced for example by the method exemplified below.

(1) A multifunctional active hydrogen compound i.e. glycol and a diisocyanate compound are reacted in such a ratio that the isocyanate group/active hydrogen group (NCO/OH) equivalent ratio is 2 to form an NCO-terminated prepolymer, and then a compound having a hydroxyl group and an ethylenically unsaturated group and the NCO-terminated prepolymer are reacted in an NCO/OH ratio of 1.

(2) A compound having a hydroxyl group and an ethylenically unsaturated group and a diisocyanate compound are reacted in an NCO/OH ratio of 2, to form a compound having an NCO group and an ethylenically unsaturated group, and then this compound and a polyol compound are reacted in an NCO/OH ratio of 1.

As the urethane-based curing compound, there are commercial products such as UA-306H, UA-306T, UA-101H, Actilane 167, Actilane 270 and Actilane 200 (AKCROS CHEMICALS), which can be preferably used.

As the liquid light-reactive compound, the one effecting chemical reaction by light can be used without limitation, and for improving sensitivity, the compound having photosensitive groups at higher density in the molecule thereof is preferably used. The compound wherein the density of photosensitive groups is 30 weight % or more is preferable. Examples thereof include, but are not limited to, C7 or less alkyl diol dimethacrylate, trimethylolpropane trimethacrylate, and dipentaerythritol hexaacrylate. These liquid light-reactive compounds are used in combination with a solid polymer compound. The solid polymer compound is preferably a solid light-reactive polymer compound.

The solid light-reactive polymer compound used as a material constituting the curing composition can be used without limitation insofar as it effects chemical reaction by light, and examples thereof include:

1) a polymer comprising a compound having an active ethylene group or an aromatic polycyclic compound introduced into a main chain or side chain of the polymer; that is, an unsaturated polyester having polyvinyl cinnamate and p-phenylene diacrylic acid polycondensated with glycol, an ester having cinnamylidene acetic acid with polyvinyl alcohol, and a polymer having a photosensitive group such as cinnamoyl group, cinnamylidene group, chalcone residue, isocoumarin residue, 2,5-dimethoxystilbene residue, styryl pyridinium residue, thymine residue, α-phenyl maleimide, anthracene residue or 2-pyrone introduced into a main chain or side chain of the polymer, 2) a polymer having a diazo group or azide group introduced into a main chain or side chain of the polymer; that is, a p-diazodiphenyl amine/p-formaldehyde condensate, a benzenediazonium-4-(phenylamino)-phosphate/formaldehyde condensate, a methoxybenzenediazodium-4-(phenylamino) salt adduct/formaldehyde condensate, polyvinyl-p-azidobenzal resin, azidoacrylate etc.; and 3) a polymer having a phenol ester introduced into a main chain or side chain of the polymer; that is, a polymer having an unsaturated carbon-carbon double bond such as (meth) acryloyl group introduced into the polymer; unsaturated polyester, unsaturated polyurethane, unsaturated polyamide, polyacrylic acid having an unsaturated carbon-carbon double bond introduced via an ester linkage into a side chain of the polyacrylic acid, epoxy acrylate, novolak acrylate etc.

A variety of photosensitive polyimides, photosensitive polyamide acid, photosensitive polyamide imide, and phenol resin can be used in combination with the azide compound. Epoxy resin and a polyamide having a chemical crosslinked site into it can also be used in combination with a photo cation polymerization initiator. Natural rubber, synthetic rubber, and cyclized rubber can be used in combination with the bisazide compound.

When the curing composition is used to produce the polishing pad of this invention, a photo-initiator is added to the curing composition in a preferable mode. As the initiator, a compound which upon irradiation with energy rays, absorbs the rays to undergo cleavage etc. thus generating polymerizable active species thereby initiating polymerization reaction etc. can be used without limitation. Examples thereof include those initiating photo-crosslinking, those initiating photopolymerization (radical polymerization, cation polymerization, anion polymerization), those changing their structure by light to change dissolution properties, and those generating an acid by light.

The light radical polymerization initiator when UV rays in the vicinity of i-ray (365 nm) are used as the light source includes, for example, aromatic ketones, benzoins, benzyl derivatives, imidazoles, acridine derivatives, N-phenyl glycine, bisazide compounds etc. Specifically, the following compounds are mentioned:

Aromatic ketones: benzophenone, 4,4'-bis(dimethylamino)benzophenone, 4,4'-bis(diethylamino) benzophenone, 4-methoxy-4'-dimethylaminobenzophenone, 2-benzyl-2-dimethylamino-1-(4-morpholinophenyl)-butan-1-one, 2-ethyl anthraquinone, phenanthrene quinone etc.

Benzoins: methyl benzoin, ethyl benzoin etc.

Benzyl derivatives: benzyldimethyl ketal etc.

Imidazoles: 2-(o-chlorophenyl)-4,5-diphenyl imidazole dimer, 2-(o-chlorophenyl)-4,5-di(m-methoxyphenyl)imidazole dimer, 2-(o-fluorophenyl)-4,5-phenyl imidazole dimer, 2-(o-methoxyphenyl)-4,5-diphenyl imidazole dimer, 2-(p-methoxyphenyl)-4,5-diphenyl imidazole dimer, 2-(2,4-dimethoxyphenyl)-4,5-diphenyl imidazole dimer etc.

Acridine derivatives: 9-phenyl acridine, 1,7-bis(9,9'-acridinyl)heptane etc.

The above-mentioned photo-initiators can be used alone or in combination thereof. The amount of these photo-initiators added is preferably about 0.001 to 20% by weight relative to the curing composition.

The cation photo-initiator includes those generating an acid by light. Examples thereof include an aryl diazonium salt, diaryl iodonium salt, triaryl sulfonium salt, triaryl selenonium salt, dialkyl phenacyl sulfonium salt, dialkyl-4-hydroxyphenyl sulfonium salt, sulfonate, iron-arene compound, silanol-aluminum complex etc.

The solid polymer constituting the curing composition in this invention can also be added to improve mechanical characteristics of the polishing pad, such as elastic modulus (Young's modulus), bulk hardness, compressibility and compression recovery and to reduce a change with time in the thickness of the polishing pad before the photo-reaction. Examples thereof include poly(meth)acrylate, polyvinyl alcohol, polyester, polyamide, polyurethane, polyimide, polyamide imide, polycarbonate, polyolefins such as polyethylene and polypropylene, and composites thereof and mixtures thereof, but the solid polymer is not limited insofar as the above-mentioned object can be satisfied.

As the curing composition, a commercial product may be used, and a sheet-shaped curing composition commercially available as a photosensitive sheet can also be used.

The method of producing the polishing layer using the energy ray-curing composition of this invention formed surface pattern by photolithography is described by reference to the drawings.

Figure 2:
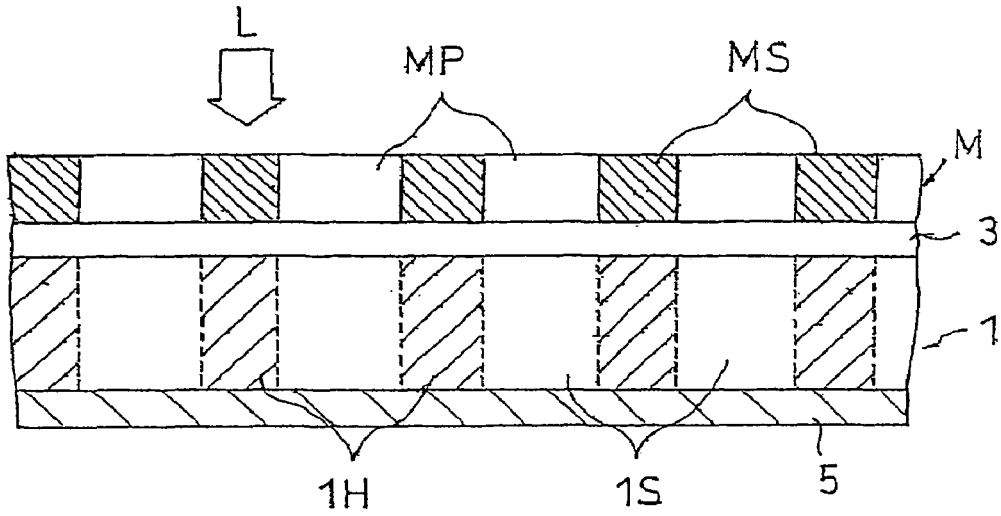
FIG. 2 is a drawing showing that a sheet molding of a curing composition to which a masking material was attached is exposed to light, to form a polishing layer having a concave penetrated in the direction of thickness.

FIG. 2 shows formed surface pattern of the polishing layer in the polishing pad. The sheet molding 1 made of the curing composition is formed between a substrate film 5 and a cover film 3. The cover film 3 is irradiated via a masking material M with a predetermined amount of light L. The mask is provided with a shielding region MS and a light-permeable region MP so as to form a predetermined surface pattern, and by light irradiation, a light exposure region 1S and non-exposed region 1H are formed. When the curing composition is a negative-working composition, the non-exposed region 1H is removed by a solvent etc. (development step), whereby a polishing layer 1 with desired predetermined surface pattern is formed from the sheet molding.

When the polishing pad of this invention is a non-foam, a sticking phenomenon occurs between the polishing pad and a polished material such as a wafer, a glass plate etc., and for example, the wafer during polishing may be detached from its fixing stand. When the polishing pad is a foam, the problem of the sticking phenomenon between the polishing pad and the polished material can be reduced. This is probably because when the polishing pad is a foam, the surface of the polishing layer has a large number of fine pores fluffed at the microscopic level, by which the friction with the material polished is reduced, thus reducing the problem of sticking.

Based on this phenomenon, the friction coefficient of the polishing pad with a glass under a certain loading was examined, and as a result it was found that even if the polishing pad is a non-foam, the occurrence of the sticking phenomenon between the polishing pad and a polished material such as wafer and glass plate can be prevented preferably by forming a pattern on the polishing surface such that the static friction coefficient is 1.49 or less, and the dynamic friction coefficient is 1.27 or less.

The effect of the formed pattern on the polishing surface also stands in the polishing step without a dressing step. The dressing step refers to a step wherein because abrasive grains, abraded dust etc. in slurry are accumulated in pores on the polishing surface during polishing, to reduce the polishing rate, the polishing surface is dressed at certain intervals with a head having abrasive grains of diamond deposited thereon, to renew the polishing surface. Even if the polishing pad of this invention is used as a dress-free polishing pad eliminating the dressing step, the effect of the friction coefficient is maintained.

However, the above dressing step does not include dressing conducted at the start of polishing to improve the flatness of the polishing pad.

The polishing pad is obtained by laminating the polishing layer 1 with a backside layer serving as a cushion layer.

Figure 3:
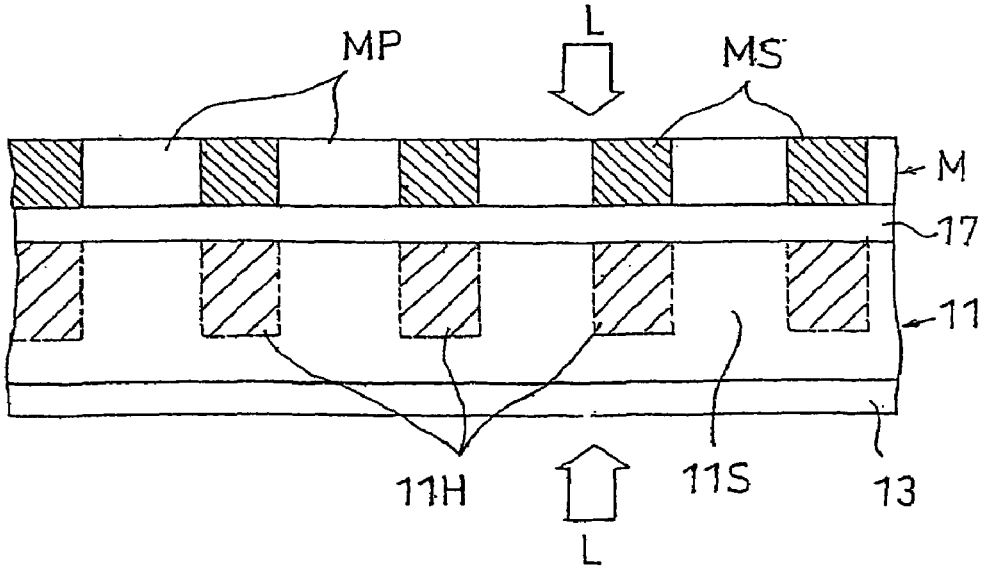
FIG. 3 is a drawing showing that a sheet molding of a curing composition to which a masking material was attached is exposed to light, to form the surface pattern of a polishing layer forming surface pattern thereon.

In the example shown in FIG. 2, the concave region in the embossed pattern penetrates through the polishing layer, and is suitable for example for forming hole. FIG. 3 illustrates a forming surface pattern method suitable for forming groove. The sheet molding 11, similar to that in FIG. 2, is formed between a substrate film 13 and a cover film 17, and the sheet molding, with the masking material M attached to the formed side and with no masking film at the side of the substrate film 13, is exposed to light. At the side of the substrate film 13, a cured layer 15 exposed wholly to light is formed, while at the side of the cover film 17, a non-exposed region 11H and a light-exposed region 11S are formed, to give a polishing layer 11 having concave 11S and convex 11H through a development step. The light with which the substrate film 13 is to be irradiated is regulated so as to form a cured layer 15 of predetermined thickness.

The depth of the formed concave is not limited and can be determined suitably depending on intended use, materials etc., and preferably the depth of the concave is regulated to be 100 μm (0.1 mm) or more within ⅔ of the thickness of the pad. The depth of the concave can also be regulated by development.

Production of the polishing layer was described in the example described above, and the backside layer as a cushion layer can also be provided with a formed pattern in the same manner.

In the production method in FIG. 2, the polishing pad provided with a cushion layer is produced by using a known backing material in place of the substrate film 5. Alternatively, the polishing pad is formed by using a known polishing pad in place of the substrate film 5 and a material as the curing composition suitable for formation of a cushion layer.

The polishing layer 1 and the backside layer may be formed respectively via a middle layer. The middle layer may be formed by curing the curing composition used in this invention or by using another material. The polishing layer is produced by the method shown in FIG. 3, and after the substrate film is released, the polishing layer is used in place of the substrate film in FIG. 2, to form a sheet molding, and then the backside layer can be formed by the method shown in FIG. 2.

Figure 4:
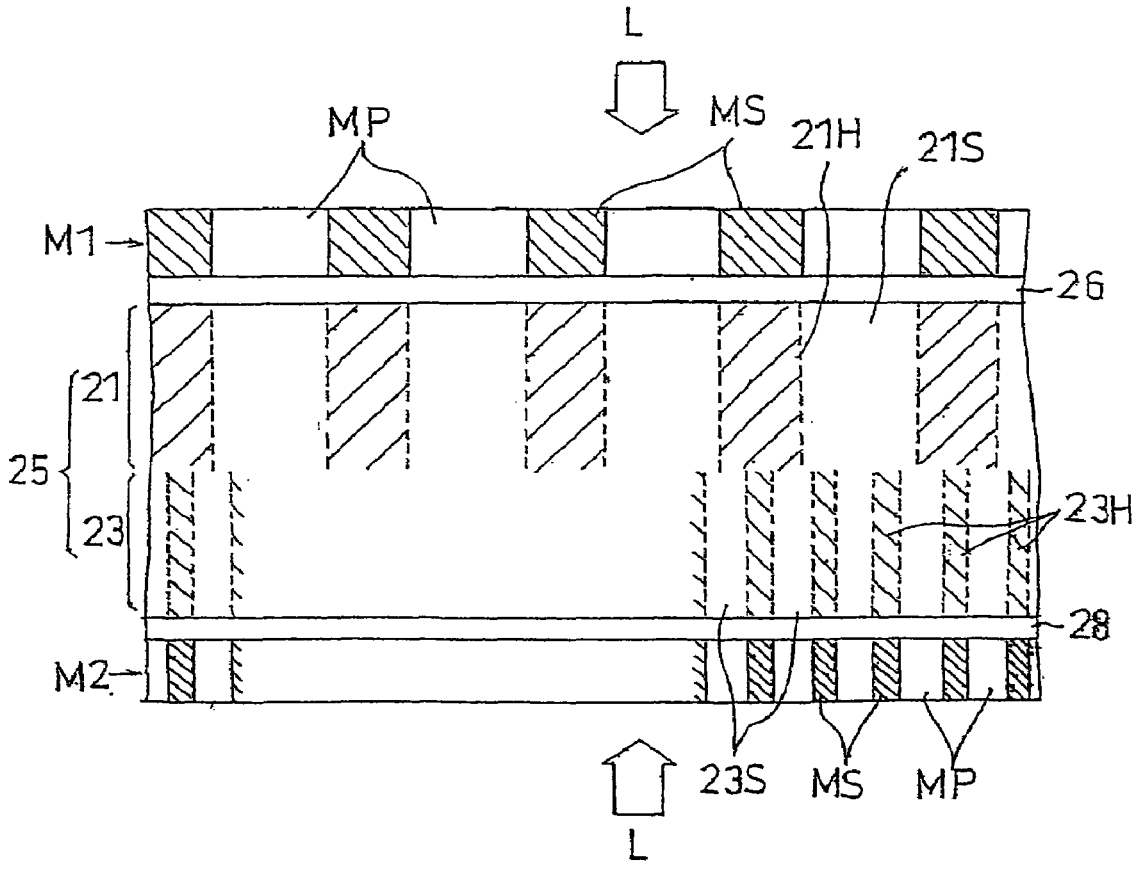
FIG. 4 is a drawing showing the step of forming surface pattern both sides of a single-layer sheet molding of a curing composition to form a polishing pad.
Figure 5:
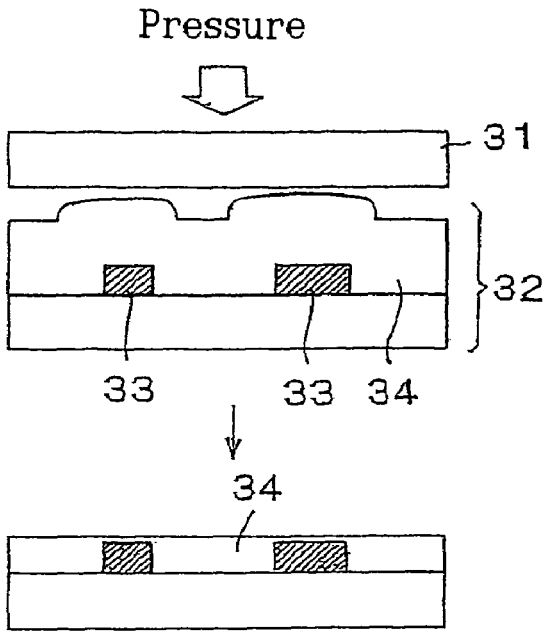
FIG. 5 is a conceptual drawing showing that a material to be polished is polished with the polishing pad of this invention.
Figure 6:
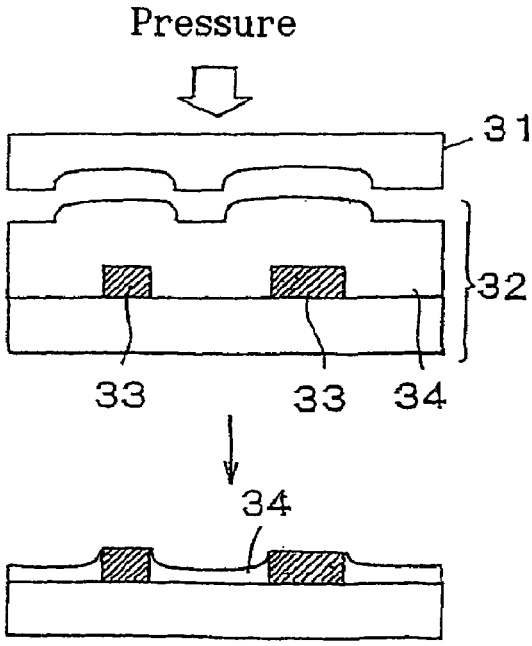
FIG. 6 is a conceptual drawing showing that a material to be polished is polished with a conventional polishing pad.

FIG. 4 shows an example of a polishing layer composed of a polishing surface layer and a backside layer. This example shows production of a polishing pad having a polishing surface layer and a backside layer formed continuously into one body formed surface pattern on both sides. The sheet molding 25 used in preparing the polishing pad is composed of a layer serving as the polishing surface layer 21 and a layer serving as the backside layer 23, and both sides of the sheet molding is covered with cover films 26 and 28. A masking material M1 with a formed surface pattern suitable for the polishing surface is attached to the cover film 26 on the surface forming the polishing surface layer 21, while a masking material M2 with a formed surface pattern suitable for the backside layer is attached to the cover film 28 on the surface forming the backside layer 23, and the sheet molding is exposed via the masking materials M1 and M2 to light L and then developed to form the polishing pad.

In this invention, the solid sheet molding is irradiated with energy rays, and then dissolved in a solvent to form a surface pattern.

For irradiation with energy rays, there is a method of irradiating a desired surface pattern directly with laser rays and intense energy rays or a method of laminating one side with a film having permeable and impermeable regions corresponding to the surface pattern and then irradiating the surface of the film with energy rays. Further, irradiation under vacuum may also be conducted to improve the adhesion between the film and the sheet molding.

In the irradiation with energy rays, the other side than the surface constituting the pattern can be irradiated with energy rays and photoset to thickness not influencing the depth of the pattern.

A polishing pad having suitable hardness balance with a hardness gradient in the thickness direction of the pad can also be formed by regulating irradiation intensity on the front surface and backside surface.

In this invention, the solubility of the permeable region in solvent is made different from that of the impermeable region by chemical reaction with energy rays, to achieve selective removal with a suitable solvent. The solvent is not limited and is suitably selected depending on the material used. Depending on the case, the solvent for removal can be heated to a certain temperature to improve the efficiency of removal.

The surface pattern of the pad includes cylindrical convex, conic convex, linear convex, crossed groove, pyramidal convex, holes and a combination thereof, and the concave and convex shape, width, pitch and depth are not limited, and the optimum surface pattern shape is selected depending on conditions such as the hardness and elastic characteristics of a polished material, the size, shape and hardness of abrasive grains in slurry used, and the hardness and elastic characteristics of a layer other than the polishing layer in the case of a laminate.

When the polishing pad of this invention is a non-foam, there occurs sticking between the polishing pad and a polished material such as a wafer, a glass plate etc., and there may arise a problem such as detachment of the wafer during polishing from its fixing stand. When the polishing pad is a foam, the surface of the polishing layer has a large number of fine pores fluffed at the microscopic level, by which the friction with the material polished is reduced, thus reducing the problem of sticking. Accordingly, the friction coefficient of the polishing pad with a glass under a certain loading was examined in this invention, and as a result, it was found that a surface pattern achieving a static friction coefficient of 1.49 or less is preferable for solving the problem described above.

The above result also applies in the polishing step without a dressing step. The dressing step refers to a step wherein because abrasive grains, abraded dust etc. in slurry are accumulated in pores on the polishing surface during polishing, to reduce the polishing rate, the polishing surface is dressed at certain intervals with a head having abrasive grains of diamond deposited thereon, to renew the polishing surface. Even if the polishing pad is used as a dress-free polishing pad eliminating the dressing step, the effect of the friction coefficient is maintained.

However, the above dressing step does not include dressing conducted at the start of polishing to improve the flatness of the polishing pad.

During polishing, clogging on the surfaced pattern can also be reduced by washing with a brush or washing with high-pressure water without grinding the surface of the pad.

The transmittance of the polishing pad of this invention at the wavelength of energy rays used is preferably 1% or more. When the transmittance is less than 1%, the irradiation energy of light is insufficient, and thus the reaction cannot proceed sufficiently.

In this invention, the method of producing the polishing pad having a difference in hardness between the polishing layer and the surface region constituting the backside layer or a middle region can be carried out by forming the curing composition, for example the composition containing an energy ray-curing compound or a thermosetting compound, into a sheet molding and applying energy rays and/or heat to the sheet molding. Specifically, the pad of this invention can be produced by regulating energy rays and heat inducing the reaction and curing of the curing composition.

The method of making a difference in hardness between the polishing layer and the backside layer using the composition containing the energy ray-curing compound can be carried out for example by regulation of irradiation conditions such as the intensity and irradiation time of energy rays such as irradiation light and/or control of the transmittance of the curing composition. In the method of regulating transmittance, the irradiation intensity is decreased as the irradiation energy rays while penetrating from the energy irradiation region into the inside of the sheet molding are absorbed little by little into the layer, and there occurs a difference in crosslinking reaction between the polishing layer nearer to the energy source and the backside layer surface thereby forming a difference in mechanical physical properties such as hardness etc.

By adding the additives or by regulating the refractive index of each component in the composition, the transmittance of the curing composition can be regulated, while by changing light energy among the respective layers thus making a difference in crosslinking reaction among the layers, mechanical characteristics such as hardness and compression characteristics of the polishing layer can be made different from those of the other layer. Accordingly, the polishing pad comprising a 1-layer sheet provided with both a polishing layer and a cushion layer can satisfy both surface hardness and cushioning characteristics, to improve the planarization and uniformity of a material polished therewith.

The polishing pad, or the molding sheet for producing a polishing layer constituting the polishing pad, can be obtained by mixing the composition, then forming it into a sheet molding by a conventional sheet-forming method, and photosetting it with an energy ray source such as UV rays. Alternatively, it can also be obtained by coating a substrate with the composition.

When the solvent is used as one component in the curing composition, the sheet molding is formed by mixing the respective components and removing the solvent under reduced pressure. The solvent may also be removed by drying after formation of the sheet molding, or before or after curing.

The thickness of the polishing pad is determined suitably depending on its intended use and is not limited, and for example, the thickness is used in the range of 0.1 to 10 mm. The thickness of the polishing pad is more preferably 0.2 to 5 mm, still more preferably 0.3 to 5 mm. When the backside layer is separately arranged, the thickness of the polishing layer is preferably 0.1 to 5 mm, more preferably 0.2 to 3 mm, still more preferably 0.3 to 2 mm.

In a preferable mode, the polishing layer is formed into a sheet molding of the curing composition foamed by mechanical foaming or chemical foaming and then subjected to light irradiation and development to form a foamed layer.

The cover film or the substrate is a film made of an energy ray-permeable material not interfering with light exposure. The cover film and the substrate film may be the same or different. The substrate may be a thin one similar to a film or a thick one like a plastic plate. The usable film or substrate includes a known resin film, for example PET film, polyamide film, polyimide film, aramid resin film, polypropylene film etc. which are subjected if necessary to releasing treatment. Both sides of the sheet molding may be covered with a film.

When the sheet molding is not sticky and is free of problems such as staining or adhesion of a directly attached masking material, the cover film or the substrate film may not be used.

The cover film is preferably coated with an antistatic agent for preventing static electricity from occurring upon releasing the film, thus making contamination with dust difficult. The surface pattern shape, width, pitch and depth are not limited, and the optimum surface pattern shape is selected depending on conditions such as the hardness and elastic characteristics of a material to be polished, the size, shape and hardness of abrasive grains in slurry used, and the hardness and elastic characteristics of a layer other than the polishing layer in the case of a laminate.

By forming the surface pattern of the polishing layer, it is possible to improve the fluidity of slurry, to improve the retention of slurry and to improve the elastic characteristics of the surface of the polishing layer. Forming surface pattern of the backside layer can give suitable cushioning characteristics to the backside layer.

The polishing layer in the polishing pad of this invention can be formed from the curing composition containing a thermosetting compound to be cured by reaction with heat. The method of making the hardness of the polishing layer different from that of the surface of the backside layer or that of a middle region, each using the thermosetting composition, can be carried out by controlling the quantity of heat applied to the composition, and by varying the quantity of applied heat, there occurs in a difference in crosslinking reaction between a high-temperature region (i.e. a region receiving much heat) and a low-temperature region, to make a difference in mechanical physical properties such as hardness therebetween.

The thermosetting compound can be used without any particular limitation insofar as curing reaction occurs by heating. Examples thereof include epoxy resin such as bisphenol A epoxy resin, bisphenol F epoxy resin, phenol novolak epoxy resin, cresol novolak epoxy resin, ester epoxy resin, ether epoxy resin, urethane-modified epoxy resin, alicyclic epoxy resin having a skeleton such as a cyclohexane, dicyclopentadiene or fluorine skeleton, hydantoin epoxy resin and amino epoxy resin, maleimide resin, isocyanate group-containing compound, melamine resin, phenol resin and acryl resin. These are used singly or in combination thereof. In a preferable mode, the thermosetting resin is used as a curing composition to which a curing agent was added.

Examples of the curing agent include, but are not limited to, aromatic amine compounds such as bis(4-aminophenyl) sulfone, bis(4-aminophenone)methane, 1,5-diamine naphthalene, p-phenylene diamine, m-phenylene diamine, o-phenylene diamine, 2,6-dichloro-1,4-benzenediamine, 1,3-di(p-aminophenyl)propane and m-xylylene diamine, aliphatic amine compounds such as ethylene diamine, diethylene triamine, tetraethylene pentamine, diethylaminopropyl amine, hexamethylene diamine, mencene diamine, isophorone diamine, bis(4-amino-3-methyl dicyclohexyl)methane, polymethylene diamine and polyether diamine, polyaminoamide compound, fatty acid anhydrides such as dodecyl succinic anhydride, polyadipic anhydride and polyazelaic anhydride, aliphatic acid anhydrides such as hexahydrophthalic anhydride and methylhexahydrophthalic anhydride, aromatic acid anhydrides such as phthalic anhydride, trimellitic anhydride, benzophenone tetracarboxylic anhydride, ethylene glycol bistrimellitate and glycerol tristrimellitate, phenol resin, amino resin, urea resin, melamine resin, dicyandiamide and hydrazine compounds, imidazole compounds, Lewis acid and Brensted acid, polymercaptan compounds, isocyanate and block isocyanate compounds. These curing agents and their amounts are selected suitably depending on the thermosetting resin used.

For the purpose of improvement of polishing performance, improvement of mechanical characteristics, improvement of processability, etc., the curing composition to be cured by heating or energy rays in this invention can be compounded if necessary with abrasive grains and other various additives. Example of the additives include antioxidants, UV absorbers, antistatic agents, pigments, fillers, polymer resin not be cured by light or heat, thickeners, heat polymerization inhibitors etc. The abrasive grains are varied depending on the polished material and include, but are not limited to, a few μm or less fine particles of silicon oxide (silica), aluminum oxide (alumina) and cerium oxide (ceria).

When it is preferable that the polishing layer does not have pores, beads added to the polishing layer are preferably solid beads etc.

In the invention described above, the sheet molding is produced by using a general coating method and a sheet forming method. As a general coating method, use can be made of coating methods of using a doctor blade or spin coating after melting or dissolution of the composition in a solvent. The sheet forming method includes known sheet molding methods such as extrusion molding thorough a die, calendering etc. by using a pressing machine, press rolls etc. under heating.

In this invention, the sheet molding can be used in various forms. For example, the sheet molding can be used in the form of a sheet, disk, belt, roll or tape. The form is determined preferably depending on the mode of polishing.

When the sheet molding is formed by applying the curing composition to be cured with energy rays particularly light, the process may comprise the steps of dissolving a photoinitiator, a light-reactive compound etc. in a solvent, kneading the components and removing the solvent before or after molding, depending on the unit and mechanical conditions used.

The polishing pad in this invention may be laminated with another sheet. Another layer laminated includes a cushioning layer having higher compressibility than that of the polishing pad and a layer having higher elastic modulus than that of the polishing pad and giving rigidity to the polishing pad.

The cushioning layer having higher compressibility than that of the polishing pad includes resin foams such as foamed polyurethane, foamed polyethylene and foamed rubber, non-foamed polymers such as rubber and gelled material, a nonwoven fabric, a nonwoven fabric impregnated with resin, a fluffed cloth etc. By laminating such a cushioning layer, the uniformity of a partial polishing rate observed at the microscopic level is improved.

The layer having higher elastic modulus than that of the polishing pad and giving rigidity to the polishing pad includes resin films and sheets of polyethylene terephthalate, nylon, polycarbonate, polypropylene, polyvinyl chloride, polyvinylidene chloride and polyacrylate, and metal foils of aluminum, copper and stainless steel. By laminating such a rigid layer, a polished material can be prevented from being over-polishing in the periphery thereof, and the polishing planarization of a polished material having a plurality of exposed materials can be improved.

For improving planarization and for securing the uniformity of polishing rate, a layer giving rigidity is preferably laminated between the cushion layer and the polishing pad of this invention.

As the lamination method, an arbitrary method using an adhesive or a double-tacked tape or by thermal fusion can be used.

Insofar as the polishing layer in the polishing pad of this invention has a storage elastic modulus of 200 MPa or more, the material for forming the polishing layer is not particularly limited. Examples of the forming material include polyester resin, polyurethane resin, polyether resin, acryl resin, ABS resin, polycarbonate resin, or a blend of these resins, and photosensitive resin. Among these, polyester resin, polyurethane resin and photosetting resin are preferable.

(Polyester Resin)

The polyester resin is composed of at least one member selected from polyvalent carboxylic acids including dicarboxylic acids and their ester-forming derivatives and at least one member selected from polyvalent alcohols including glycols or at least one member selected from hydroxycarboxylic acids and their ester-forming derivatives, or of cyclic esters, and the polyester resin is obtained by polycondensation thereof.

The dicarboxylic acids include, for example, saturated fatty dicarboxylic acids such as oxalic acid, malonic acid, succinic acid, glutaric acid, adipic acid, pimelic acid, suberic acid, azelaic acid, sebacic acid, decane dicarboxylic acid, dodecane dicarboxylic acid, tetradecane dicarboxylic acid, hexadecane dicarboxylic acid, 1,3-cyclobutane dicarboxylic acid, 1,3-cyclopentane dicarboxylic acid, 1,2-cyclohexane dicarboxylic acid, 1,3-cyclohexane dicarboxylic acid, 1,4-cyclohexane dicarboxylic acid, 2,5-norbornane dicarboxylic acid and dimer acid, or ester-forming derivatives thereof, unsaturated fatty dicarboxylic acids such as fumaric acid, maleic acid and itaconic acid, or ester-forming derivatives thereof, and aromatic dicarboxylic acids such as orthophthalic acid, isophthalic acid, terephthalic acid, (alkali metal) 5-sulfoisophthalate, diphenine acid, 1,3-naphthalene dicarboxylic acid, 1,4-naphthalene dicarboxylic acid, 1,5-naphthalene dicarboxylic acid, 2,6-naphthalene dicarboxylic acid, 2,7-naphthalene dicarboxylic acid, 4,4'-biphenyl dicarboxylic acid, 4,4'-biphenyl sulfone dicarboxylic acid, 4,4'-biphenyl ether dicarboxylic acid, 1,2-bis(phenoxy)ethane-p,p'-dicarboxylic acid, pamoic acid and anthracene dicarboxylic acid, or ester-forming derivatives thereof. Particularly preferable among these dicarboxylic acids are terephthalic acid and naphthalene dicarboxylic acid, particularly 2,6-naphthalene dicarboxylic acid.

Polyvalent carboxylic acids other than these dicarboxylic acids include ethane tricarboxylic acid, propane tricarboxylic acid, butane tetracarboxylic acid, pyromellitic acid, trimellitic acid, trimesic acid, 3,4,3',4'-biphenyl tetracarboxylic acid, and ester-forming derivatives thereof.

The glycols include aliphatic glycols such as ethylene glycol, 1,2-propylene glycol, 1,3-propylene glycol, diethylene glycol, triethylene glycol, 1,2-butylene glycol, 1,3-butylene glycol, 2,3-butylene glycol, 1,4-butylene glycol, 1,5-pentane diol, neopentyl glycol, 1,6-hexane diol, 1,2-cyclohexane diol, 1,3-cyclohexane diol, 1,4-cyclohexane diol, 1,2-cyclohexane dimethanol, 1,3-cyclohexane dimethanol, 1,4-cyclohexane dimethanol, 1,4-cyclohexane diethanol, 1,10-decamethylene glycol, 1,12-dodecane diol, polyethylene glycol, polytrimethylene glycol and polytetramethylene glycol, and aromatic glycols such as hydroquinone, 4,4'-dihydroxybisphenol, 1,4-bis(β-hydroxyethoxy)benzene, 1,4-bis(β-hydroxyethoxyphenyl)sulfone, bis(p-hydroxyphenyl)ether, bis(p-hydroxyphenyl)sulfone, bis(p-hydroxyphenyl)methane, 1,2-bis(p-hydroxyphenyl) ethane, bisphenol A, bisphenol C, 2,5-naphthalene diol, and glycols having ethylene oxide added to the above glycols. Preferable among these glycols are ethylene glycol and 1,4-butylene glycol.

Polyvalent alcohols other than these glycols include trimethylol methane, trimethylol ethane, trimethylol propane, pentaerythritol, glycerol, hexane triol etc.

The hydroxycarboxylic acids include lactic acid, citric acid, malic acid, tartaric acid, hydroxyacetic acid, 3-hydroxybutyric acid, p-hydoroxybenzoic acid, p-(2-hydroxyethoxy)benzoic acid, 4-hydroxycylohexane carboxylic acid, or ester-forming derivatives thereof.

The cyclic esters include ε-caprolactone, β-propiolactone, β-methyl-β-propiolactone, δ-valerolactone, glycolide, lactide etc.

(Polyurethane Resin)

The polyurethane resin is obtained by reacting polyisocyanate with polyol and if necessary with a chain extender. The polyurethane resin may be obtained by reacting all the components simultaneously or by preparing an isocyanate-terminated urethane prepolymer from polyisocyanate and polyol, and then reacting a chain extender with the prepolymer. The polyurethane resin is preferably the one obtained by reacting a chain extender with the isocyanate-terminated urethane prepolymer.

The polyisocyanate includes, for example, 2,4- and/or 2,6-diisocyanatotoluene, 2,2'-, 2,4'- and/or 4,4'-diisocyanatodiphenyl methane, 1,5-naphthalene diisocyanate, p- and m-phenylene diisocyanate, dimellyl diisocyanate, xylylene diisocyanate, diphenyl-4,4'-diisocyanate, 1,3- and 1,4-tetramethylxylidine diisocyanate, tetramethylene diisocyanate, 1,6-hexamethylene diisocyanate, dodecamethylene diisocyanate, cyclohexane-1,3- and 1,4-diisocyanate, 1-isocyanato-3-isocyanatomethyl-3,5,5-trimethyl cyclohexane (=isophorone diisocyanate), bis-(4-isocyanatocyclohexyl)methane (=hydrogenated MDI), 2- and 4-isocyanatocyclohexyl-2'-isocyanatocyclohexyl methane, 1,3- and 1,4-bis-(isocyanatomethyl)-cyclohexane, bis-(4-isocyanato-3-methylcyclohexyl)methane etc. The polyisocyanate is selected depending on the pot life required in injection molding, and the viscosity of the isocyanate-terminated urethane prepolymer should be low, and thus these polyisocyanates are used singly or as a mixture of two or more thereof.

The polyols include high- and low-molecular polyols. As the polyol, a high-molecular polyol is generally used. The high-molecular polyol includes, for example, hydroxy-terminated polyester, polyether, polycarbonate, polyester carbonate, polyether carbonate, polyester amide etc.

The hydroxy-terminated polyester includes reaction products of divalent alcohol with dibasic carboxylic acid, and for improving hydrolysis resistance, the length of the ester linkage is preferably longer, and thus a combination of long-chain components is desired. The divalent alcohol is not particularly limited, and examples thereof include ethylene glycol, 1,3- and 1,2-propylene glycol, 1,4-, 1,3- and 2,3-butylene glycol, 1,6-hexane glycol, 1,8-octane diol, neopentyl glycol, cyclohexane dimethanol, 1,4-bis-(hydroxymethyl)-cyclohexane, 2-methyl-1,3-propane diol, 3-methyl-1,5-pentane diol, 2,2,4-trimethyl-1,3-pentane diol, diethylene glycol, dipropylene glycol, triethylene glycol, tripropylene glycol, dibutylene glycol etc.

The dibasic carboxylic acid includes aliphatic, alicyclic, aromatic and/or heterocyclic carboxylic acids, and the aliphatic and alicyclic ones are preferable for making a solution of the isocyanate-terminated urethane prepolymer or for reducing its melt viscosity, and when the aromatic ones are used, they are used preferably in combination with aliphatic or alicyclic ones. These carboxylic acids include, but are not limited to, dimer aliphatic acids such as succinic acid, adipic acid, suberic acid, azelaic acid, sebacic acid, phthalic acid, isophthalic acid, terephthalic acid, naphthalene dicarboxylic acid, cyclohexane dicarboxylic acid (o-, m-, p-), and oleic acid.

The hydroxy-terminated polyester can have a part of a carboxyl terminal group. For example, polyesters of lactone such as ε-caprolactone or hydroxycarboxylic acid such as ε-hydroxycaproic acid can also be used.

The hydroxy-terminated polyether includes reaction products of a starting compound having a reactive hydrogen atom with, for example, an alkylene oxide such as ethylene oxide, propylene oxide, butylene oxide, styrene oxide, tetrahydrofuran or epichlorohydrin or a mixture of these alkylene oxides. The starting compound having a reactive hydrogen atom includes water, bisphenol A, and the divalent alcohols used in production of the hydroxy-terminated polyester.

The hydroxy-terminated polycarbonate includes, for example, reaction products of diol such as 1,3-propane diol, 1,4-butane diol, 1,6-hexanediol diethylene glycol, polyethylene glycol, propylene glycol and/or polytetramethylene glycol, with phosgene, diallyl carbonate (for example diphenyl carbonate) or cyclic carbonate (for example propylene carbonate).

The low-molecular polyol includes the divalent alcohols used in production of the hydroxy-terminated polyester.

The chain extender is a compound having at least 2 active hydrogen atoms at the terminal thereof. The compound includes organic diamine compounds and the above-enumerated low-molecular polyols. Among these compounds, the organic diamine compounds are preferable. The organic diamine compounds include, but are not limited to, 3,3'-dichloro-4,4'-diaminodiphenyl methane, chloroaniline-modified dichlorodiaminodiphenyl methane, 1,2-bis(2-aminophenylthio)ethane, trimethylene glycol-di-p-aminobenzoate and 3,5-bis(methylthio)-2,6-toluene diamine.

The polishing pad of this invention has a cushion layer in addition to the polishing layer. The cushion layer is laminated at the opposite side of the polishing surface of the polishing layer. The storage elastic modulus of this cushion layer is lower than that of the polishing layer. The cushion layer is not particularly limited insofar as it has a lower storage elastic modulus than that of the polishing layer. Examples thereof include a nonwoven fabric or a nonwoven fabric impregnated with resin, such as a polyester nonwoven fabric impregnated with polyurethane, polymer resin foams such as polyurethane foam and polyethylene foam, rubber-like resin such as butadiene rubber and isoprene rubber, and photosensitive resin. As the cushion layer, the one achieving its characteristics satisfactorily is suitably selected depending on the type of an intended material to be polished and polishing conditions.

Formation of the polishing layer and cushion layer is not particularly limited and various means can be used. For example, the layer is formed by applying the starting materials onto a substrate and drying them. The substrate includes, but is not limited to, polymer substrates made of resins based on polyester, polyamide, polyimide, polyamide imide, acryl, cellulose, polyethylene, polypropylene, polyolefin, polyvinyl chloride, polycarbonate, phenol or urethane. Among these materials, a polyester film made of polyester resin is preferable from the viewpoint of adhesion, strength, and environmental stress. The thickness of the substrate is usually about 50 to 250 μm. The coating method is not particularly limited, and dip coating, brush coating, roll coating, spraying and other various printing methods can be used. Each layer can be formed by molding with a predetermined casting mold or by making a sheet with a calender, an extruder or a pressing machine.

In the above case, the thickness of the polishing layer or the cushion layer is varied depending on rigidity necessary for the polishing pad, its intended use etc. and is thus not limited, but generally the thickness of the polishing layer is usually about 0.5 to 2 mm, and the thickness of the cushion layer is about 0.5 to 2 mm.

The polishing layer is stuck on the cushion layer usually via a double-tacked tape. In sticking the polishing layer on the cushion layer, the substrate used in forming each layer can be removed or used as it is. When the polishing layer is stuck on the cushion layer, another layer such as a middle layer can also be laminated. An adhesive tape for sticking on a platen may be stuck on the cushion layer.

Further, the polishing layer in the polishing pad of this invention is preferably free of voids, and it is more important for this polishing pad than for a polishing pad having a foamed polishing layer to retain the retention of slurry between the polishing layer and a material to be polished. For retaining the slurry between the polishing layer and a material to be polished and for efficiently eliminating or accumulating dust generated during polishing, the polishing surface of the polishing layer is provided preferably with slurry-flowing grooves or slurry reservoirs. These can be combined. For example, latticed grooves, perforations, concentric circle-shaped grooves, cylindrical convex, conic convex, linear grooves, crossed grooves, pyramidal convex and combinations thereof. Their pattern shape, width, pitch and depth are not limited, and the optimum pattern shape is selected depending on conditions such as the hardness and elastic characteristics of a polished material, and the size, shape and hardness of abrasive grains in slurry used. For forming of the surface shape, photolithography can be used in the case of the polishing pad using a photosensitive resin in the polishing layer, or a method of using mechanical cutting or a laser or a method of using a mold having grooves or an embossed pattern is used in the case of the polishing pad using other resin than the photosensitive resin.

The compressibility of the polishing layer in the polishing pad in this invention is preferably 0.5 to 10%. When the compressibility is less than 0.5%, the polishing pad hardly adjusts itself to a warped material to be polished and may reduce uniformity in the surface. On the other hand, when the compressibility is higher than 10%, the planarization in a local difference in level of a patterned wafer may be deteriorated.

In this invention, the compressibility and compression recovery of the polishing layer, the cushion layer etc. were determined from the following equations using T1 to T3 measured at 25° C. with a cylindrical indenter of 5 mm in diameter by TMA manufactured by Mac Science.

$$\text{Compressibility (\%)}=100(T1-T2)/T1$$

$$\text{Compression recovery (\%)}=100(T3-T2)/(T1-T2)$$

T1: the thickness of a sheet after application of 30 kPa (300 g/cm$^2$) stress for 60 seconds to the sheet.

T2: the thickness of the sheet after application of 180 kPa stress for 60 seconds to the sheet in the state T1.

T3: the thickness of the sheet after leaving the sheet in the state T2 for 60 seconds without loading and subsequent application of 30 kPa stress for 60 seconds to the sheet.

<[I] Cushion Layer for the Polishing Pad>

The cushion layer for the polishing pad of this invention may be made of an energy ray-setting resin, thermosetting resin or thermoplastic resin, but in consideration of formation of grooves etc., the cushion layer is made preferably of an energy ray-setting resin, particularly a photosetting resin. The energy ray-setting resin used can be identical with the material constituting the polishing layer.

A compound exhibiting rubber elasticity in the composition constituting the cushion layer for the polishing pad of this invention is not limited insofar as it is a rubber-like resin having high compressibility with less hysteresis, and examples thereof include a butadiene polymer, isoprene polymer, styrene-butadiene copolymer, styrene-isoprene-styrene block copolymer, styrene-butadiene-styrene block copolymer, styrene-ethylene-butadiene-styrene block copolymer, acrylonitrile-butadiene copolymer, urethane rubber, epichlorohydrin rubber, chlorinated polyethylene, silicone rubber, polyester-based thermoplastic elastomer, polyamide-based thermoplastic elastomer, urethane-based thermoplastic elastomer, and fluorine-type thermoplastic elastomer.

By mixing a plasticizer with the material constituting the cushion layer, the compressibility can further be increased. The plasticizer used includes, but is not limited to, phthalates such as dimethyl phthalate, diethyl phthalate, dibutyl phthalate, diheptyl phthalate, dioctyl phthalate, di-2-ethylhexyl phthalate, diisononyl phthalate, diisodecyl phthalate, ditridecyl phthalate, butylbenzyl phthalate, dicyclohexyl phthalate and tetrahydrophthalate, fatty dibasic esters such as di-2-ethylhexyl adipate, dioctyl adipate, diisononyl adipate, diisodecyl adipate, bis-(butyl diglycol)adipate, di-n-alkyl adipate, di-2-ethylhexyl azelate, dibutyl sebacate, dioctyl sebacate, di-2-ethylhexyl sebacate, dibutyl maleate, di-2-ethylhexyl maleate, and dibutyl fumarate, phosphates such as triethyl phosphate, tributyl phosphate, tri-2-ethylhexyl phosphate, triphenyl phosphate, and tricresyl phosphate, as well as chlorinated paraffin, tributyl acetylcitrate, epoxy plasticizers and polyester plasticizers.

Hereinafter, the method of producing the cushion layer for the polishing pad in this invention is described by reference to an example using a photosetting resin. When other resins are used, the cushion layer can be produced in an analogous manner.

In this invention, a polymer, a monomer and a plasticizer, to which the above photo-initiator etc. were added, are melted and mixed to form a mixture and then molded into a sheet. The method of mixing the starting materials includes, but is not limited to, techniques of melting and mixing them in a twin-screw extruder heated at a temperature higher than the Tg (glass transition temperature) of the polymer. The method of manufacturing a sheet is not limited, and known methods can be used. For example, there are techniques such as roll coating, knife coating, doctor coating, blade coating, gravure coating, die coating, reverse coating, spin coating, curtain coating, spray coating etc. Molding with a specified casting mold etc. can also be conducted.

For further increasing the compressibility of the sheet produced by the method described above, the sheet is subjected to patterning at a light wavelength suitable for the composition by photolithography known in the art, and one side of the sheet is irradiated to photoset a desired pattern. The uncured region is washed away with a solvent to form a surface pattern.

Upon application of a loading to the cushion layer thus obtained, the loading is concentrated at convex regions in the surface pattern formed by patterning. When these convex regions are dispersed uniformly on the surface of the pad, the convex regions are uniformly pushed to demonstrate their cushioning effect.

EXAMPLES

Hereinafter, this invention is described in more detail by reference to the Examples, but this invention is not particularly limited to the Examples.

<Evaluation Methods>

(Evaluation of Fluidity)

A sample with a predetermined size, shape and thickness (disk having a radius of 5 cm and a thickness of 2 mm) was placed on a horizontal stand and left under the environment of a temperature of 20° C. and 65% humidity. The movement of the sample was evaluated at predetermined intervals by measuring the diameter of the disk.

(Measurement of Static Friction Coefficient, Dynamic Friction Coefficient)

These coefficients were measured according to ASTM-D-1894. Specifically, the coefficient of a 50 mm×80 mm sample on a commercial soda glass (transparent plate glass) was measured under a loading of 4.4 kgf at a motion rate of 20 cm/min.

(Hardness)

(a) When the Polishing Layer is a Single Layer

Shore D hardness was measured according to JIS K 6253.

(b) When the Polishing Layer is Composed of a Polishing Surface Layer and a Backside Layer The polishing layer after processing was divided in half with a slice cutter in the direction of thickness, and the two sides opposite to the cut face, that is, the polishing layer (surface) and the attachment side (back side) were measured respectively for Shore D hardness according to JIS K 6253. When the hardness of the surface and the hardness of the back side were almost the same and the hardness of the middle layer (cut region) was lower than that of the two, the hardness of the cut region was measured to determine the difference in hardness from the surface layer.

In measurement of the difference in hardness, hardness was measured at 5 different sites to determine the average hardness. A plurality of identical layered samples were measured to confirm that there was no difference among measurements. If there was a difference among the measurements, additional several identical layered samples were measured until there was no difference in hardness.

(Storage Elastic Modulus)

A 3 mm×40 mm rectangular sample (with arbitrary thickness) was cut out and used as a sample for measurement of dynamic viscoelasticity. The accurate width and thickness of each sheet after cutting were measured using a micro-meter. For measurement, a dynamic viscoelasticity spectrometer (manufactured by Iwamoto Seisakusho, now IS Giken) was used to determine storage elastic modulus E'. Measurement conditions are as follows: measurement temperature, 40° C.; applied strain, 0.03%; initial loading, 20 g; and frequency, 1 Hz. The storage elastic modulus is shown in Table 1.

(Compressibility, Compression Recovery)

The compressibility and compression recovery of the polishing layer after processing were determined from the following equations using T1 to T3 measured at 25° C. with a cylindrical indenter of 5 mm in diameter by TMA manufactured by Mac Science.

$$\text{Compressibility (\%)}=100(T1-T2)/T1$$

$$\text{Compression recovery (\%)}=100(T3-T2)/(T1-T2)$$

T1: the thickness of a sheet after application of 30 kpa (300 g/cm$^2$) stress for 60 seconds to the sheet.

T2: the thickness of the sheet after application of 180 kPa stress for 60 seconds to the sheet in the state T1.

T3: the thickness of the sheet after leaving the sheet in the state T2 for 60 seconds without loading and subsequent application of 30 kPa stress for 60 seconds to the sheet.

(Polishing Evaluation A)

[Polishing Rate]

A wafer having an $SiO_2$ layer of 500 nm (5000 Å) formed on single crystal silicon was used as a material polished for evaluation, and its polishing was evaluated under the following conditions.

The polishing machine used was a general test polishing machine Lap Master/LM15 (ϕ4 inch). The polishing slurry used was ceria ($CeO_2$) sol (Nissan Chemical Industries, Ltd.). The wafer to be polished was held on a polishing head under the condition of water absorption/standard backing material (NF200), while the polishing pad sample was supported by sticking it on a platen (polishing pad support), and the procedure of polishing was carried out using the polishing slurry at a feed rate of 110 cm$^3$/min. for 2 minutes under application of 20 kPa (200 g/cm$^2$) polishing pressure and at a relative speed of 30 m/min. between the polishing head and the platen, to determine the polishing rate.

For evaluating the relationship between the polishing time and the polishing rate, polishing was carried out for a predetermined time without a dressing step with a dresser having abrasive grains of diamond deposited thereon and with in situ washing with a brush when dust remained on the uneven surface of the polishing layer, to determine the polishing rate.

[Evaluation of Uniformity]

After polishing, 25 points on the polished surface of the wafer of 101.6 mm (ϕ4 inch) were measured for Rmax and Rmin by a contact needle meter, and a numerical value (%) according to the formula 100×(Rmax−Rmin)/(Rmax+Rmin) was used as an indicator in evaluation of the uniformity of the whole surface of the wafer.

[Evaluation of Reproducibility]

A patterned region after processing was observed under an optical microscope.

(Polishing Evaluation B)

As the polishing machine, SPP600S (Okamoto Kosaku Kikai) was used in the following evaluation of polishing characteristics. The polishing conditions were that silica slurry (SS12, manufactured by Cabot) was added at a flow rate of 150 ml/min. during polishing. The polishing loading was 350 g/cm$^2$, the number of revolutions of the polishing platen was 35 rpm, and the number of revolutions of the wafer was 30 rpm.

[Polishing Rate]

The polishing rate (Å/min) of a thermally oxidized silicon coating was calculated from the time in which the thermally oxidized 1 μm coating on an 8 inch silicon wafer was polished by about 0.5 μm under the above conditions. The thickness of the oxidized coating was measured by an interference film thickness measuring machine (manufactured by Otsuka Denshisha).

[Planarization Characteristics]

0.5 μm thermally oxidized coating was deposited on an 8-inch silicon wafer and subjected to predetermined patterning, and 1 μm oxidized coating of p-TEOS was deposited thereon, to prepare a wafer having a pattern with an initial difference in step height of 0.5 μm, and this wafer was polished under the above-described conditions, and after polishing, each difference in step height was measured to evaluate planarization characteristics. For planarization characteristics, two differences in step height were measured. One difference is a local difference in step height, which is a difference in step height in a pattern having lines of 270 μm in width and spaces of 30 μm arranged alternately and is measured after 1 minute polishing. The other difference is an abrasion loss in the concaves of 270 μm spaces when the difference in step height of an upper part of lines in two patterns (that is, a pattern having lines of 270 μm in width and spaces of 30 μm arranged alternately and a pattern having lines of 30 μm in width and spaces of 270 μm arranged alternately) became 2000 Å or less. A lower numerical value of the local difference in step height indicates, in a certain time, a higher rate of planarizing the oxidized coating unevenness generated depending on a pattern on the wafer. Further, a lower abrasion loss of the spaces indicates higher planarization with less abrasion of regions not intended to be polished.

(Polishing Evaluation C)

A wafer having an $SiO_2$ layer of 500 nm (5000 Å) formed on single crystal silicon was used as a material polished for evaluation, and its polishing was evaluated under the following conditions.

The polishing machine used was a general Nanofactor/NF-30 (ϕ3 inch). The polishing slurry used was silica ($SiO_2$) slurry (Fujimi). The wafer to be polished was held on a polishing head under the condition of water absorption/standard backing material (S=R301), while the polishing pad sample was supported by sticking it on a platen (polishing pad support), and the procedure of polishing was carried out using the polishing slurry at a feed rate of 25 cc/min. for 2 minutes under application of 20 kPa (200 g/cm$^2$) polishing pressure and at a relative speed of 50 m/min. between the polishing head and the platen, to determine the polishing rate.

[Evaluation of Uniformity]

After polishing, 14 points on the polished surface of the wafer of 7.62 cm (+3 inch) were measured for Rmax and Rmin by a contact needle meter, and a numerical value (%) according to the formula 100×(Rmax−Rmin)/(Rmax+Rmin) was used as an indicator in evaluation of the uniformity of the whole surface of the wafer.

Example 1

Example 1-1

125 g epoxy acrylate (EX5000, methyl ethyl ketone solvent, solids content 80%, manufactured by Kyoeisha Chemical Co., Ltd.), 1 g benzyl dimethyl ketal and 0.1 g hydroquinone methyl ether were mixed under stirring by a kneader, and the solvent was removed under reduced pressure, whereby a solid photosetting composition was obtained. This composition was sandwiched between films and pressed at 10 atmospheric pressure with a pressing machine at 100° C., to give a sheet molding of 2 mm in thickness. This sheet molding was irradiated with UV rays, and the other side with a mask film having a desired pattern drawn thereon was irradiated with UV rays, and after the films were removed, the sheet was developed by rubbing with a brush in a toluene solvent. The sheet was dried at 60° C. for 30 minutes to give a polishing pad.

This polishing pad was evaluated for polishing by the polishing evaluation method A.

Example 1-2

200 g polyurethane resin (Vylon UR-1400, toluene/methyl ethyl ketone (1/1 by weight) solvent, solids content 30%, manufactured by Toyo Boseki Co., Ltd.), 40 g trimethylol propane trimethacrylate, 1 g benzyl dimethyl ketal and 0.1 g hydroquinone methyl ether were mixed under stirring by a kneader, and the solvent was removed, whereby a solid photosetting composition was obtained. This composition was sandwiched between films and pressed at 10 atmospheric pressure with a pressing machine at 100° C., to give a sheet molding of 2 mm in thickness. This sheet molding was irradiated with UV rays for a predetermined time, and the other side with a mask film having a desired pattern drawn thereon was irradiated with UV rays, and after the films were removed, the sheet was developed. The sheet was dried at 60° C. for 30 minutes to give a polishing pad. Its subsequent evaluation was carried out in the same manner as in Example 1-1.

Example 1-3

145 g urethane acrylate (UF503LN, methyl ethyl ketone solvent, solids content 70%, manufactured by Kyoeisha chemical Co., Ltd.), 1 g benzyl dimethyl ketal and 0.1 g hydroquinone methyl ether were mixed under stirring by a kneader, and the solvent was removed, whereby a solid photosetting composition was obtained. This composition was sandwiched between films and pressed at 10 atmospheric pressure with a pressing machine at 100° C., to give a sheet molding of 2 mm in thickness. This sheet molding was irradiated with UV rays for a predetermined time, and the other side with a mask film having a desired pattern drawn thereon was irradiated with UV rays, and after the films were removed, the sheet was developed. The sheet was dried at 60° C. for 30 minutes to give a polishing pad. Its subsequent evaluation was carried out in the same manner as in Example 1-1.

Example 1-4

258 g polyurethane resin (Vylon UR-8400, toluene/methyl ethyl ketone (1/1 by weight) solvent, solids content 30%, manufactured by Toyo Boseki Co., Ltd.), 22.5 g of 1,6-hexanediol dimethacrylate, 1 g benzyl dimethyl ketal and 0.1 g hydroquinone methyl ether were mixed under stirring by a kneader, and the solvent was removed, whereby a solid photosetting composition was obtained. This composition was sandwiched between films and pressed at 10 atmospheric pressure with a pressing machine at 100° C., to give a sheet molding of 2 mm in thickness. This sheet molding was irradiated with UV rays for a predetermined time, and the other side with a mask film having a desired pattern drawn thereon was irradiated with UV rays, and after the films were removed, the sheet was developed. The sheet was dried at 60° C. for 30 minutes to give a polishing pad. Its subsequent evaluation was carried out in the same manner as in Example 1-1.

Comparative Example 1-1

100 g liquid urethane acrylate and 1 g benzyl dimethyl ketal were mixed under stirring to give a liquid photosetting composition. This composition was poured into a mold having a predetermined size and shape to give a sheet molding having predetermined thickness. This sheet molding was irradiated with UV rays for a predetermined time, and the other side with a film having a desired pattern drawn thereon was irradiated with UV rays, and after the films were removed, the sheet was developed. The sheet was dried at 60° C. for 30 minutes to give a polishing pad.

Comparative Example 1-2

A foamed polyurethane pad, IC1000 A21 (manufactured by Rodel), was used as a polishing pad. The polishing rate was evaluated using the same machine and conditions as in Example 1-1. Further, the polishing rate was measured. The relationship between the polishing time and polishing rate was evaluated by conducting polishing with the polishing pad for a predetermined time with or without a dressing step using a diamond abrasive grain-deposited dresser, to measure the polishing rate.

The results of examination of the fluidity of each sample before irradiation with light are shown in Table 1-1. As can be seen from these results, the solid sheet moldings are not fluidic. Accordingly, it can be seen that a change in thickness with time can be reduced.

TABLE 1

| | After left for 1 hour | After left for 3 hours |
|---|---|---|
| Example 1-1 | no change | no change |
| Example 1-2 | no change | no change |
| Example 1-3 | no change | no change |
| Comparative Example 1-1 | 10.5 cm | 11.9 cm |

The relationship between surface patterns formed on the basis of Example 1-1 and friction coefficient is shown.

TABLE 1-2

| Surface pattern | Removal of wafer | Static friction coefficient | Dynamic friction coefficient |
|---|---|---|---|
| No pattern | Yes | 1.49 | 1.27 |
| Penetrated hole | No | 1.37 | 1.23 |
| XY lattice | No | 1.14 | 1.01 |
| Concentric circle | No | 1.10 | 0.98 |
| Cylinder | No | 0.88 | 0.72 |
| Combination of cylinder and penetrated hole | No | 0.51 | 0.34 |

penetrated hole: hole diameter 1.6 mm, 4 holes/$cm^2$
XY lattice: groove width 2.0 mm, groove depth 0.6 mm, groove pitch 15.0 mm
Concentric circle: groove width 0.3 mm, groove depth 0.4 mm, groove pitch 1.5 mm
Cylinder: diameter 0.5 mm, height 0.5 mm The results of the polishing rate of each sample are shown. The measurement was conducted according to the polishing evaluation method A.

TABLE 1-3

| | Polishing rate (Å/min) |
|---|---|
| Example 1-1 | 1160 |
| Example 1-2 | 1210 |

TABLE 1-3-continued

| | Polishing rate (Å/min) |
|---|---|
| Example 1-3 | 1290 |
| Comparative Example 1-1 | 1000 |

A combination of cylinder and concentric circle was used in the surface patterns in Examples 1-1 to 1-3.

With respect to Example 1-1 (whose surface pattern is a combination of cylinder and concentric circle), the relationship between the polishing rate and polishing time in the case of polishing without a dressing step is shown in Table 1-4.

TABLE 1-4

| | Polishing rate (Å/min) | | |
|---|---|---|---|
| | Example 1-1 | Comparative Example 1-2 without a dressing step | Comparative Example 1-2 with a dressing step |
| 2 minutes after polishing | 1160 | 1000 | 1000 |
| 20 minutes after polishing | 1180 | 800 | 1120 |
| 40 minutes after polishing | 1150 | 420 | 1180 |

It can be seen from these results that in the present invention, the polishing rate is stable without a dressing step, and can be maintained stably as compared with that of Comparative Example 1-2 using a dressing step.

Example 1-4

The even surface of the polishing pad (with a concentric circle-shaped surface pattern) used in Example 1-1 was laminated with an urethane-impregnated nonwoven fabric (SUBA400, Rodel Nitta Co., Ltd.) via a double-tacked tape using polyethylene terephthalate of 50 μm in thickness as a core material. By observing interference light on the surface with naked eyes, the partial polishing unevenness on the wafer was hardly observed and lower than in Example 1-1. When the surface unevenness was measured by a contact needle surface roughness measuring machine, the planarization was further improved as compared with that in Example 1-1.

Example 2

(Preparation of a Polishing Pad Sample 2-1)

A mixture of 30 parts by weight of 1,9-nonanediol dimethacrylate (1,9-NDH, Kyoeisha Chemical Co., Ltd.), 70 parts by weight of a pentaerythritol triacrylate hexamethylene diisocyanate urethane prepolymer (UA-306H, Kyoeisha Chemical Co., Ltd.) and 1 part by weight of benzyl dimethyl ketal (Irgacure 651, Ciba-Geigy) was stirred with a homogenizer for 10 minutes and then applied by a coater onto PET films coated with a releasing agent, such that the mixture was sandwiched between the PET films to prepare a sheet molding. The other side than the polishing surface was irradiated with a predetermined amount of UV rays, and this sheet with a making material having a latticed pattern with a groove width of 2 mm and a pitch width of 1.5 cm arranged on the polishing surface was cured by irradiation with UV rays, and after the PET films were removed, the sheet was subjected to development to remove the non-exposed regions and then dried to give a polishing pad sample 1-1. A surface pattern corresponding accurately to the original pattern was reproduced on the resulting pad, and the operation time could be significantly reduced.

(Preparation of Polishing Pad Samples 2-2 to 2-12)

The polishing pads 2-2 to 2-12 were prepared in the same manner as for the polishing pad sample 2-1. The curing compositions and surface patterns used are shown in Table 2-1. The compounding ratio is expressed in terms of parts by weight. The starting materials used are as follows.

1,6-Hexanediol dimethacrylate: 1,6-HX (Kyoeisha Chemical Co., Ltd.)

Glycerin dimethacrylate hexamethylene diisocyanate prepolymer: UA-101H (Kyoeisha Chemical Co., Ltd.)

Aliphatic urethane acrylate: Actilane 270 (ACROS CHEMICALS LTD.)

Aromatic urethane acrylate: Actilane 167 (ACROS CHEMICALS LTD.)

Oligobutadiene acrylate: BAC-45 (Osaka Organic Chemical Industry).

(Preparation of Polishing Pad Samples 2-13 to 2-15)

125 g epoxy acrylate EX5000 (methyl ethyl ketone solvent, solids content 80%, manufactured by Kyoeisha Chemical Co., Ltd.), 1 g benzyl methyl ketal and 0.1 g hydroquinone methyl ether were mixed under stirring by a kneader, and the solvent was removed, whereby a solid photosetting composition was obtained. This composition was sandwiched between films and pressed at 10 atmospheric pressure with a pressing machine at 100° C., to give a sheet molding of 2 mm in thickness. This sheet molding was irradiated with UV rays, and the other side with a mask film having an XY latticed pattern drawn thereon was irradiated with UV rays, and after the films were removed, the molding was developed by bushing it in toluene. The sheet was dried at 60° C. for 30 minutes to give a polishing pad sample 2-13 having an XY latticed embossed pattern on the surface.

The pattern of the mask film was changed to give a polishing pad sample 2-14 (concentric circle pattern) and a polishing pad sample 2-15 (halftone dot pattern). The groove width, pitch width, diameter and depth of each pattern were identical with those of the sample pads 2-1 to 2-3.

(Preparation of Polishing Pad Samples 2-16 to 2-18)

200 g polyurethane resin Vylon UR-1400 (toluene/methyl ethyl ketone (1/1 by weight) solvent, solids content 30%, manufactured by Toyo Boseki Co., Ltd.), 40 g trimethylol propane trimethacrylate, 1 g benzyl methyl ketal and 0.1 g hydroquinone methyl ether were used to prepare a polishing pad sample 2-16 having an XY latticed embossed pattern on the surface, a polishing pad sample 2-17 having an embossed concentric circle pattern on the surface, and a polishing pad sample 2-18 having an embossed halftone dot pattern on the surface, in the same manner as for the polishing pad samples 2-13 to 2-15.

(Preparation of Polishing Pad Samples 2-19 to 2-21)

258 g polyurethane resin Vylon UR-8400 (toluene/methyl ethyl ketone (1/1 by weight) solvent, solids content 30%, manufactured by Toyo Boseki Co., Ltd.), 22.5 g 1,6-hexanediol dimethacrylate, 1 g benzyl methyl ketal and 0.1 g hydroquinone methyl ether were used to prepare a polishing pad sample 2-19 having an XY latticed embossed pattern on the surface, a polishing pad sample 2-20 having an embossed concentric circle pattern on the surface, and a polishing pad sample 2-21 having an embossed halftone dot pattern on the surface, in the same manner as for the polishing pad samples 2-13 to 2-15.

(Preparation of Polishing Pad Sample 2-22)

The surface of a foamed polyurethane resin was provided by a chisel with a latticed pattern having a groove width of 2 mm, a pitch width of 1.5 cm and a depth of 0.6 mm to give a polishing pad sample 2-22, but the operation was time-consuming, and the latticed pattern itself was not uniform.

(Preparation of Polishing Pad Sample 2-23)

The same sheet molding as used in preparing the polishing pad samples 2-13 to 2-15 was used without forming a surface pattern to prepare the polishing pad sample 2-23.

[Evaluation]

The polishing pad samples 2-1 to 2-22 were evaluated for polishing by the evaluation method A, and the results are shown in Tables 2-2 and 2-3. Tables 2-2 and 2-3 show the measurement results of the compressibility and compression recovery of the polishing pads, as well as the operativeness for forming surface pattern and pattern reproducibility.

Table 2-4 shows the results of measurement of the static coefficient of friction and the dynamic coefficient of friction of the polishing pad samples 2-13 to 2-15 and the non-pattern polishing pad 2-23.

TABLE 2-1

| Polishing pad sample | Curing composition | | Embossed pattern |
|---|---|---|---|
| 1 | 1,9-nonanediol dimethacrylate | 30 parts | groove width 2 mm |
| | pentaerythritol triacrylate hexamethylene | | pitch width 1.5 cm |
| | diisocyanate urethane prepolymer | 70 parts | depth 0.6 mm |
| | benzyl dimethyl ketal | 1 part | XY latticed groove |
| 2 | The same as above | | groove width 0.3 mm |
| | | | pitch width 1.5 mm |
| | | | depth 0.4 mm |
| | | | concentric circle-shaped groove |
| 3 | The same as above | | diameter 500 μm |
| | | | pitch width 900 μm |
| | | | depth 0.4 mm |
| | | | halftone dot convex |

TABLE 2-1-continued

| Polishing pad sample | Curing composition | | Embossed pattern |
|---|---|---|---|
| 4 | 1,9-nonanediol dimethacrylate<br>aliphatic urethane acrylate<br>benzyl dimethyl ketal | 30 parts<br>70 parts<br>1 part | groove width 2 mm<br>pitch width 1.5 cm<br>depth 0.4 mm<br>XY latticed groove |
| 5 | The same as above | | groove width 0.3 mm<br>pitch width 1.5 mm<br>depth 0.4 mm<br>concentric circle-shaped groove |
| 6 | The same as above | | diameter 500 μm<br>pitch width 900 μm<br>depth 0.4 mm<br>halftone dot convex |
| 7 | 1,9-nonanediol dimethacrylate<br>aromatic urethane acrylate<br>benzyl dimethyl ketal | 40 parts<br>60 parts<br>1 part | groove width 2 mm<br>pitch width 1.5 cm<br>depth 0.4 mm<br>XY latticed groove |
| 8 | The same as above | | groove width 0.3 mm<br>pitch width 1.5 mm<br>depth 0.4 mm<br>concentric circle-shaped groove |
| 9 | The same as above | | diameter 500 μm<br>pitch width 900 μm<br>depth 0.4 mm<br>halftone dot convex |
| 10 | 1,9-nonanediol dimethacrylate<br>oligobutadiene diacrylate<br>aromatic urethane acrylate<br>benzyl dimethyl ketal | 10 parts<br>10 parts<br>80 parts<br>1 part | groove width 2 mm<br>pitch width 1.5 cm<br>depth 0.4 mm<br>XY latticed groove |
| 11 | The same as above | | groove width 0.3 mm<br>pitch width 1.5 mm<br>depth 0.4 mm<br>concentric circle-shaped groove |
| 12 | The same as above | | diameter 500 μm<br>pitch width 900 μm<br>depth 0.4 mm<br>halftone dot convex |

TABLE 2-2

| | Polishing pad sample No. | Hardness shore D | Compressibility (%) | Compression recovery (%) | Polishing rate (nm/min) | Uniformity (%) | Reproducibility | Operativeness | Removal of wafer |
|---|---|---|---|---|---|---|---|---|---|
| Example 2-1 | 2-1 | 71 | 2.1 | 90.0 | 102 | 12 | Good | ○ | No |
| Example 2-2 | 2-2 | | 2.8 | 91.0 | 110 | 8 | Good | ○ | No |
| Example 2-3 | 2-3 | | 3.2 | 90.8 | 100 | 7 | Good | ○ | No |
| Example 2-4 | 2-4 | 78 | 1.9 | 89.0 | 128 | 4 | Good | ○ | No |
| Example 2-5 | 2-5 | | 2.2 | 90.5 | 141 | 3 | Good | ○ | No |
| Example 2-6 | 2-6 | | 2.4 | 91.0 | 115 | 3 | Good | ○ | No |
| Example 2-7 | 2-7 | 68 | 3.1 | 79.3 | 113 | 8 | Good | ○ | No |
| Example 2-8 | 2-8 | | 3.9 | 80.0 | 118 | 6 | Good | ○ | No |
| Example 2-9 | 2-9 | | 4.5 | 81.3 | 111 | 6 | Good | ○ | No |
| Example 2-10 | 2-10 | 59 | 4.7 | 75.1 | 136 | 10 | Good | ○ | No |
| Example 2-11 | 2-11 | | 5.3 | 76.2 | 142 | 9 | Good | ○ | No |
| Example 2-12 | 2-12 | | 5.9 | 76.4 | 132 | 7 | Good | ○ | No |

TABLE 2-3

| | Polishing pad sample No. | Hardness shore D | Compressibility (%) | Compression recovery (%) | Polishing rate (nm/min) | Uniformity (%) | Reproducibility | Operativeness | Removal of wafer |
|---|---|---|---|---|---|---|---|---|---|
| Example 2-13 | 2-13 | 80 | 0.8 | 91.9 | 103 | 15 | Good | ○ | No |
| Example 2-14 | 2-14 | | 0.7 | 93.6 | 108 | 12 | Good | ○ | No |
| Example 2-15 | 2-15 | | 0.8 | 95.1 | 114 | 10 | Good | ○ | No |
| Example 2-16 | 2-16 | 80 | 0.9 | 91.6 | 102 | 15 | Good | ○ | No |
| Example 2-17 | 2-17 | | 0.7 | 92.4 | 104 | 11 | Good | ○ | No |
| Example 2-18 | 2-18 | | 0.8 | 92.8 | 110 | 9 | Good | ○ | No |
| Example 2-19 | 2-19 | 72 | 1.1 | 82.9 | 113 | 11 | Good | ○ | No |
| Example 2-20 | 2-20 | | 1.3 | 83.3 | 120 | 8 | Good | ○ | No |
| Example 2-21 | 2-21 | | 1.4 | 85.0 | 130 | 6 | Good | ○ | No |
| Comparative Example 2-1 | 2-22 | 52 | 1.2 | 76.5 | 100 | 30 | Poor | x | Yes |

The results in Tables 2-2 and 2-3 indicate that the polishing pads of this invention are excellent in reproducibility with less variation in qualities in forming surface pattern by an individual, easily enables a change in processed patterns to improve operativeness, and are excellent in uniformity in polishing. Further, there does not arise the problem of wafer removal during polishing.

TABLE 2-4

| Polishing pad sample | Pattern | Static friction coefficient | Dynamic friction coefficient | Removal of wafer |
|---|---|---|---|---|
| 2-13 | XY | 1.14 | 1.01 | No |
| 2-14 | concentric circle | 1.10 | 0.98 | No |
| 2-15 | halftone dot | 0.88 | 0.72 | No |
| 2-23 | No | 1.49 | 1.27 | Yes |

Example 3

[Preparation of a Polishing Pad]

(Polishing Pad Sample 3-1)

A mixture of 60 parts by weight of oligobutadiene diol diacrylate (BAC-45, Osaka Organic Chemical Industry., Ltd.), 40 parts by weight of 1,9-nonanediol dimethacrylate (1,9-NDH, Kyoeisha Chemical Co., Ltd.) and 1 part by weight of benzyl dimethyl ketal (Irgacure 651, Ciba-Geigy) was stirred with a homogenizer for 10 minutes and then applied by a coater onto PET films coated with a releasing agent, such that the mixture was sandwiched between the PET films to prepare a non-crosslinked sheet of 2 mm in thickness. The polishing layer side of this sample was cured in a usual manner by irradiation with UV rays. After curing, the PET films were removed to give a polishing pad sample 3-1.

(Polishing Pad Sample 3-2)

A mixture of 40 parts by weight of 1,9-nonanediol dimethacrylate (1,9-NDH, Kyoeisha Chemical Co., Ltd.), 60 parts by weight of aliphatic urethane acrylate (Actilane 270, AKCROS CHEMICALS), and 1 part by weight of benzyl dimethyl ketal (Irgacure 651, Ciba-Geigy) was stirred with a homogenizer for 10 minutes and then applied by a coater onto PET films coated with a releasing agent, such that the mixture was sandwiched between the PET films to prepare a non-crosslinked sheet of 2 mm in thickness. This sample was cured by irradiation with UV rays in the same manner as for the polishing pad sample 3-1. After curing, the PET films were removed to give a polishing pad sample 3-2.

(Polishing Pad Sample 3-3)

A mixture of 40 parts by weight of bisphenol A epoxy resin (Epicoat 154, Yuka Shell Epoxy Co., Ltd.), 60 parts by weight of bisphenol A epoxy resin (Epicoat 871, Yuka Shell Epoxy Co., Ltd.) and 1 part by weight of 2-methyl imidazole was stirred with a homogenizer for 10 minutes and then applied by a coater onto PET films coated with a releasing agent, such that the mixture was sandwiched between the PET films to prepare a non-crosslinked sheet of 2 mm in thickness. This sample was cured by heating its upper and lower parts at 150° C. and 90° C. respectively. After curing, the PET films were removed to give a polishing pad sample 3-3.

(Polishing Pad Sample 3-4)

A mixture of 60 parts by weight of oligobutadiene diol diacrylate (BAC-45, Osaka Organic Chemical Industry., Ltd.), 40 parts by weight of 1,9-nonanediol dimethacrylate (1,9-NDH, Kyoeisha Chemical Co., Ltd.) and 1 part by weight of benzyl dimethyl ketal (Irgacure 651, Ciba-Geigy) was stirred with a homogenizer for 10 minutes and then applied by a coater onto PET films coated with a releasing agent, such that the mixture was sandwiched between the PET films. The other side of the polishing layer side was irradiated with UV rays, and then the sample, with a negative film having circles of 50 μm in diameter arranged on the polishing layer, was cured by irradiation with UV rays. Thereafter, the PET films were removed, and the sample was developed with toluene and dried to give a polishing pad sample 3-4 having cylinders of 50 μm in diameter in the polishing surface.

(Polishing Pad Sample 3-5)

A mixture of 60 parts by weight of oligobutadiene diol diacrylate (BAC-45, Osaka Organic Chemical Industry., Ltd.), 40 parts by weight of 1,9-nonanediol dimethacrylate (1,9-NDH, Kyoeisha Chemical Co., Ltd.) and 1 part by weight of benzyl dimethyl ketal (Irgacure 651, Ciba-Geigy) was stirred with a homogenizer for 10 minutes and then applied by a coater onto PET films coated with a releasing agent, such that the mixture was sandwiched between the PET films. The other side of the polishing layer side of this sample was irradiated with UV rays, and then this sample, with a negative film provided with XY grooves placed on the polishing layer side, was cured by irradiation with UV rays. Thereafter, the PET films were removed, and the sample was developed with toluene and dried to give a polishing pad sample 3-5 having XY grooves on the polishing surface.

(Polishing Pad Samples 3-6 and 3-7)

A mixture of 100 parts by weight of Actilane 200 (AKROS CHEMICALS) and 1 part by weight of benzyl dimethyl ketal (Irgacure 651, Ciba-Geigy) was stirred with a homogenizer for 10 minutes and then applied by a coater onto PET films coated with a releasing agent, such that the mixture was sandwiched between the PET films to prepare a non-crosslinked sheet of 2 mm in thickness.

This non-crosslinked sheet sample was cured in a usual manner by irradiating its polishing layer side with UV rays. After curing, the PET films were removed to give a polishing pad sample 3-6.

Then, the other side of the polishing layer of this non-crosslinked sheet sample were irradiated with UV rays, and then this sample, with a negative film having circles of 50 μm in diameter arranged on the polishing layer side, was cured by irradiation with UV rays. Thereafter, the PET films were removed, and the sample was developed with toluene and dried to give a polishing pad sample 3-7 having cylinders of 50 μm in diameter arranged on the polishing surface.

(Polishing Pad Sample 3-8)

200 g polyurethane resin Vylon UR-1400 (toluene/methyl ethyl ketone (1/1 by weight) solvent, solids content 30%, manufactured by Toyo Boseki Co., Ltd.), 40 g trimethylol propane trimethacrylate, 1 g benzyl dimethyl ketal and 0.1 g hydroquinone methyl ether were mixed under stirring by a kneader, and the solvent was removed, whereby a solid photosetting composition was obtained. This composition was sandwiched between films and pressed at 10 atmospheric pressure with a pressing machine at 100° C., to give a sheet molding of 2 mm in thickness. The other side of the polishing layer side of this sheet sample was irradiated with UV rays, and then this sample with a negative film having circles of 50 μm in diameter arranged on the polishing surface was cured by irradiation with UV rays. Thereafter, the PET films were removed, and the sample was developed with toluene and dried to give a polishing pad sample 3-8 having cylinders of 50 μm in diameter on the polishing surface.

(Polishing Pad Sample 3-9)

258 g polyurethane resin Vylon UR-8400 (toluene/methyl ethyl ketone (1/1 by weight) solvent, solids content 30%, manufactured by Toyo Boseki Co., Ltd.), 22.5 g 1,6-hexanediol dimethacrylate, 1 g benzyl dimethyl ketal and 0.1 g hydroquinone methyl ether were mixed under stirring by a kneader, and the solvent was removed, whereby a solid photosetting composition was obtained. This composition was sandwiched between films and pressed at 10 atmospheric pressure with a pressing machine at 100° C., to give a sheet molding of 2 mm in thickness. The other side of the polishing layer side of this sheet sample was irradiated with UV rays, and then this sample with a negative film having XY grooves arranged on the polishing surface was cured by irradiation with UV rays. Thereafter, the PET films were removed, and the sample was developed with toluene and dried to give a polishing pad sample 3-9 having XY grooves on the polishing surface.

(Polishing Pad Sample 3-10)

A commercial polishing pad made of polyurethane, IC-1000A21, was used in polishing pad sample 3-10.

The evaluation results of these pads are shown in Table 3. Evaluation of the polishing characteristics was conducted according to the polishing evaluation method A.

TABLE 3

| | Used polishing pad sample | Hardness (Shore D) Surface (light-exposed surface) | Hardness (Shore D) Backside | Compressibility (%) | Compression recovery (%) | Polishing rate (nm/min) | Uniformity (%) |
|---|---|---|---|---|---|---|---|
| Example 3-1 | 3-1 | 61 | 52 | 1.5 | 90.0 | 130 | 8 |
| Example 3-2 | 3-2 | 64 | 55 | 4.6 | 89.0 | 128 | 4 |
| Example 3-3 | 3-3 | 66 | 58 | 1.9 | 79.6 | 110 | 7 |
| Example 3-4 | 3-4 | 60 | 52 | 1.8 | 92.3 | 113 | 8 |
| Example 3-5 | 3-5 | 58 | 51 | 2.0 | 89.4 | 140 | 5 |
| Example 3-6 | 3-6 | 65 | 61 | 3.7 | 81.4 | 121 | 11 |
| Example 3-7 | 3-7 | 64 | 60 | 3.9 | 84.9 | 123 | 8 |
| Example 3-8 | 3-8 | 80 | 75 | 0.5 | 91.6 | 111 | 9 |
| Example 3-9 | 3-9 | 72 | 68 | 1.4 | 85.0 | 139 | 7 |
| Comparative Example 3-1 | 3-10 | 52 | 52 | 1.2 | 76.5 | 100 | 30 |

Example 4

Example 4-1

(Polishing Layer)

As the polishing layer forming material, a photosensitive resin prepared in the following manner was used. 258 g polyurethane resin (Vylon UR-8400, toluene/methyl ethyl ketone (1/1 by weight), solids content 30%, manufactured by Toyo Boseki Co., Ltd.), 22.5 g 1,6-hexanediol dimethacrylate, 1 g benzyl dimethyl ketal and 0.1 g hydroquinone methyl ether were mixed under stirring by a kneader, and the solvent was removed, whereby a solid photosetting composition was obtained. This composition was sandwiched between films and pressed at 10 atmospheric pressure with a pressing machine at 100° C., to give a sheet molding of 1.27 mm in thickness. This sheet molding was irradiated with UV rays for a predetermined time, and the other side with a mask film having a desired pattern drawn thereon was irradiated with UV rays, and after the films were removed, the sheet was developed. The sheet was dried at 60° C. for 30 minutes to give a (nonporous) polishing layer. The pattern film used was the one giving XY latticed grooves (groove width 2.0 mm, groove depth 0.6 mm, groove pitch 15.0 mm) to the polishing surface of the polishing layer. The polishing layer used was the one cut into a disk of 60 cm in diameter. The storage elastic modulus of the resulting polishing layer was 350 MPa, and the tensile elastic modulus was 860 MPa.

(Cushion Layer)

A polyethylene foam (Toray PEF, manufactured by Toray Industries, Inc.) having a surface brushed with a buff and subjected to corona treatment (thickness, 1.27 mm; storage elastic modulus, 7.9 MPa) was used.

(Polishing Pad)

A double-tacked tape (Double Tack Tape, manufactured by Sekisui Chemical Co., Ltd.) was stuck on the other side than the polishing surface of the polishing layer, and the cushion layer was stuck on the double-tacked tape. Further, a double-coated tape was stuck on the side of the cushion layer opposite to the polishing layer, to prepare a polishing pad.

Example 4-2

A polishing pad was prepared in the same manner as in Example 4-1 except that (in the polishing layer) in Example 4-1, a solid photosetting composition prepared by mixing 258 g polyurethane resin (Vylon UR-8300, solvent: toluene/methyl ethyl ketone (1/1: ratio by weight), solids content 30% by weight, manufactured by Toyo Boseki Co., Ltd.), 22.5 g trimethylol propane trimethacrylate, 1 g benzyl dimethyl ketal, and 0.1 g hydroquinone methyl ether by a kneader and removing the solvent was used as the polishing layer-forming material. The storage elastic modulus of the resulting polishing layer was 200 MPa, and the tensile elastic modulus was 690 MPa.

Example 4-3

A polishing pad was prepared in the same manner as in Example 4-1 except that (in the polishing layer) in Example 4-1, a molded polyurethane sheet (polymer of a polyether urethane prepolymer (Adiprene L-325, Uniroyal) with a curing agent (4,4'-methylene-bis[2-chloroaniline])) was used as a polishing layer-forming material to prepare a (nonporous) polishing layer (polishing layer thickness 1.27 mm), and the polishing surface of the polishing layer was formed XY latticed grooves (groove width 2.0 mm, groove depth 0.6 mm, groove pitch 15.0 mm) by an external means, and then the polishing layer was cut into a disk of 60 cm in diameter. The storage elastic modulus of the resulting polishing layer was 700 MPa, and the tensile elastic modulus was 1050 MPa.

Example 4-4

A polishing pad was prepared in the same manner as in Example 4-1 except that (in the polishing layer) in Example 4-1, a molded polyester sheet (polyethylene terephthalate) was used as a polishing layer-forming material to prepare a (nonporous) polishing layer (polishing layer thickness 1.27 mm), and the polishing surface of the polishing layer was formed XY latticed grooves (groove width 2.0 mm, groove depth 0.6 mm, groove pitch 15.0 mm) by an external means, and then the polishing layer was cut into a disk of 60 cm in diameter. The storage elastic modulus of the resulting polishing layer was 795 MPa, and the tensile elastic modulus was 1200 MPa.

Comparative Example 4-1

A polishing pad was prepared in the same manner as in Example 1 except that (in the polishing layer) in Example 4-1, foamed polyurethane (IC1000, manufactured by Rodel) was used as a polishing layer-forming material to prepare a (nonporous) polishing layer (polishing layer thickness 1.27 mm), and the polishing surface of the polishing layer was formed XY latticed grooves (groove width 2.0 mm, groove depth 0.6 mm, groove pitch 15.0 mm) by an external means, and then the polishing layer was cut into a disk of 60 cm in diameter. The storage elastic modulus of the resulting polishing layer was 190 MPa, and the tensile elastic modulus was 200 MPa.

The polishing pads obtained in the Examples and Comparative Examples were evaluated for polishing rate and planarization characteristics according to the polishing evaluation method (B). The results are shown in Table 4.

TABLE 4

| | Storage elastic modulus of the polishing layer (MPa) | Polishing rate (Å/min) | Local difference in step height (Å) | Abrasion loss of 270 μm space (Å) |
|---|---|---|---|---|
| Example 4-1 | 350 | 1580 | 1100 | 500 |
| Example 4-2 | 200 | 2190 | 400 | 1500 |
| Example 4-3 | 700 | 1800 | 800 | 1400 |
| Example 4-4 | 795 | 1350 | 1100 | 1300 |
| Comparative Example 4-1 | 190 | 2200 | 1300 | 4600 |

From the results shown in Table 4-1, it is recognized that a polishing pad having the polishing layer and the cushion layer wherein the storage elastic modulus of the polishing layer was 200 MPa or more, and the storage elastic modulus of the cushion layer was lower than that of the polishing layer can improve planarization characteristics.

(Sample 6-1)

84 parts by weight of a polymer i.e. a styrene-butadiene copolymer (SBR1507, manufactured by JSR), 10 parts by weight of a monomer lauryl methacrylate, 1 part by weight of a photo-initiator benzyl dimethyl ketal and 5 parts by weight of a plasticizer, liquid isoprene, were blended, melted and mixed in a twin-screw extruder, and extruded through a T die. The resulting sheet was sandwiched between PET films of 100 μm in thickness and pressed against rolls such that the whole thickness of the sheet became 2 mm, to form an uncured cushion sheet.

Both sides of the uncured cushion sheet were irradiated with UV rays to cure the whole surface, and the PET films were removed to give sample 6-1.

(Sample 6-2)

One side of the uncured cushion sheet obtained in the method of forming the sample 6-1 was irradiated with UV rays, and then PET on the other side was removed, and a halftone dot negative film (diameter of light-permeable region, 0.6 mm; distance between halftone dot centers, 1.2 mm) was placed thereon, and the negative film was irradiated with UV rays. After irradiation, the cushion sheet was dipped in a mixed solvent of toluene/methyl ethyl ketone (1/1 by weight) and rubbed with a nylon brush in the solvent to wash away the uncured region. The resulting pattern cushion sheet was dried in an oven at 60° C., and the embossed surface was cured by irradiation with UV rays.

By removing the PET sheet on the backside, sample 6-2 was obtained. The concave of sample 6-2 was 0.6 mm in depth.

(Sample 6-3)

A commercial nonwoven fabric cushion layer, SUBA400 (Rodel) was used as sample 6-3.

The characteristic values of the samples are shown below.

TABLE 6-1

| | (Shore A) | Compressibility (%) | Compression recovery (%) |
|---|---|---|---|
| Sample 6-1 | 17 | 20.4 | 92.9 |
| Sample 6-2 | 18 | 26.8 | 90.2 |
| Sample 6-3 | 52 | 8.0 | 88.0 |

Each sample was laminated with a commercial polyurethane polishing pad IC-1000 (Rodel) and evaluated for polishing characteristics by the evaluation method C. The results are shown below.

TABLE 6-2

| | Cushion layer | Polishing rate (Å/min) | Uniformity on the surface |
|---|---|---|---|
| Example 6-1 | Sample | 192 | 2.2 |
| Example 6-2 | Sample | 188 | 2.0 |
| Comparative Example 6-1 | sample | 100 | 3.5 |

<[II] Slurry-Free Polishing Pad>

Examples of the slurry-free polishing pad of this invention are described.

As the resin forming the polishing layer of this invention, the one having ionic groups in the range of 20 to 1500 eq/ton can be used without particular limitation. The resin may be linear or branched, and may have a structure having side chains added to the main chain thereof. Insofar as the ionic groups are contained in the resin, they may be present in either the main chain or side chains.

The ionic groups possessed by the resin include anionic groups such as carboxyl group, sulfonate group, sulfate group, phosphate group or salts thereof (hydrogen salt, metal salt, ammonium salt) and/or cationic groups such as primary to tertiary amine groups. Among these ionic groups, a carboxyl group, ammonium carboxylate group, sulfonate group, alkali metal sulfonate etc. can be preferably used.

Preferable examples of the resin include polyester resin, polyurethane resin, acryl resin, polyester polyurethane resin etc. Among these, the polyester resin is particularly preferable. This polyester resin may be modified with urethane, acryl compound etc.

Hereinafter, the polyester resin is described as a typical example of the resin having ionic groups in the range described above.

(Polyester Resin)

The polyester resin is obtained basically by polycondensating a polyvalent carboxylic acid with a polyvalent alcohol.

Mainly, the polyvalent carboxylic acid includes dicarboxylic acids and acid anhydrides thereof. The dicarboxylic acids include, for example, aromatic dicarboxylic acids such as terephthalic acid, isophthalic acid, orthophthalic acid, 1,5-napthathalic acid and biphenyl dicarboxylic acid. The aromatic dicarboxylic acid is used preferably in an amount of 40 mol-% or more, more preferably 60 mol-% or more, based on the polycarboxylic acid component. Among the aromatic dicarboxylic acids, terephthalic acid and isophthalic acid are preferable, and these are used preferably in an amount of 50 mol-% or more based on the total aromatic dicarboxylic acids.

Dicarboxylic acids other than the aromatic dicarboxylic acids include aliphatic dicarboxylic acids such as succinic acid, adipic acid, azelaic acid, sebacic acid and dodecane dicarboxylic acid, and alicyclic dicarboxylic acids such as 1,4-cyclohexane dicarboxylic acid, 1,3-cyclohexane dicarboxylic acid, 1,2-cyclohexane dicarboxylic acid, dimer acid, trimer acid and tetramer acid.

The dicarboxylic acids include aliphatic or alicyclic dicarboxylic acids containing unsaturated double bonds, such as fumaric acid, maleic acid, itaconic acid, citraconic acid, hexahydrophthalic acid, tetrahydrophthalic acid, 2,5-norbornene dicarboxylic acid or anhydrides thereof.

As the polyvalent carboxylic acid component, tricarboxylic acids and tetracarboxylic acids such as trimellitic acid, trimesic acid and pyromellitic acid can be used as necessary.

The polyvalent alcohol component in this invention includes, for example, diols such as ethylene glycol, propylene glycol, 1,3-propane diol, 1,4-butane diol, 1,5-pentane diol, 1,6-hexane diol, neopentyl glycol, diethylene glycol, dipropylene glycol, 2,2,4-trimethyl-1,3-pentane diol, 1,4-cyclohexane dimethanol, spiroglycol, 1,4-phenylene glycol, a 1,4-phenylene glycol ethylene oxide adduct, polyethylene glycol, polypropylene glycol, polytetramethylene glycol, tricyclodecane dimethanol, dimer diol, a diol such as hydrogenated dimer diol, a bisphenol A ethylene oxide adduct and propylene oxide adduct, a hydrogenated bisphenol A ethylene oxide adduct and propylene oxide adduct, and if necessary the polyvalent alcohol component includes triols such as trimethylol ethane, trimethylol propane and glycerin and tetraols such as pentaerythritol.

As the polyvalent alcohol component, polyvalent alcohol components containing unsaturated double bonds, such as glycerine monoallyl ether, trimethylol propane monoallyl ether and pentaerythritol monoallyl ether can be used.

Further, the usable polyester resin makes use of aromatic oxycarboxylic acids such as p-oxybenzoic acid and p-(hydroxyethoxy)benzoic acid in addition to the polyvalent carboxylic acids and polyvalent alcohols described above.

The number-average molecular weight of the polyester resin is preferably 3000 to 100000, more preferably 4000 to 30000.

(Introduction of Ionic Groups)

The method of introducing ionic groups into the resin is not particularly limited. For introduction of ionic groups into the polyester resin, there is a method of using polyvalent carboxylic acids and/or polyvalent alcohols having ionic groups not reacting with carboxyl groups or hydroxyl groups in polycondensation of the polyester. Such components include, for example, polyvalent carboxylic acids containing sulfonate groups, such as sulfoterephthalic acid, 5-sulfoisophthalic acid, 4-sulfophthalic acid, 4-sulfonaphthalene-2,7-dicarboxylic acid and 5[4-sulfophenoxy]isophthalic acid, as well as metal salts thereof. Monocarboxylic acids containing sulfonate groups, such as sulfobenzoic acid and metal salts thereof can be used to introduce ionic groups into the terminals of the polymer.

For introducing ionic groups into the polyester resin, the polyester obtained by polycondensating a polyvalent carboxylic acid with a polyvalent alcohol is used as a major skeleton, and side chains having ionic groups can be introduced into the polyester. For introducing side chains having ionic groups, polyvalent carboxylic acid and/or polyvalent alcohol having a polymerizable unsaturated double bond is used to introduce a double bond into the polyester, followed by graft polymerization with a radical polymerizable monomer having an ionic group. As the radical polymerizable monomer, the exemplified monomers having ionic groups can be used without limitation. The radical polymerizable monomers are not limited to those having ionic groups, and these monomers can be used in combination with those not having any ionic group. The ratio of the main chain to side chain in the polyester resin is not particularly limited, but preferably the main chain/side chain is in the range of 40/60 to 95/5 by weight.

Alternatively, the polyester resin having ionic groups in the above range can be prepared by regulating carboxyl groups remaining at the terminals of the polyester resin. For example, the polyester resin having ionic groups in the above range can be prepared by introducing a larger number of carboxyl groups to the terminals of the resin by adding a trivalent or more carboxylic acid anhydride such as trimellitic anhydride, pyromellitic anhydride or phthalic anhydride at the final stage of polymerization of the polyester resin.

The anionic groups such as carboxyl group and sulfonate group introduced into the polyester resin may previously be formed into salts, or neutralized with ammonia, alkali metals or amines by post-treatment for effectively utilizing the ionic groups. The metal salts are Li, Na, K, Mg, Ca, Cu and Fe salts, particularly preferably K salts.

The resins having ionic groups in this invention may be used alone or in combination thereof if necessary. Further, the resin in this invention can be used in a molten form or solution form in combination with a resin serving as a curing agent. For example, the polyester resin can be mixed with amino resin, epoxy resin, isocyanate compound etc. and can also be reacted partially therewith.

(Method of Preparing an Aqueous Dispersion)

The resin having ionic groups in this invention has ionic groups in the range of 20 to 1000 eq/ton, and is thus made water-dispersible to form a microscopic aqueous dispersion by self-emulsification. The ionic groups are required to make the resin soluble and water-dispersible. The particle diameter of such microscopic dispersion is preferably about 0.01 to 1 μm.

A specific method of self-emulsification in the case of a resin (polyester resin) having a carboxyl group, sulfonate group, sulfate group and phosphate group as the ionic groups comprise, for example, the steps of (1) dissolving the resin in a water-soluble organic compound, (2) adding cations for neutralization, (3) adding water, and (4) removing the water-soluble organic compound by azeotropic distillation or dialysis.

A specific method of self-emulsification in the case of a resin (polyester resin) having anionic groups such as carboxylic group, sulfonate group, sulfate group and phosphate group (metal salt, ammonium salt) or cationic groups such as primary to tertiary amine groups as the ionic groups comprises, for example, the steps of (1) dissolving the resin in a water-soluble organic compound, (2) adding water, and (3) removing the water-soluble organic compound by azeotropic distillation or dialysis. For self-emulsification, an emulsifier and a surfactant can also be simultaneously used.

As the water-soluble organic compound, water-soluble solvents of relatively low boiling point such as methanol, ethanol, propanol, butanol, acetone, methyl ethyl ketone, tetrahydrofuran, dioxane, butyl cellosolve, and ethyl cellosolve can be preferably used.

The cation source used for neutralization includes alkali metal hydroxides, alkali metal carbonates, alkali metal bicarbonates, ammonia, amines such as triethylamine, monoethanolamine, diethanolamine, triethanolamine, dimethylethanolamine, diethylethanolamine, monomethyldiethanolamine, monoethyldiethanolamine, isophorone, aminoalcohols, cyclic amines etc.

The resin forming the polishing layer in this invention is, for example, a polymer resin wherein the main chain is a polyester containing at least 60 mol-% aromatic dicarboxylic acid in the total carboxylic acid component, or polyester polyurethane comprising the polyester as a major constituent component, and the side chain is a polymer of radical polymerizable monomers containing hydrophilic functional groups.

With respect to the conditions of the side chain, the side chain is preferably a polymer of radical polymerizable monomers satisfying the following requirements (1) to (2).

That is, the side chain is;

(1) In the polymer of radical polymerizable monomers constituting the side chain, electron accepting monomers wherein the e value in the Q-e value is 0.9 or more and electron donating monomers wherein the e value is −0.6 or less account for at least 50 weight % of the whole radical polymerizable monomers.

(2) In the polymer of radical polymerizable monomers constituting the side chain, aromatic radical polymerizable monomers account for at least 10 weight % of the whole radical polymerizable monomers.

The radical polymerizable monomers used in the side chain are composed mainly of radical polymerizable monomers which should be a combination of radical polymerizable monomers wherein the e value in the Q-e value proposed by Alfrey-Price is 0.9 or more, preferably 1.0 or more, more preferably 1.5 or more, and monomers wherein the e value is −0.6 or less, preferably −0.7 or less, more preferably −0.8 or less.

A large minus e value indicates that the polymer has strongly electron donating substituent groups, and thus electrons not participating in bonding, present in unsaturated bonding regions, occur in excess thus indicating that the double bonds and radicals formed therefrom are negatively polarized. On the other hand, a large plus number indicates that the polymer has strongly electron withdrawing substituents, and thus electrons not participating in bonding, present in unsaturated bonding regions, are deficient thus indicating that the double bonds and radicals formed therefrom are positively polarized. When a radical polymerizable monomer having an electron donating substituent group, that is, a monomer having a large minus e value is combined with a radical polymerizable monomer having an electron withdrawing substituent group, that is, a monomer having a large plus e value, that is, when monomers in an opposite electron state are combined in copolymerizing radical polymerizable monomers, monomers whose radicals formed during polymerization are easily added to one another are those monomers having an e value of opposite polarity, and this tendency is significant as the difference in the e value thereamong is increased. Because monomers having a great difference in the e value are actually easily copolymerized, random copolymerization occurs more smoothly than block copolymerization, and the monomers in the resulting side chain can be made more similar to the monomers prepared as the starting material.

The unsaturated bonds in the modified resin are derived from unsaturated dicarboxylic acids such as fumaric acid and itaconic acid or allyl compounds having a hydroxyl group or a carboxyl group, such as glycerin monoallyl ether, and the e values of these compounds are as positively very large as 1.0 to 3.0 in the case of fumaric acid and itaconic acid (or 1.0 to 2.0 in the case of diester) because of the presence of an electron withdrawing carboxyl group as the substituent group in an unsaturated bonding region, and thus its unsaturated bond is positively polarized, while the e values of allyl compounds are as negatively very large as −1.0 to −2.0 because of allyl resonance, and thus their unsaturated bond is negatively polarized. When graft reaction is carried out, radical polymerizable monomers highly copolymerizable (that is, those having an e value of opposite polarity with a great difference) with unsaturated bonds in a resin to be modified can be used to preventing homopolymerization of the monomers, thus allowing them to react with the resin to be modified. That is, the modified resin copolymerized with fumaric acid having an positively large e value is easily copolymerized with monomers having a negatively large e value, out of the radical polymerizable monomers in this invention which should be a combination of monomers having an e value of 0.9 or more and monomers having an e value of −0.6 or less, thus improving the graft efficiency, while the modified resin having allyl groups having a negatively large e value is easily copolymerized with monomers having a positively large e value, thus improving the graft efficiency in this case too, and in both the cases, the amount of a homopolymer of radical polymerizable monomers not reacting with the resin modified can be reduced. This invention is also characterized in that gelation can be inhibited by the ratio of the monomer having an e value of 0.9 or more to the monomer having an e value of −0.6 or less. In conventional modification of an unsaturated bond-containing resin with radical polymerizable monomers, sufficient graft reaction does not occur when the amount of the unsaturated bonds in the resin to be modified is low, and a homopolymer of the radical polymerizable monomers is formed, while when the amount of unsaturated bonds is high, gelation occurs due to coupling between graft chains, and the range of the amount of unsaturated bonds which can be actually used in the resin to be modified is very narrow, but in this invention, gelation can be inhibited by the ratio of the monomer having an e value of 0.9 or more to the monomer having an e value of −0.6 or less even if the amount of unsaturated bonds is considerably high. In the case of a combination of monomers having e values outside of the above range, the above-described effect is low.

The side chain used in this invention is formed from a mixture of radical polymerizable monomers which should be a combination of radical polymerizable monomers wherein the e value in the Q-e value in radical copolymerization is 0.9 or more and monomers wherein the e value is −0.6 or less, and the components in the side chain include aromatic radical polymerizable monomers. The present inventors extensively studied a cause for deterioration in various physical properties particularly water resistance etc, by modification, and as a result, they found that when the resin to be modified is an aromatic polyester or polyester polyurethane (referred to hereinafter as base resin) changes its physical properties, depending on the composition of the side chains, and that particularly when an aromatic radical polymerizable monomer is used as one component in the side chains to improve the miscibility of the main chain with the side chains, the deterioration in the physical properties can be significantly prevented. When none of aromatic radical polymerizable monomer is used in the side chains, the resulting polymer is poor in the miscibility of the main chain with the side chains, to cause a significant deterioration in the physical properties particularly a deterioration in elongation of its coating.

(Polyester Resin)

The polyester is a polyester containing an aromatic dicarboxylic acid component in an amount of 60 mol-% or more based on the whole acid component, and is produced preferably by copolymerization of polymerizable unsaturated double bond-containing dicarboxylic acids and/or glycols in an amount of 0.5 to 20 mol-% based on the whole dicarboxylic acid component or the whole glycol component. The amount of aliphatic or alicyclic dicarboxylic acids is 0 to 40 mol-%. The aromatic dicarboxylic acids include terephthalic acid, isophthalic acid, orthophthalic acid, naphthalene dicarboxylic acid and biphenyl dicarboxylic acid.

The aliphatic dicarboxylic acids include succinic acid, adipic acid, azelaic acid, sebacic acid, dodecanedione acid and dimer acid, and the alicyclic dicarboxylic acids include 1,4-cyclohexane dicarboxylic acid, 1,3-cyclohexane dicarboxylic acid, 1,2-cyclohexane dicarboxylic acid and acid anhydrides thereof.

The dicarboxylic acid having a polymerizable unsaturated double bond includes α,β-unsaturated dicarboxylic acids such as fumaric acid, maleic acid, maleic anhydride, itaconic acid and citraconic acid, and the alicyclic dicarboxylic acid having a polymerizable unsaturated double bond includes 2,5-norbornene dicarboxylic anhydride and tetrahydrophthalic anhydride. The most preferable among these acids are fumaric acid, maleic acid, itaconic acid and 2,5-norbornene dicarboxylic anhydride.

Hydroxycarboxylic acids such as p-hydroxybenzoic acid, p-(2-hydroxyethoxy)benzoic acid, hydroxy pivalic acid, γ-butyrolactone and ε-caprolactone can also be used if necessary.

On one hand, the glycol component comprises $C_{2-10}$ aliphatic glycol and/or $C_{6-12}$ alicyclic glycol and/or ether linkage-containing glycol, and the $C_{2-10}$ aliphatic glycol includes ethylene glycol, 1,2-propylene glycol; 1,3-propane diol, 1,4-butane diol, 1,5-pentane diol, neopentyl glycol, 1,6-hexane diol, 3-methyl-1,5-pentane diol, 1,9-nonanediol, 2-ethyl-2-butyl propane diol, hydroxy pivalic acid neopentyl glycol ester, dimethylol heptane etc., and the $C_{6-12}$ alicyclic glycol includes 1,4-cyclohexane dimethanol, tricyclodecane dimethylol etc.

The ether linkage-containing glycol includes diethylene glycol, triethylene glycol, dipropylene glycol, and a glycol obtained by adding one mole or a few moles of ethylene oxide or propylene oxide to two phenolic hydroxyl groups of bisphenols, for example, 2,2-bis(4-hydroxyethoxyphenyl) propane. Polyethylene glycol, polypropylene glycol and polytetramethylene glycol can also be used if necessary.

When a dicarboxylic acid having a polymerizable unsaturated double bond are used as the dicarboxylic acid component in an amount of 0.5 to 20 mol-% based on the whole acid component, the polyester resin used in this invention comprises an aromatic dicarboxylic acid in an amount of 60 to 99.5 mol-%, preferably 70 to 99 mol-% and an aliphatic dicarboxylic acid and/or alicyclic dicarboxylic acid in an amount of 0 to 40 mol-%, preferably 0 to 30 mol-%. When the aromatic dicarboxylic acid is less than 60 mol-%, the processability of the coating, expansion resistance of the coating after retort treatment, and blister resistance are lowered. When the aliphatic dicarboxylic acid and/or alicyclic dicarboxylic acid is higher than 40 mol-%, the hardness, stain resistance and resort resistance are lowered, and because aliphatic ester linkages are inferior in hydrolysis resistance to aromatic ester linkages, there arise troubles such as a reduction in the degree of polymerization of the polyester during storage.

The amount of the dicarboxylic acid having a polymerizable unsaturated double bond is 0.5 to 20 mol-%, preferably 1 to 12 mol-%, more preferably 1 to 9 mol-%. When the amount of the dicarboxylic acid having an unsaturated double bond is less than 0.5 mol-%, the effective grafting of the acryl monomer composition onto the polyester resin is not feasible, and homopolymers consisting exclusively of the radical polymerizable monomer composition are mainly formed, and the desired modified resin cannot be obtained.

When the amount of the dicarboxylic acid having a polymerizable unsaturated double bond is higher than 20 mol-%, physical properties are significantly deteriorated, and at the latter stage of graft reaction, the viscosity of the reaction solution is undesirably increased to disturb stirring with a stirrer, to prevent uniform progress of the reaction.

The glycol containing a polymerizable unsaturated double bond includes glycerin monoallyl ether, trimethylol propane monoallyl ether, pentaerythritol monoallyl ether etc.

When the glycol containing a polymerizable unsaturated double bond is used, it can be used in an amount of 0.5 to 20 mol-% relative to the whole glycol component, desirably 1 to 12 mol-%, more desirably 1 to 9 mol-%. When the total amount of the glycol and dicarboxylic acid containing a polymerizable unsaturated double bond is less than 0.5 mol-%, the effective grafting of the radical polymerizable monomer composition onto the polyester resin is not feasible, and homopolymers consisting exclusively of the radical polymerizable monomer composition are mainly formed, and the desired modified resin cannot be obtained.

For introducing polymerizable unsaturated bonds into the polyester, the dicarboxylic acid and/or the glycol is used, and the total amount of the glycol and dicarboxylic acid containing a polymerizable unsaturated double bond is up to 20 mol-%, and when the amount is higher than 20 mol-%, physical properties are significantly deteriorated, and at the latter stage of graft reaction, the viscosity of the reaction solution is undesirably increased to disturb stirring with a stirrer, to prevent uniform progress of the reaction.

In the polyester resin having 0 to 5 mol-% trifunctional or more polycarboxylic acid and/or polyol copolymerized therein, the trifunctional or more polycarboxylic acid include (anhydrous) trimellitic acid, (anhydrous) pyromellitic acid, (anhydrous) benzophenonetetracarboxylic acid, trimesic acid, ethyleneglycol bis(anhydrotrimellitate), glycerol tris(anhydrotrimellitate) etc. On the other hand, the trifunctional or more polyol includes glycerin, trimethylol ethane, trimethylol propane, pentaerythritol etc. The trifunctional or more polycarboxylic acid and/or polyol is copolymerized in the range of 0 to 5 mol-%, preferably 0.5 to 3 mol-%, based on the whole acid component or whole glycol monomer, and given an amount more than 5 mol-%, sufficient processability cannot be given.

The weight-average molecular weight of the polyester resin is in the range of 5000 to 100000, desirably in the range of 7000 to 70000, more desirably 10000 to 50000. When the weight-average molecular weight is 5000 or less, various physical properties are deteriorated, while when the weight-average molecular weight is 100000 or more, the viscosity is increased during graft reaction to prevent uniform progress of the reaction.

(Polyurethane Resin)

The polyurethane resin in this invention is composed of a polyester polyol (a), an organic diisocyanate compound (b), and if necessary a chain extender having an active hydrogen group (c), and the weight-average molecular weight is 5000 to 100000, and the content of urethane linkages is 500 to 4000 equivalents/$10^6$ g, and the polymerizable double bonds are 1.5 to 30 bonds on average per chain. The polyester polyol (a) used in this invention is preferably the one having hydroxyl groups at both ends and a weight-average molecular weight of 500 to 10000, produced by using the compounds exemplified above in the item polyester resin, as the dicarboxylic acid component and glycol component. The polyester polyol used in this invention, similar to the polyester resin, contains the aromatic dicarboxylic acid component in an amount of 60 mol-% or more, preferably 70 mol-% or more.

The aliphatic polyester polyol used widely in general polyurethane resin, for example polyurethane resin using ethylene glycol and neopentyl glycol adipate, is very poor in water resistance. For example, the retention of reduced viscosity thereof after immersion in hot water at 70° C. for 20 days is as low as 20 to 30%, while the retention of reduced viscosity of resin comprising glycol terephthalate and isophthalate as polyester polyol is as high as 80 to 90% under the same conditions. Accordingly, use of polyester polyol based on aromatic dicarboxylic acid is necessary for higher water resistance of a coating. Further, polyether polyol, polycarbonate diol and polyolefin polyol can also be used if necessary in combination with the polyester polyol.

The organic diisocyanate compound (b) used in this invention includes hexamethylene diisocyanate, tetramethylene diisocyanate, 3,3'-dimethoxy-4,4'-biphenylene diisocyanate, p-xylylene diisocyanate, m-xylylene diisocyanate, 1,3-diisocyanate methylcyclohexane, 4,4'-diisocyanate dicyclohexane, 4,4'-diisocyanate cyclohexyl methane, isophorone diisocyanate, 2,4-tolylene diisocyanate, 2,6-tolylene diisocyanate, p-phenylene diisocyanate, diphenyl methane diisocyanate, m-phenylene diisocyanate, 2,4-naphthalene diisocyanate, 3,3'-dimethyl-4,4'-biphenylene diisocyanate, 4,4'-diisocyanate diphenyl ether and 1,5-naphthalene diisocyanate.

The chain extender having an active hydrogen group (c) which is used if necessary includes, for example, glycols such as ethylene glycol, propylene glycol, neopentyl glycol, 2,2-diethyl-1,3-propane diol, diethylene glycol, spiroglycol and polyethylene glycol, and amines such as hexamethylene diamine, propylene diamine and hexamethylene diamine.

The polyurethane resin should be (polyurethane resin) obtained by reacting the polyester polyol (a), the organic diisocyanate (b) and if necessary the chain extender having an active hydrogen group (c) in such a compounding ratio that the active hydrogen group in (a)+(c)/the isocyanate group is in the range of 0.4 to 1.3 (equivalent ratio).

When the ratio of the active hydrogen group in (a)+(c)/the isocyanate group is outside of the above range, the urethane resin cannot be sufficiently polymerized, thus failing to achieve desired coating physical properties. The polyurethane resin used in this invention is produced in the presence or absence of a catalyst at a reaction temperature of 20 to 150° C. in a solvent by a known method. The solvent used includes, for example, ketones such as methyl ethyl ketone, methyl isobutyl ketone and cyclohexanone, aromatic hydrocarbons such as toluene and xylene, and esters such as ethyl acetate and butyl acetate. The catalyst used for promoting the reaction is an amine, an organic tin compound or the like.

The polyurethane resin used in this invention preferably contains about 1.5 to 30, preferably 2 to 20, more preferably 3 to 15 polymerizable double bonds per urethane chain in order to improve the efficiency of the graft reaction of radical polymerizable monomers.

For introduction of the polymerizable double bonds, there are the following 3 methods.

1) Unsaturated dicarboxylic acids such as fumaric acid, itaconic acid and norbornene dicarboxylic acid are contained in the polyester polyol.

2) Glycols containing an allyl ether group are contained in the polyester polyol.

3) Glycols containing an allyl ether group are used as a chain extender.

These may be used alone or in combination thereof. The polymerizable double bond introduced in 1) into the main chain has an e value of 0.9 or more to indicate strong electron acceptance, and the polymerizable double bond introduced in 3) has an e value of −0.6 or less to indicate strong electron donation.

In considering the degree and amount of the electron acceptance or electron donation of the polymerizable double bonds introduced into the base resin in this manner, it is the gist of this invention to subject the radical polymerizable monomers to graft polymerization after taking a method of combining electron-donating and electron-receiving monomers and the ratio thereof into consideration.

According to a conventional theory on formation of graft or block polymers, the number of polymerizable double bonds per main chain shall be one per main chain or per terminal. In prior patents, a very narrow range of nearly 1 is actually claimed. In methods of these prior patents, the number of polymerizable double bonds introduced into the main chain is integrated in fact with statistical distribution, and thus the proportion of chain components wherein the number of polymerizable double bonds per main chain is 0 is increased thereby reducing the graft efficiency. The suitable range is so narrow that an increase in the amount of double bonds causes gelation. On the other hand, the method of this invention based on the principle of reaction alternation among radical polymerizable chemical species has an advantage that the suitable range satisfying two requirements i.e. high graft efficiency and prevention of gelation is broad.

(Radical Polymerizable Monomer)

The e value in the Q-e value in radical copolymerization, proposed by Alfrey-Price, is generally a value empirically showing the state of electrons in an unsaturated linkage portion in the radical polymerizable monomer, and when there is a great difference in the Q value, the monomer is interpreted as useful in the copolymerization reaction, and the value is given in for example Polymer Handbook, 3rd ed. John Wiley and Sons.

The radical polymerizable monomer wherein the e value in the Q-e value is 0.9 or more, which should be used in this invention, is a monomer having an electrophilic substituent group in its unsaturated bond region, and use is made of a mixture of one or more members selected from fumaric acid, fumaric acid monoesters and diesters such as monoethyl fumarate, diethyl fumarate and dibutyl fumarate, maleic acid and an anhydride thereof, maleic acid monoesters and diesters such as monoethyl maleate, diethyl maleate and dibutyl maleate, itaconic acid, itaconic acid monoesters and diesters, maleimide such as phenyl maleimide, and acrylonitrile, most preferably maleic anhydride and esters thereof and fumaric acid and esters thereof.

The radical polymerizable monomer wherein the e value in the Q-e value is −0.6 or less, which should be used in this invention, includes those having an electron-donating substituent group in its unsaturated bond region, or conjugated monomers, and use is made of a mixture of one or more monomers selected from vinyl radical polymerizable monomers such as styrene, α-methyl styrene, t-butyl styrene and N-vinyl pyrrolidone, vinyl esters such as vinyl acetate, vinyl ethers such as vinyl butyl ether and vinyl isobutyl ether, allyl radical polymerizable monomers such as allyl alcohol, glycerin monoallyl ether, pentaerythritol monoallyl ether and trimethylol propane monoallyl ether, and butadiene, most preferably vinyl radical polymerizable monomers such as styrene.

In this invention, a combination of the radical polymerizable monomer wherein the e value is 0.9 or more and the radical polymerizable monomer wherein the e value is −0.6 or less is essential, and the combination accounts for 50 weight % or more, more preferably 60 weight % or more, of the whole radical polymerizable monomers. Based on the unsaturated bonds contained in the resin to be modified, the highly copolymerizable radical polymerizable monomer (that is, the monomer having a large difference from the e value of the unsaturated bonds in the resin to be modified) is contained in an amount of 20 weight % or more in the whole radical polymerizable monomers, while the poorly copolymerizable radical polymerizable monomer (that is, the monomer having a small difference from the e value of the unsaturated bonds in the resin to be modified) is contained in an amount of 20 weight % or more in the whole radical polymerizable monomers. When the former is less than 20 weight %, homopolymerization of the radical polymerizable monomers occurs due to a low graft efficiency onto the main chain. When the latter is less than 20 weight %, gelation occurs during graft polymerization, and the graft reaction cannot proceed smoothly.

Other radical polymerizable monomers which can be copolymerized if necessary with the above essential components include radical polymerizable monomers wherein the e value is −0.6 to 0.9. For example, one or more monomers selected from monomers each having one radical polymerizable double bond, that is, acrylic acid, methacrylic acid and esters thereof such as ethyl acrylate and methyl methacrylate, nitrogen-containing radical polymerizable monomers such as acrylamide and metahcrylonitrile can be used. The Tg of the side chain and miscibility with the main chain are thus regulated, and arbitrary functional groups can be introduced.

Further, the aromatic radical polymerizable monomers essential for the side chain components include radical polymerizable monomers having an aromatic ring, and styrene and styrene derivatives such as α-methyl styrene and chloromethyl styrene, reaction products of 2-hydroxyethyl acrylate (HEA) and 2-hydroxyethyl methacrylate (HEMA), such as phenoxyethyl acrylate, phenoxyethyl methacrylate, benzyl acrylate and benzyl methacrylate with aromatic compounds, reaction products of phthalic acid derivatives such as 2-acryloyloxy ethyl hydrogen phthalate, esters such as HEA and HEMA, acrylic acid, methacrylic acid, and phenyl glycidyl ether, that is, 2-hyddroxy-3-phenoxypropyl (meth) acrylate can be used in introducing an aromatic group into the side chain. In this invention, the proportion of the aromatic radical polymerizable monomer used is 10 weight % or more, preferably 20 weight % or more, most preferably 30 weight % or more, based on the whole radical polymerizable monomers.

(Graft Reaction)

The graft polymer in this invention is obtained by graft polymerization of radical polymerizable monomers with polymerizable unsaturated double bonds in the base resin. The graft polymerization reaction in this invention is carried out by reacting a radical initiator with a mixture of radical polymerizable monomers in a solution of the base resin containing polymerizable double bonds in an organic solvent. After the graft reaction is finished, the reaction product consists usually of the non-grafted base resin, the base resin, and non-grafted homopolymers in addition to the graft polymer. Generally, when the proportion of the graft polymer in the reaction product is low while the proportion of the non-grafted base and non-grafted homopolymers is high, the effect of modification is low, and further an adverse effect such as whitening of a coating due to the non-grafted homopolymers is observed. Accordingly, it is important to select reaction conditions achieving a higher proportion of the graft polymer formed.

To carry out the graft reaction of the radical polymerizable monomers onto the base resin, a mixture of radical polymerizable monomers and a radical initiator may be added all at once to the base resin dissolved in a solvent under heating, or added separately dropwise thereto over a predetermined time followed by heating the mixture to permit the reaction to proceed under stirring for a predetermined time. In a preferable embodiment of this invention, the radical polymerizable monomer having a small difference from the e value of the polymerizable double bonds in the base resin is first added, and then the radical polymerizable monomer having a large difference from the e value of the polymerizable double bonds in the base resin, and an initiator, are added dropped thereto for a predetermined period, followed by heating the mixture to allow the reaction to proceed under stirring for a predetermined time.

Prior to the reaction, the base resin and the solvent are introduced into a reactor, and the resin is dissolved by heating under stirring. The base resin/solvent ratio by weight is desirably in the range of 70/30 to 30/70. In this case, the weight ratio is regulated in such a weight ratio as to enable uniform reaction in the polymerization step, in consideration of the reactivity of the base resin with the radical polymerizable monomers and solubility in solvent. The graft reaction temperature is desirably in the range of 50 to 120° C. The desired base resin/radical polymerizable monomer ratio by weight suitable for the object of this invention is in the range of 25/75 to 99/1, most preferably in the range of 50/50 to 95/5 in terms of base resin/side chain moiety. When the weight ratio of the base resin is not higher than 25% by weight, the excellent performance of the base resin described above, that is, high processability, excellent water resistance and adhesion to various base materials cannot be sufficiently exhibited. A weight ratio of the base resin which is not less than 99% by weight is not preferable because the ratio of the non-grafted base resin in polyester or polyester polyurethane resin is nearly 100%, and the effect of modification is low.

The weight-average molecular weight of the graft chain moiety in this invention is 1000 to 100000. In the case of graft polymerization by radical reaction, it is not preferable that the weight-average molecular weight of the graft chain moiety is 1000 or less because the control of the molecular weight in such a range is generally difficult, thus decreasing the graft efficiency, to lead to poor addition of functional groups to the base resin. When the weight-average molecular weight of the graft chain moiety is 100000 or more, the viscosity is increased significantly during the polymerization reaction, and the polymerization reaction cannot be carried out in the desired homogeneous system. The control of the molecular weight described above can be carried out by the amount of the initiator, dropping time of the monomer, polymerization time, reaction solvent, monomer composition or a suitable combination of a chain transfer agent and a polymerization inhibitor if necessary.

(Radical Initiator)

As the radical polymerization initiator used in this invention, well-known organic peroxides and organic azo compounds can be utilized. That is, the organic peroxides include, for example, benozyl peroxide and t-butyl peroxy pivalate, and the organic azo compounds include 2,2'-azobisisobutyronitrile, 2,2'-azobis(2,4-dimethylvareronitrile) etc.

The radical initiator compound should be selected in consideration of the radical-forming rate (i.e. half-life) at the reaction temperature of the compound. Generally, a radical initiator whose half-life at that temperature is in the range of 1 minute to 2 hours is desirably selected. The amount of the radical initiator used for graft reaction is 0.2% by weight or more, preferably 0.5% by weight or more, based on the radical polymerizable monomers.

The chain transfer agent, for example octyl mercaptan, dodecyl mercaptan or mercaptoethanol is used if necessary for regulation of the length of graft chain. In such a case, the chain transfer agent is added preferably in the range of 0 to 20% by weight based on the radical polymerizable monomers.

(Reaction Solvent)

The reaction solvent includes a wide variety of solvents, for example ketones such as methyl ethyl ketone, methyl isobutyl ketone and cyclohexanone, aromatic hydrocarbons such as toluene and xylene, and esters such as ethyl acetate and butyl acetate. However, the selection of the reaction solvent used in the graft reaction is very important. Desired requirements of the reaction solvent include 1) solubility, 2) suitability as a radical polymerization solvent, 3) boiling point of the solvent, and 4) solubility of the solvent in water. With respect to 1), it is important that the base resin is dissolved or suspended, and branch moieties of the graft polymer composed of a mixture of unsaturated monomers, and non-grafted homopolymers, are well dissolved to the maximum degree. With respect to 2), it is important that the solvent itself does not decompose the radical initiator (induced decomposition), a combination of a specific organic peroxide and a specific ketone solvent does not cause reported explosion, and the reaction solvent for radical polymerization has a suitably low chain transfer constant. With respect to 3), it is desired that because the radical addition reaction of the radical polymerizable monomer is generally an exothermic reaction, the reaction is carried out under reflux conditions to keep the reaction temperature constant. With respect to 4), it is preferable from the viewpoint of industrial application that for the purpose of introducing hydrophilic functional groups through modification into the base resin thereby making the modified resin water-dispersible, the solvent selected under the requirements 1) to 3) is preferably an organic solvent capable of being mixed arbitrarily with water or highly miscible with water, which however is not always an essential requirement of the graft reaction itself. When the fourth requirement is satisfied, an aqueous dispersion can be formed by neutralizing, with a basic compound, the graft reaction product containing the solvent under heating and then adding water to it. More preferably, the organic solvent mixed arbitrarily with water or highly miscible with water has a lower boiling point than that of water. In this case, the organic solvent can be removed by simple distillation from the thus formed aqueous dispersion to the outside of the system.

The graft reaction solvent for carrying out this invention may be either a single solvent or a mixed solvent. A solvent having a boiling point higher than 250° C. is not suitable because it cannot be completely removed due to its too low evaporation rate, even by high-temperature burning of a coating. Use of a solvent having a boiling point lower than 50° C. or less in graft reaction is not preferable because an initiator dissociated into radicals at a temperature of 50° C. or less, which makes handling dangerous, should be used.

For the purpose of dispersing the formed polyester or polyester polyurethane resin in water, the reaction solvent usable in the graft reaction includes solvents desired for dissolving or dispersing the base resin and for dissolving a mixture of radical polymerizable monomers and a polymer thereof relatively well, for example ketones such as methyl ethyl ketone, methyl isobutyl ketone and cyclohexanone, cyclic ethers such as tetrahydrofuran and dioxane, glycol ethers such as propylene glycol methyl ether, propylene glycol propyl ether, ethylene glycol ethyl ether and ethylene glycol butyl ether, carbitols such as methyl carbitol, ethyl carbitol and butyl carbitol, glycols or glycol ether lower esters such as ethylene glycol diacetate and ethylene glycol ethyl ether acetate, ketone alcohols such as diacetone alcohol, and N-substituted amides such as dimethyl formamide, dimethyl acetamide and N-methylpyrrolidone.

When the graft reaction is carried out in a single solvent, one solvent can be selected from organic solvents dissolving the base resin well. When the reaction is carried out in a mixed solvent, the reaction is carried out in a plurality of solvents selected from the above organic solvents only, or in a mixed solvent of at least one solvent selected from the organic solvents dissolving the base resin well and at least one organic solvent selected from lower alcohols, lower carboxylic acids and lower amines hardly dissolving the base resin, and in either case, the reaction can be carried out.

(Method of Preparing the Water-Dispersible Polyester or Polyester Polyurethane Resin)

The graft reaction product in this invention can be made water-dispersible by neutralizing, with a basic compound etc., hydrophilic functional groups introduced by graft reaction. The ratio of the radical polymerizable monomers containing hydrophilic functional groups to the radical polymerizable monomers not containing hydrophilic functional groups in a mixture of the radical polymerizable monomers is related to the type of monomers selected and the weight ratio of base resin/side chain moiety subjected to graft reaction, but preferably the acid value of the graft product is 200 to 4000 equivalent/$10^6$ g, more preferably 500 to 4000 equivalent/$10^6$ g. The basic compound is desirably a compound evaporated at the time of forming a coating or at the time of baking and curing with a curing agent, and ammonia, organic amines etc. are preferable. Preferable examples of such compounds include triethylamine, N,N-diethyl ethanolamine, N,N-dimethylethanolamine, aminoethanolamine, N-methyl-N,N-diethanolamine, isopropylamine, iminobispropylamine, ethylamine, diethylamine, 3-ethoxypropylamine, 3-diethylaminopropylamine, sec-butylamine, propylamine, methylaminopropylamine, dimethylaminopropylamine, methyliminobispropylamine, 3-methoxypropylamine, monoethanolamine, diethanolamine and triethanolamine. Depending on the content of carboxyl groups in the graft reaction product, the basic compound is used such that the pH value of the aqueous dispersion is preferably in the range of 5.5 to 9.0 by at least partial neutralization or complete neutralization.

For forming the aqueous dispersion, the solvent contained in the graft reaction product is removed by an extruder under reduced pressure, and the molten or solid (e.g. pellet or powder) graft reaction product is introduced into water containing the basic compound and stirred under heating, whereby an aqueous dispersion can be formed, but most preferably the aqueous dispersion is produced by a method (one-pot method) wherein the basic compound and water are introduced just after the graft reaction is finished, and heating and stirring are continued to give an aqueous dispersion. In the latter case, the water-miscible solvent used in the graft reaction can be subjected if necessary to distillation or azeotropic distillation with water to remove a part or the whole of the solvent.

The crosslinking agent includes phenol formaldehyde resin, amino resin, multifunctional epoxy compounds, multifunctional isocyanate compounds, various block isocyanate compounds and multifunctional aziridine compounds. The phenol resin includes, for example, alkylated phenol or cresol/formaldehyde condensates. Examples thereof include formaldehyde condensates with alkylated (methyl, ethyl, propyl, isopropyl, butyl) phenol, p-tert-amyl phenol, 4,4'-sec-butylidene phenol, p-tert-butyl phenol, o-, m- or p-cresol, p-cyclohexyl phenol, 4,4'-isopropylidene phenol, p-nonyl phenol, p-octyl phenol, 3-pentadecyl phenol, phenol, phenyl-o-cresol, p-phenyl phenol and xylenol.

The amino resin includes, for example, formaldehyde adducts with urea, melamine and benzoguanamine, and $C_{1-6}$ alcohol alkyl ether compounds thereof. Examples thereof include methoxylated methylol urea, methoxylated methylol N,N-ethylene urea, methoxylated methylol dicyandiamide, methoxylated methylol melamine, methoxylated methylol benzoguanamine, butoxylated methylol melamine and butoxylated methylol benzoguanamine. The amino resin is preferably methoxylated methylol melamine, butoxylated methylol melamine or methylol benzoguanamine, and these resins can be used alone or in combination thereof.

The epoxy compound include bisphenol A diglycidyl ether and an oligomer thereof, hydrogenated bisphenol A diglycidyl ether and an oligomer thereof, diglycidyl orthophthalate, diglycidyl isophthalate, diglycidyl terephthalate, diglycidyl p-oxybenzoate, diglycidyl tetrahydrophthalate, diglycidyl hexahydrophthalate, diglycidyl succinate, diglycidyl adipate, diglycidyl sebacate, ethylene glycol diglycidyl ether, propylene glycol diglycidyl ether, 1,4-butanediol diglycidyl ether 1,6-hexanediol diglycidyl ether and polyalkylene glycol diglycidyl ethers, triglycidyl trimellitate, triglycidyl isocyanurate, 1,4-diglycidyloxybenzene, diglycidyl propylene urea, glycerol triglycidyl ether, trimethylol propane triglycidyl ether, pentaerythritol triglycidyl ether, and glycerol alkylene oxide-added triglycidyl ether.

The isocyanate compounds include aromatic and aliphatic diisocyanates and trivalent or more polyisocyanates, which may be low- or high-molecular compounds. Examples thereof include tetramethylene diisocyanate, hexamethylene diisocyanate, toluene diisocyanate, diphenylmethane diisocyanate, hydrogenated diphenylmethane diisocyanate, xylylene diisocyanate, hydrogenated xylylene diisocyanate, isophorone diisocyanate or trimers of these isocyanate compounds, and isocyanate-terminated compounds obtained by reacting an excess of these isocyanate compounds with low-molecular active hydrogen compounds such as ethylene glycol, propylene glycol, trimethylol propane, glycerin, sorbitol, ethylene diamine, monoethanol amine, diethanol amine and triethanol amine, or various polyester polyols, polyether polyols and polyamides.

The isocyanate compounds may be blocked isocyanates. The isocyanate blocking agent includes, for example, phenol and phenol derivatives such as thiophenol, methyl thiophenol, cresol, xylenol, resorcinol, nitrophenol and chlorophenol, oximes such as acetoxime, methyl ethyl ketoxime and cyclohexanone oxime, alcohols such as methanol, ethanol, propanol and butanol, halogen-substituted alcohols such as ethylene chlorohydrin and 1,3-dichloro-2-propanol, tertiary alcohols such as t-butanol and t-pentanol, and lactams such as ϵ-caprolactam, δ-valerolactam, γ-butyrolactam and β-propyllactam, active methylene compounds such as aromatic amines, imides, acetyl acetone, acetoacetate and ethyl malonate, mercaptan or derivatives thereof, imines, urea or derivatives thereof, sodium sulfites of diaryl compounds. The blocked isocyanate is obtained by addition reaction of the isocyanate compound, the isocyanate compound and the isocyanate blocking agent by a suitable method known in the art.

These crosslinking agents can be used in combination with a curing agent or an accelerator. The method of compounding the crosslinking agent includes a method of mixing it with the base resin and a method of previously dissolving the polyester or polyester polyurethane resin in an organic solvent solution, and dispersing the mixed solution in water, and the method can be arbitrarily selected depending on the type of the crosslinking agent. The curing reaction is carried out generally by compounding 5 to 40 parts (solids content) of the curing resin with 100 parts (solids content) of the polyester or polyester polyurethane resin in this invention and then heating the mixture for about 1 to 60 minutes in the temperature range of 60 to 250° C. depending on the type of the curing agent. If necessary, a reaction catalyst and an accelerator are also used.

(Making Particle Process)

The aqueous resin dispersion having ionic groups or the aqueous polyester or the aqueous polyester polyurethane resin dispersion can be slowly aggregated to form particles of larger diameter. As a means of realizing slow aggregation, a method of adding an ionic compound such as electrolyte to the aqueous dispersion to increase the ionic strength in the system is effective. In addition, means such as (1) cleavage of ionic groups by light decomposition, thermal decomposition or hydrolysis, (2) regulation of the degree of dissociation of ionic groups by temperature, pH etc., (3) blocking of ionic groups by counterions.

The means of slow aggregation in this invention includes, for example, a method of adding an ester compound of amino alcohol with carboxylic acid to the system and generating, in the system, amino alcohol and carboxylic acid generated through hydrolysis of the ester compound, to increase ionic strength. According to this method, the ionic strength can be increased without locally uneven concentration in the system, to give excellent resin particles having regulated particle diameters.

(Abrasive Grains)

The abrasive grains used in this invention can be used without particular limitation. Preferable examples include the above-exemplified silicon oxide, cerium oxide, aluminum oxide, zirconium oxide, ferric oxide, chrome oxide and diamond. These abrasive grains can be selected depending on a material to be polished. In particular, silicon oxide, cerium oxide and aluminum oxide are preferable. These abrasive grains are excellent in polishing characteristics for a silicon wafer itself, a silicon oxide layer deposited on a silicon wafer, a metal wiring material such as aluminum and copper, and a glass substrate. The optimum abrasive grains in polishing can be suitably selected. Further, these abrasive grains are fine abrasive grains having an average particle diameter of 5 to 1000 nm.

In this invention, the content of the abrasive grains in the polishing layer is preferably 20 to 95% by weight, particularly preferably 60 to 85% by weight. When the content of the abrasive grains is 20% by weight or less, the volume ratio of the abrasive grains is low, and when a polishing pad is produced, the polishing rate is reduced or absent. When the abrasive grains are higher than 90% by weight, the viscosity of a mixture of the polishing layer-forming resin and the abrasive grains is increased significantly during molding, to lose processability. Further, the resulting coating is not strong and is thus released during polishing to cause scratches.

(Preparation of a Polishing Layer-Forming Material: Formation of a Composite)

The polishing layer-forming resin such as the resin (polyester resin) having ionic groups, the polyester or polyester polyurethane resin, and fine grain particles are used to form a polishing layer, and the polishing layer-forming material is used as a solution or dispersion in a solvent or as a solution having the aqueous resin dispersion mixed with the abrasive grains.

For preparing these polishing layer-forming materials, the particles of resin having ionic groups (polyester resin) and fine abrasive particles can be formed into a composite. As the method of forming the composite, the hetero-aggregation method can be used.

Hereinafter, introduction of sodium sulfonate groups into the polyester resin is described. The surfaces of the polyester resin particles to which sodium sulfonate groups were introduced are always negatively charged. It is generally known that the polarity of inorganic particles is changed depending on pH. For example, fine particles of silicon dioxide are negatively charged in a neutral range, but positively charged at low pH. When an aqueous dispersion of polyester resin particles regulated in a neutral range is mixed with an aqueous dispersion of fine particles of silicon dioxide regulated in a neutral range, the surfaces of both particles are negatively charged and thus repel one another to maintain the dispersion stably. When an acid is dropped into this system to reduce pH slowly, the surface charge of the fine particles of silicon dioxide can be reversed at a certain point in time to give composite particles having the fine silicon dioxide particles sprinkled on the surfaces of the polyester resin particles.

(Polishing Layer)

Although the method of forming the polishing layer is not particularly limited, the polishing layer is formed by coating a substrate with the polishing layer-forming material (solution) containing the polishing layer-forming resin and abrasive grains and then drying it. The coating method is not particularly limited, and dip coating, brush coating, roll coating, spraying and other printing methods can be used.

Voids are contained in the resulting polishing layer. The method is not particularly limited if voids are formed in the polishing layer. The void size is preferably 10 to 100 μm. The method of containing voids includes, for example:

1) A method of forming the polishing layer by using a mixture of the polishing layer-forming material (solution) and hollow resin particles having an internal void diameter of 10 to 100 μm.

2) A method of forming the polishing layer by using a mixture of the polishing layer-forming material (solution) and a solution insoluble in the resin having ionic groups and applying and drying it to form a coating with voids.

3) A method of forming the polishing layer by using a mixture of the polishing layer-forming material (solution) and a gas-generating material such as an azide compound to be decomposed by heat or light, applying the mixture and generating voids by light irradiation or heat.

4) A method of making voids in the polishing layer-forming material (solution) by shearing at high speed with a stirring blade and then forming the polishing layer with the voids.

(Polishing Pad)

The polishing pad of this invention has the polishing layer containing abrasive grains dispersed in the polishing layer-forming resin. The polishing layer is obtained usually by coating a substrate with the resin. The thickness of the polishing layer is usually about 10 to 500 μm. Preferably, the thickness is 50 to 500 μm. When the thickness of the polishing layer is less than 10 μm, the longevity of the polishing pad is significantly reduced. When the thickness is greater than 500 μm, the polishing pad just after the polishing layer is formed thereon is significantly curled, thus failing to effect good polishing.

In the polishing pad of this invention, the resin having abrasive grains dispersed therein may be a bulk or sheet form, but preferably it is a polishing pad having a polymer substrate coated with the resin.

The polymer substrate includes, but is not limited to, polymer substrates based on polyester, polyamide, polyimide, polyamide imide, acryl, cellulose, polyethylene, polypropylene, polyolefin, polyvinyl chloride, polycarbonate, phenol and urethane resins. Among these materials, polyester resin, polycarbonate resin, acryl resin and ABS resin are preferable from the viewpoint of adhesion, strength, and environmental stress. The thickness of the polymer substrate is usually about 50 to 250 μm.

Further, the strength of adhesion of the polishing layer to the polymer substrate in this invention is preferably 90 or more, particularly preferably 100 in a crosscut test. A coating having this value of less than 90 is poor in adhesion, and when used in polishing, the coating is released to cause scratches.

To improve the uniformity of a material to be polished, a cushion layer of softer material than that of the polishing layer, and if necessary another layer, may be laminated between the polishing layer and the polymer substrate in the polishing pad of this invention. The material of the cushion layer includes a nonwoven fabric, a nonwoven fabric impregnated with resin, and various foamed resins (foamed polyurethane, foamed polyethylene). Further, the surface of the polishing layer can be formed suitably with grooves.

The polymer substrate is stuck on the cushion layer preferably via an adhesive or double-tacked tape. The adhesive or double-tacked tape in this case is not particularly limited, but preferably it is based on acryl resin, styrene butadiene rubber etc. Preferably, the adhesion strength of the layer is at least 600 g/cm in a 180° peeling test. When the adhesion strength is less than 600 g/cm, the cushion layer may be released from the polymer substrate during polishing.

When the cushion layer is arranged, the thickness of the polishing layer is preferably 250 μm to 2 mm, particularly preferably 300 μm to 1 mm. A polishing layer thickness of less than 250 μm is not practical because the polishing layer is also worn out during polishing, to reduce the longevity of the polishing pad. On the other hand, when the thickness of the polishing layer is greater than 2 mm, the surface undergoes significant cracking upon drying of a coating, thus failing to give a beautiful coating. In this case, the thickens of the polymer substrate is preferably 0.25 to 1 mm.

EXAMPLES

Hereinafter, this invention is described in more detail by reference to the Examples, which are not intended to limit this invention.

Production Example 1

An autoclave equipped with a thermometer and a stirrer was charged with:

| | |
|---|---|
| dimethyl terephthalate | 96 parts by weight, |
| dimethyl isophthalate | 94 parts by weight, |
| sodium 5-sulfodimethyl isophthalate | 6 parts by weight, |
| tricyclodecane dimethylol | 40 parts by weight, |
| ethylene glycol | 60 parts by weight, |
| neopentyl glycol | 91 parts by weight, and |
| tetrabutoxy titanate | 0.1 part by weight, |

and the mixture was subjected to ester exchange reaction by heating at 180 to 210° C. for 120 minutes. Then, the reaction was continued for 60 minutes by heating the reaction system to 250° C. at a pressure of 0.13 to 1.3 Pa in the system, to give a copolymerized polyester resin (A1). The composition, the number-average molecular weight, and the ionic group content of the resulting copolymerized polyester resin (A1) as determined by NMR etc. are shown in Table 5-1. In the case of sodium sulfonate, the ionic group content was determined by analyzing its sulfur element by fluorescence X rays and calculating the content in terms of sulfur content.

Production Examples 2 to 6

Polyester resins (A2) to (A6) were obtained by the same polymerization as in Production Example 1 except that the type of polycarboxylic acid and polyvalent alcohol and the compounding ratio were changed such that the composition, number-average molecular weight and ionic group content of the resulting polyester resins became those shown in Table 5-1.

TABLE 5-1

| | | Production Example 1 | Production Example 2 | Production Example 3 | Production Example 4 | Production Example 5 | Production Example 6 |
|---|---|---|---|---|---|---|---|
| Copolymerized polyester | | (A1) | (A2) | (A3) | (A4) | (A5) | (A6) |
| Polyvalent carboxylic acid (mol-%) | TPA | 48 | — | 30 | 45 | 51 | 47 |
| | IPA | 49 | — | 50 | 45 | 49 | 48 |
| | SA | — | — | 15 | — | — | — |
| | CHDM | — | 95 | — | — | — | — |
| | SIP | 3 | 5 | 5 | 10 | — | — |
| | F | — | — | — | — | 4 | 5 |

TABLE 5-1-continued

| | | Production Example 1 | Production Example 2 | Production Example 3 | Production Example 4 | Production Example 5 | Production Example 6 |
|---|---|---|---|---|---|---|---|
| Polyvalent alcohol (mol-%) | EG | 70 | 20 | 50 | — | 49 | 21 |
| | NPG | — | — | 50 | — | 51 | — |
| | TCD | 30 | 80 | — | — | — | — |
| | CHDM | — | — | — | 30 | — | — |
| | PG | — | — | — | 70 | — | — |
| | MPD | — | — | — | — | — | 79 |
| Number-average molecular weight (Mn) | | 5000 | 7000 | 12000 | 4000 | | |
| Glass transition point (° C.) | | 72 | 39 | 42 | 68 | 65 | 30 |
| Ionic group content (eq/ton) | | 110 | 130 | 200 | 350 | | |

Abbreviations in Table 5-1 are as follows:
TPA: terephthalic acid
IPA: terephthalic acid
SA: sebacic acid
CHDA: cyclohexane dicarboxylic acid
SIP: sodium 5-sulfoisophthalate
F: fumaric acid
EG: ethylene glycol
NPG: neopentyl glycol
TCD: tricyclodecane dimethanol
CHDM: cyclohexane dimethanol
PG: propylene glycol
MPD: 3-methyl-1,5-pentanediol

Example 5

(Production of an Aqueous Dispersion)

After 100 parts by weight of the copolymerized polyester resin (A1) obtained above, 66 parts by weight of methyl ethyl ketone and 33 parts by weight of tetrahydrofuran were dissolved at 70° C., 200 parts of water at 68° C. was added thereto to give an aqueous microscopic dispersion of the copolymerized polyester resin having a particle diameter of about 0.1 μm. The resulting aqueous microscopic dispersion was introduced into a distillation flask and distilled until the distillate temperature reached 100° C., and after cooling, water was added thereto, whereby a solvent-free aqueous dispersion of the copolymerized polyester with a solids content of 30% was obtained. From the copolymerized polyester resins (A2) to (A4), aqueous dispersions were prepared in the same manner as described above. The particle diameter of each aqueous dispersion is shown in Table 5-2.

TABLE 5-2

| | Copolymerized polyester | | | |
|---|---|---|---|---|
| | (A1) | (A2) | (A3) | (A4) |
| Average particle diameter (μm) | 0.1 | 0.08 | 0.05 | 0.04 |

(Production of Resin Particles)

A four-necked 3-L separable flask equipped with a thermometer, a condenser and a stirring blade was charged with 1000 parts by weight of the aqueous copolymerized polyester dispersion (A1) and 8.0 parts by weight of dimethylaminoethyl methacrylate, and the mixture was heated from room temperature to 80° C. over 30 minutes under stirring and maintained at 80° C. for 5 hours. Meanwhile, the pH in the system was decreased from pH 10.5 to 6.2, and the electrical conductivity was increased from 1.8 mS to 9.0 mS. This suggests that the dimethylaminoethyl methacrylate is hydrolyzed into dimethyl amino ethanol and methacrylic acid, and amine is neutralized with a carboxyl group in the generated methacrylic acid to form a salt thereby increasing the ionic strength. In this stage, fine particles of about 0.1 μm present in the aqueous copolymerized polyester dispersion were confirmed to be gently aggregated to form grown aggregated particles by observation under an optical microscope.

The separable flask was cooled to room temperature on iced water, and when the particle diameter distribution of the grown polyester resin particles was measured, those particles having a particle diameter in the range of 0.5 D to 2 D (D=diameter) where the average particle diameter was 3.5 μm occupied 92 wt-%.

The resulting polyester resin particles were washed with water on a filter paper and then dispersed again in water to give an aqueous polyester resin particle dispersion (B1) with a solids content of 20% by weight.

From the copolymerized polyester resins (A2) to (A4), aqueous dispersions of polyester resin particles (B2) to (B4) were prepared in the same manner as described above. The average particle diameter is shown in Table 5-3.

TABLE 5-3

| | Copolymerized polyester particles | | | |
|---|---|---|---|---|
| | (B1) | (B2) | (B3) | (B4) |
| | Copolymerized polyester | | | |
| | (A1) | (A2) | (A3) | (A4) |
| Average particle diameter (μm) | 3.5 | 8.5 | 2.9 | 5.1 |

(Manufacture of a Coating Compounded with Abrasive Grains)

A three-necked 3-L separable flask equipped with a stirring blade was charged with 750 parts by weight of the resulting aqueous dispersion of the polyester resin (A1), and 844 parts by weight of abrasive grains, colloidal silica (Snowtex ST-ZL, manufactured by Nisssan Chemical Industries, Ltd.) were added gently under stirring. The resulting mixed solution became a homogeneous dispersion without aggregation. This dispersion was applied by an applicator having a gap of 100 μm onto a polyester film (Cosmoshine A4100, manufactured by Toyo Boseki Co., Ltd.) and then dried at 120° C. for 30 minutes to give a polishing film (F1). In the resulting polishing film, a polyester resin coating layer of about 30 μm in thickness containing 60% by weight of silica abrasive grains had been formed. When a section of the resulting coating layer was observed under a scanning electron microscope, the abrasive grains were dispersed very beautifully without aggregation in the polyester resin.

Using the resins (A2) to (A4), polishing films (F2) to (F4) were obtained in the same manner. In any films, the abrasive grains could be dispersed well to form a beautiful polishing layer.

(Manufacture of Aggregated Abrasive Grain Particles)

A four-necked 3-L separable flask equipped with a thermometer, a condenser and a stirring blade was charged with 1000 parts by weight of 20 weight-% of the resulting aqueous polyester resin particle dispersion (B1), and after the pH was confirmed to be 6.8, an aqueous dispersion of colloidal silica (Snowtex ST-XL, manufactured by Nisssan Chemical Industries, Ltd.) was added gently thereto in a polyester/silica ratio of 30/70 (ratio by weight).

Just after the addition, the pH was 6.5. While the temperature was kept at room temperature, 0.1 N hydrochloric acid was added dropwise until the pH was reduced to 1.8, and thereafter, the temperature was increased to 80° C. over 30 minutes and kept at 80° C. for 15 minutes, and the reaction solution was cooled to room temperature on iced water.

The resulting dispersion was washed repeatedly on a filter paper with water until the pH of the wash was increased to 6 or more, to give polyester resin/silica composite particles (C1). When the resulting composite particles (C1) were observed under a scanning electron microscope, it was confirmed that the fine silica particles were stuck on the surfaces of the polyester resin particles.

Using the polyester particles (B2) to (B4), composite particles (C1) to (C4) were prepared in an analogous manner. A vessel coated with a releasing agent was packed densely with the resulting composite particles (C1) to (C4) and then heated to a temperature higher than the Tg of the respective resins for about 1 hour to form disks (P1) to (P4) having a thickness of 10 mm and a diameter of 60 cm.

Example 6-1

(Preparation of a Mixture Compounded with Abrasive Grains)

A three-necked 3-L separable flask equipped with a stirring blade was charged with 750 parts by weight of the resulting aqueous dispersion of the polyester resin (A1), and 844 parts by weight of abrasive grains, colloidal silica (Snowtex ST-ZL, manufactured by Nisssan Chemical Industries, Ltd.) were added gently thereto under stirring. The resulting mixture became a homogeneous dispersion without aggregation. Eight parts by weight of hollow fine particles (Expancell Cell 551DE, manufactured by Nippon Ferrite) serving as voids were added slowly to this dispersion, to prepare a mixture compounded with the abrasive grains.

(Preparation of a Polishing Pad)

The mixture compounded with abrasive grains was applied by an applicator having a gap of 100 μm onto a polyester film (Cosmoshine A4100, Toyo Boseki Co., Ltd.) and then dried at 120° C. for 30 minutes to give a polishing layer: polishing film (F1). In the resulting polishing film, a polyester resin coating layer (polishing layer) with voids (volume 30%) of about 30 μm in diameter, containing 60% by weight of silica abrasive grains, had been formed in a thickness of about 40 μm. When a section of the resulting polishing layer was observed under a scanning electron microscope, the abrasive grains were dispersed very beautifully without aggregation in the polyester resin.

Examples 6-2 to 6-4

Mixtures compounded with abrasive grains were prepared in the same manner as in Example 5 except that the aqueous dispersions of copolymerized polyester resins (A2) to (A4) were used in place of the aqueous dispersion of copolymerized polyester resin (A1), and the mixtures compounded with abrasive grains were used to prepare polishing pads: polishing films (F2) to (F4). In the resulting polishing films (F2) to (F4), the abrasive grains could be dispersed well to form beautiful polishing layers respectively.

Example 6-5

(Preparation of a Mixture Compounded with Abrasive Grains)

A three-necked 3-L separable flask equipped with a stirring blade was charged with 750 parts by weight of the resulting aqueous dispersion of the polyester resin (A1), and then 844 parts by weight of abrasive grains, colloidal silica (Snowtex ST-ZL, manufactured by Nisssan Chemical Industries, Ltd.) were added gently thereto under stirring. The resulting mixture became a homogeneous dispersion without aggregation. Further, this dispersion was sheared at high speed to mix it with bubbles to prepare a mixture compounded with abrasive grains.

(Preparation of a Polishing Pad)

The mixture compounded with abrasive grains was applied by an applicator having a gap of 100 μm onto a polyester film (Cosmoshine A4100, Toyo Boseki Co., Ltd.) and then dried at 120° C. for 30 minutes to give a polishing layer: polishing film (F5). In the resulting polishing film, a polyester resin coating layer (polishing layer) with voids (volume 30%) of about 10 to 30 μm in diameter, containing 60% by weight of silica abrasive grains, had been formed in a thickness of about 40 μm. When a section of the resulting polishing layer was observed under a scanning electron microscope, the abrasive grains were dispersed very beautifully without aggregation in the polyester resin.

Example 7

(Production of an Aqueous Dispersion)

100 parts by weight of the copolymerized polyester resin (A1), 66 parts by weight of methyl ethyl ketone and 33 parts by weight of tetrahydrofuran were dissolved at 70° C. and then added to 200 parts of water at 68° C., to give an aqueous microscopic dispersion of the copolymerized polyester resin having a particle diameter of about 0.1 μm. The resulting microscopic dispersion was introduced into a distillation flask and distilled until the distillate temperature reached 100° C., and after cooling, water was added thereto, whereby a solvent-free aqueous dispersion of the copolymerized polyester with a solids content of 30% was obtained.

With respect to the polyester resins (A5) and (A6), a reaction vessel equipped with a stirrer, a thermometer, a reflux device and a quantitatively dropping device was charged with 60 parts by weight of the polyester resin (A5), 70 parts by weight of methyl ethyl ketone, 20 parts by weight of isopropyl alcohol, 6.4 parts by weight of maleic anhydride and 5.6 parts by weight of diethyl fumarate, and the resin was dissolved under stirring in a refluxed state. After the resin was completely dissolved, a mixture of 8 parts by weight of styrene and 1 part by weight of octyl mercaptan and a solution prepared by dissolving 1.2 parts by weight of azobisisobutyronitrile in a mixed solvent of 25 parts by weight of methyl ethyl ketone and 5 parts by weight of isopropyl alcohol were dropped respectively into the polyester solution over 1.5 hours and allowed to react for 3 hours to give a solution of graft product (B2). 20 parts of ethanol were added to the graft product solution, followed by reaction with maleic anhydride in a side chain of the graft product in a refluxed state for 30 minutes and then cooling the reaction solution to room temperature. Then, the reaction solution was neutralized by adding 10 parts by weight of triethylamine, and 160 parts of ion-exchanged water were added thereto, and the solution was stirred for 30 minutes. Thereafter, the solvent remaining in the medium was distilled away by heating, to give a final aqueous dispersion (C2). The aqueous dispersion thus formed was milk-white with an average particle diameter of 80 nm and a B type viscosity of 50 cps at 25° C. The graft efficiency of this graft product was 60%. The molecular weight of the side chain of the resulting graft product was 8000.

The resin (A6) was grafted in an analogous manner by using the compositions in Tables 5-4 and 5-5, to produce aqueous dispersions (C2) and (C3). The results of composition analysis by NMR etc. are shown in the table. The respective components in the table are expressed in mol-%. The average particle diameter of each aqueous dispersion is shown in Table 5-6.

TABLE 5-4

| | | Graft product | |
|---|---|---|---|
| | | B2 | B3 |
| Base resin | A5 | 75 | 0 |
| | A6 | 0 | 75 |
| Monomer | St | 10 | 7 |
| | BZA | 0 | 3 |
| | DEF | 7 | 7 |
| | MAnh | 8 | 8 |
| | AIBN | 1.5 | 1.5 |

Abbreviations in Table 5-4 are as follows:
St: styrene
BZA: benzyl acrylate
DEF: diethyl fumarate
MAnh: maleic anhydride, and
AIBN: azobisisobutyronitrile.

TABLE 5-5

| | Aqueous dispersion | |
|---|---|---|
| | C2 | C3 |
| Graft product B2 | 100 | 0 |
| Graft product B3 | 0 | 100 |

TABLE 5-5-continued

| | Aqueous dispersion | |
|---|---|---|
| | C2 | C3 |
| TEA | 5 | 5 |
| Ion-exchanged water | 80 | 80 |

In Table 5-5, TEA refers to triethylamine.

TABLE 5-6

| | Aqueous dispersion | | |
|---|---|---|---|
| | (C1) | (C2) | (C3) |
| | Base polyester resin | | |
| | (A1) | (B2) | (B3) |
| Average particle diameter (μm) | 0.1 | 0.08 | 0.05 |

Example 7-1

A three-necked 3-L separable flask equipped with a stirring blade was charged with 350 parts by weight of the resulting aqueous polyester resin dispersion (C1) and 350 parts by weight of the aqueous dispersion (C3), and then 844 parts by weight of abrasive grains, colloidal silica (Snowtex ST-ZL, Nisssan Chemical Industries, Ltd.), were added gently added thereto under stirring. The resulting mixture became a homogeneous dispersion without aggregation. Further, this dispersion was applied by an applicator having a gap of 100 μm onto a polyester film (Cosmoshine A4100, Toyo Boseki Co., Ltd.) and then dried at 120° C. for 30 minutes to give a polishing film (F1). In the resulting polishing film, a polyester coating layer containing 60% by weight of silica abrasive grains was formed in a thickness of about 30 μm. When a section of the resulting coating layer was observed under a scanning electron microscope, the abrasive grains were dispersed very beautifully without aggregation in the polyester resin.

Example 7-2

The aqueous dispersions (C2) and (C3) were mixed to produce a polishing film (F2) in the same manner as in Example 7-1. This coating could be dispersed well to form a beautiful coating film.

Example 8

(Production Example of Polyester Resin)

A stainless steel autoclave equipped with a stirrer, a thermometer and a partially refluxing condenser was charged with 466 parts of dimethyl terephthalate, 466 parts of dimethyl isophthalate, 401 parts of neopentyl glycol, 443 parts of ethylene glycol and 0.52 part of tetra-n-butyl titanate, and the mixture was subjected to ester exchange reaction at 160 to 220° C. over 4 hours. Then, 23 parts of fumaric acid were added thereto, and the mixture was heated to 200 to 220° C. over 1 hour and subjected to esterification reaction. Then, the mixture was heated to 255° C., and after the pressure in the reaction system was gradually reduced, the mixture was reacted for 1.5 hours under reduced pressure at 0.26 Pa, to give a polyester (A1). The resulting polyester (A1) was pale yellow and transparent. The composition thereof measured by NMR etc. was as follows.

Dicarboxylic acid components: 47 mol-% terephthalic acid, 48 mol-% isophthalic acid, 5 mol-% fumaric acid.

Diol components: 50 mol-% neopentyl glycol, 50 mol-% ethylene glycol.

Various polyesters (A2, A5, A6) shown in Table 5-7 were produced in an analogous manner. The molecular weights of the polyesters and the result of composition analysis of the polyesters by NMR etc. are shown in Table 5-7. The respective components in the table are expressed in mol-%.

TABLE 5-7

| | | Copolymerized polyester | | | |
|---|---|---|---|---|---|
| | | (A1) | (A2) | (A5) | (A6) |
| Polyvalent carboxylic acid (mol-%) | TPA | 47 | 50 | 47 | 50 |
| | IPA | 64 | 49 | 48 | 50 |
| | SA | 0 | 0 | 0 | 0 |
| | F | 7 | 1 | 5 | 0 |
| Polyvalent alcohol (mol-%) | EG | 50 | 50 | 50 | 50 |
| | NPG | 50 | 50 | 50 | 50 |
| | MPD | 0 | 0 | 0 | 0 |

The abbreviations in Table 5-7 are as follows:
TPA: terephthalic acid
IPA: isophthalic acid
SA: sebacic acid
F: fumaric acid
EG: ethylene glycol
NPG: neopentyl glycol and
MPD: 3-methyl-1,5-pentane diol.

(Production Example of Polyester Polyurethane Resin)

A stainless steel autoclave equipped with a stirrer, a thermometer and a partially refluxing condenser was charged with 466 parts of dimethyl terephthalate, 466 parts of dimethyl isophthalate, 401 parts of neopentyl glycol, 443 parts of ethylene glycol and 0.52 part of tetra-n-butyl titanate, and the mixture was subjected to ester exchange reaction at 160 to 220° C. over 4 hours. Then, 23 parts of fumaric acid were added thereto, and the mixture was heated to 200 to 220° C. over 1 hour and subjected to esterification reaction. Then, the mixture was heated to 255° C., and after the pressure in the reaction system was gradually reduced, the mixture was reacted for 1 hour under reduced pressure at 0.39 Pa, to give a polyester (A5). The resulting polyester (A5) was pale yellow and transparent. The composition thereof measured by NMR etc. was as follows.

Dicarboxylic acid components: 47 mol-% terephthalic acid, 48 mol-% isophthalic acid, 5 mol-% fumaric acid.

Diol components: 50 mol-% neopentyl glycol, 50 mol-% ethylene glycol.

100 parts of this polyester polyol, together with 100 parts of methyl ethyl ketone, were introduced into a reactor equipped with a stirrer, a thermometer and a partially refluxing condenser, and after the mixture was dissolved, 3 parts of neopentyl glycol, 15 parts of diphenyl methane diisocyanate and 0.02 part of dibutyltin laurate were introduced into the mixture and reacted at 60 to 70° C. for 6 hours. Then, 1 part of dibutyl amine was added thereto, and the reaction was terminated by cooling the reaction system to room temperature. The reduced viscosity of the resulting polyurethane resin (A3) was 0.52.

A polyester polyurethane (A4) was produced in an analogous manner. The molecular weights of the respective polyesters and the result of composition analysis thereof by NMR etc. are shown in Table 5-7, and the molecular weights of the respective polyester polyurethanes and the result of composition analysis thereof by NMR etc. are shown in Table 5-8.

TABLE 5-8

| | Polyester polyurethane | |
|---|---|---|
| | A3 | A4 |
| Polyester polyol (A5) | 100 | 0 |
| Polyester polyol (A6) | 0 | 100 |
| GMAE | 0 | 3 |
| NPG | 3 | 0 |
| MDI | 20 | 0 |
| IPDI | 0 | 20 |
| Reduced viscosity | 0.52 | 0.55 |

Abbreviations in Table 5-8 are as follows:
GMAE: glycerine monoallyl ether
NPG: neopentyl glycol
MDI: dimethyl methane diisocyanate and
IPDI: isophorone diisocyanate.

(Production of an Aqueous Dispersion)

A reactor equipped with a stirrer, a thermometer, a reflux device and a quantitatively dropping device was charged with 60 parts by weight of the polyester resin (A1), 70 parts by weight of methyl ethyl ketone, 20 parts by weight of isopropyl alcohol, 6.4 parts by weight of maleic anhydride and 5.6 parts by weight of diethyl fumarate, and the resin was dissolved under stirring in a refluxed state. After the resin was completely dissolved, a mixture of 8 parts by weight of styrene and 1 part by weight of octyl mercaptan and a solution prepared by dissolving 1.2 parts by weight of azobisisobutyronitrile in a mixed solvent of 25 parts by weight of methyl ethyl ketone and 5 parts by weight of isopropyl alcohol were dropped respectively into the polyester solution over 1.5 hours and allowed to react for 3 hours to give a solution of graft product (B1). 20 parts of ethanol were added to this graft product solution, followed by reaction with maleic anhydride in a side chain of the graft product in a refluxed state for 30 minutes and then cooling the reaction solution to room temperature. Then, the reaction solution was neutralized by adding 10 parts by weight of triethylamine, and 160 parts of ion-exchanged water were added thereto, and the solution was stirred for 30 minutes. Thereafter, the solvent remaining in the medium was distilled away by heating, to give a final aqueous dispersion (C1). The aqueous dispersion thus formed was milk-white with an average particle diameter of 80 nm and a B type viscosity of 50 cps at 25° C. The graft efficiency of this graft product was 60%. The molecular weight of the side chain of the resulting graft product was 8000.

The resins (A2 to A4) were grafted in an analogous manner by using the compositions in Table 5-9, to produce various aqueous dispersions (C2 to C4) (Table 5-10). The result of composition analysis by NMR etc. is shown in the table. The respective components in the table are expressed in mol-%.

TABLE 5-9

| Graft product | | B1 | B2 | B3 | B2 |
|---|---|---|---|---|---|
| Base resin | A1 | 75 | 0 | 0 | 0 |
| | A2 | 0 | 75 | 0 | 0 |
| | A3 | 0 | 0 | 75 | 0 |
| | A4 | 0 | 0 | 0 | 75 |

TABLE 5-9-continued

| Graft product | | B1 | B2 | B3 | B2 |
|---|---|---|---|---|---|
| Monomer | St | 10 | 8 | 7 | 15 |
| | EA | 0 | 7 | 0 | 0 |
| | MMA | 0 | 0 | 0 | 3 |
| | BZA | 0 | 0 | 3 | 0 |
| | DEF | 7 | 0 | 7 | 0 |
| | MAnh | 8 | 10 | 8 | 7 |
| | AIBN | 1.5 | 1.5 | 1.5 | 1.5 |

Abbreviations in Table 5-9 are as follows:
St: styrene
EA: acrylic acid
MMA: methacrylic acid
BZA: benzyl acrylate
DEF: diethyl fumarate
MAnh: maleic anhydride, and
AIBN: azobisisobutyronitrile.

TABLE 5-10

| | Aqueous dispersion | | | |
|---|---|---|---|---|
| | C1 | C2 | C3 | C4 |
| Graft product B1 | 100 | 0 | 0 | 0 |
| Graft product B2 | 0 | 100 | 0 | 0 |
| Graft product B3 | 0 | 0 | 100 | 0 |
| Graft product B4 | 0 | 0 | 0 | 100 |
| TEA | 5 | 5 | 5 | 5 |
| Ion-exchanged water | 80 | 80 | 80 | 80 |

In Table 5-10, TEA refers to triethylamine.

(Production of Coating Compounded with Abrasive Grains)

A three-necked 3-L separable flask equipped with a stirring blade was charged with 23 parts by weight of the resulting aqueous dispersion of aqueous dispersion (C1) with 30 weight-% solids content, 8.5 parts by weight of purified water and 1.2 parts by weight of a melamine crosslinking agent (Cymel 325), and the mixture was stirred. Then, 67 parts by weight of cerium oxide (nanoscale ceria, Siber Hegner) having an average particle diameter of 0.3 μm were added as abrasive grains and added gently thereto under stirring. The resulting mixture became a homogeneous dispersion without aggregation. Further, this dispersion was applied by an applicator having a gap of 100 μm onto a polyester film (Cosmoshine A4100, Toyo Boseki Co., Ltd.) and then dried at 120° C. for 30 minutes to give a polishing film (F1). In the resulting polishing film, a polyester coating layer containing 89% by weight of abrasive grains of cerium oxide had been formed in a thickness of about 75 μm. When a section of the resulting coating layer was observed under a scanning electron microscope, the abrasive grains were dispersed very beautifully without aggregation in the polyester resin.

The aqueous dispersions (C2) to (C4) were used to prepare polishing films (F2) to (F4) in the same manner. In any films, the abrasive grains could be dispersed well to form a beautiful coating.

Comparative Example 5-1

600 parts by weight of a thermoplastic polyester resin (Vylon RV200, ionic group 0 eq/ton, manufactured by Toyo Boseki Co., Ltd.) and 400 parts by weight of silica powder having a diameter of 0.5 μm were attempted to be melted and mixed at a temperature higher than the Tg (68° C.) of the resin, but the viscosity was too high and to mix of them was impossible.

Comparative Example 5-2

800 parts by weight of a thermoplastic polyester resin (Vylon RV200, ionic group 0 eq/ton, manufactured by Toyo Boseki Co., Ltd.) and 200 parts by weight of silica powder having a diameter of 0.5 μm were melted and mixed at a temperature higher than the Tg (68° C.) of the resin. The mixed solution was poured into a vessel coated with a releasing agent, to give a disk-shaped polishing layer (polishing pad) of 10 mm in thickness and 60 cm in diameter. When a section of the resulting polishing pad was observed under a scanning electron microscope, it was observed that the silica grains were aggregated to a mass of few microns.

Comparative Example 5-3

3000 parts by weight of a polyether urethane prepolymer (Adiprene L-325, ionic group 0 eq/ton, Uniroyal), 19 parts by weight of a surfactant (SH192, a dimethyl polysiloxane/polyoxyalkyl copolymer, Toray Dow Corning Silicone Co., Ltd.) and 5000 parts by weight of cerium oxide (nanoscale ceria, Siebelhegner) were introduced into a vessel, and the stirrer was exchanged with another stirrer, and 770 parts by weight of a curing agent (4,4'-methylene-bis[2-chloroaniline]) were introduced into it under stirring, and the mixture was attempted to be stirred at about 400 rpm with the stirrer, but its rapid thickening made stirring of the mixture impossible.

Comparative Example 5-4

3000 parts by weight of a polyether urethane prepolymer (Adiprene L-325, ionic group 0 eq/ton, Uniroyal), 19 parts by weight of a surfactant (SH192, a dimethyl polysiloxane/polyoxyalkyl copolymer, Toray Dow Corning Silicone Co., Ltd.) and 600 parts by weight of cerium oxide (nanoscale ceria, Siebelhegner) were introduced into a vessel and mixed at about 400 rpm with a sitter to produce a mixed solution, and thereafter, the stirrer was exchanged with another stirrer, and 770 parts by weight of a curing agent (4,4'-methylene-bis[2-chloroaniline]) were introduced into it under stirring. The mixture was stirred for about 1 minute, and the mixed solution was introduced into a pan-type open mold and post-cured for 6 hours in an oven at 110° C., to produce a foamed polyurethane block. The resulting foamed polyurethane had an Asker D hardness of 65, a compressibility of 0.5%, a specific gravity of 0.95 and an average void diameter of 35 μm. When a section of the resulting polishing pad was observed under a scanning electron microscope, it was observed that the Ceria grains were aggregated to a mass of few microns.

The polishing pads: polishing films obtained in the Examples and Comparative Examples above were evaluated as follows, and the results are shown in Table 5-11.

(Evaluation of Polishing Characteristics)

As the polishing machine, SPP600S (Okamoto Kosaku Kikai) was used in evaluation of polishing characteristics.

The polishing rate was calculated from the time in which a 1 μm thermally oxidized coating on a 6 inch silicon wafer was polished by about 0.5 μm. The thickness of the oxidized coating was measured by an interference film thickness measuring device (manufactured by Otsuka Denshi). For polishing, a solution (pH 11) of KOH in ultra-pure water was added as a chemical solution at a flow rate of 150 mg/min. during polishing. The polishing loading was 350 g/cm$^2$, the number of revolutions of the polishing platen was 35 rpm, the number of revolutions of the wafer was 30 rpm. The polishing rate of the thermally oxidized silicon coating polished under these conditions is shown in Table 5-11. As shown in Table 5-11, both the polishing films and the polishing pads in the Examples achieved a polishing rate of at least 1000 Å/min. The polishing rate is preferably at least 1200 Å/min.

(Planarization Characteristics)

0.5 μm thermally oxidized coating was deposited on a 6-inch silicon wafer and subjected to predetermined patterning, and 1 μm oxidized coating of p-TEOS was deposited thereon, to prepare a wafer having a pattern with an initial difference in step height of 0.5 μm. This wafer was polished under the above-described conditions, and after polishing, each difference in step height was measured to evaluate planarization characteristics. For planarization characteristics, two differences in step height were measured. One difference is a local difference in step height, which is a difference in step height in a pattern having lines of 500 μm in width and spaces of 50 μm arranged alternately, and the other difference is an abrasion loss in the concaves of spaces in line-and-space arranged at 100 μm intervals. The results are shown in Table 5-11.

(Evaluation of Scratch)

The number of scratches of 0.2 μm or more on the surface of the oxidized coating on the 6-inch silicon wafer after polishing was evaluated by a wafer surface Analyzer WM2500 manufactured by Topcon. The results are shown in Table 5-11.

TABLE 5-11

| | | Polishing rate (Å/min) | Planarization: Local difference in step height (Å) | Planarization: Abrasion loss in concave (Å) | Scratch (number of scratches of 0.2 μm or more) | Remark |
|---|---|---|---|---|---|---|
| Example 5-1 | (F1) | 1100 | 80 | 500 | 15 | |
| | (F2) | 1150 | 70 | 800 | 18 | |
| | (F3) | 1200 | 60 | 700 | 20 | |
| | (F4) | 1300 | 60 | 400 | 21 | |
| | (P1) | 1300 | 50 | 400 | 23 | |
| | (P2) | 1350 | 40 | 500 | 25 | |
| | (P3) | 1400 | 40 | 450 | 25 | |
| | (P4) | 1500 | 50 | 300 | 23 | |
| Example 6-1 | (F1) | 1200 | 83 | 480 | 16 | |
| Example 6-2 | (F2) | 1250 | 65 | 790 | 20 | |
| Example 6-3 | (F3) | 1300 | 65 | 710 | 21 | |
| Example 6-4 | (F4) | 1350 | 63 | 390 | 19 | |
| Example 6-5 | (F5) | 1400 | 52 | 380 | 20 | |
| Example 7-1 | (F1) | 1800 | 70 | 400 | 14 | |
| Example 7-2 | (F2) | 1900 | 60 | 600 | 17 | |
| Example 8 | (F1) | 1100 | 80 | 500 | | |
| | (F2) | 1150 | 70 | 800 | | |
| | (F3) | 1200 | 60 | 700 | | |
| | (F4) | 1300 | 60 | 400 | | |
| Comparative Example 5-1 | | — | — | — | — | not moldable |
| Comparative Example 5-2 | | 300 | 50 | 300 | 125 | |
| Comparative Example 5-3 | | — | — | — | — | not moldable |
| Comparative Example 5-4 | | 400 | 40 | 400 | 95 | |

It is recognized that the polishing layers (polishing films) of this invention achieve a high polishing rate and are excellent in planarization and uniformity with few scratches.

Example 9-1

30 parts by weight of an aqueous dispersion of polyester resin TAD1000 (glass transition temperature of 65° C., ionic group 816 eq/ton, solids content 30% by weight, manufactured by Toyo Boseki Co., Ltd.), 40 parts by weight of an aqueous dispersion of polyester resin TAD3000 (glass transition temperature of 30° C., ionic group 815 eq/ton, solids content 30% by weight, manufactured by Toyo Boseki Co., Ltd.), 3 parts by weight of a crosslinking agent Cymel 325 (Mitsui SciTech) and 0.7 part by weight of a defoaming agent Surfinol DF75 (Nisshin Chemical Kogyo) were mixed under stirring, and 100 parts by weight of cerium oxide powder (average particle diameter of 0.2 μm, manufactured by Bicowhiskey) were added successively and the mixture was stirred so as to be homogeneous. The resulting coating solution in a paste form was applied by a table-type die coater onto a polycarbonate plate of 0.4 mm in thickness (Mitsubishi Engineering Plastics) to form a coating of about 400 μm in thickness. The resulting resin plate was dried for about 20 minutes in a hot-air oven at 110° C., then cooled and removed. The resulting coating had a thickness of about 350 μm on the polycarbonate plate, and by observing its section under a scanning electron microscope, it was confirmed that the fine particles of cerium oxide were dispersed uniformly without aggregation. When the resulting coating was subjected to crosscut tape release, the number of remaining regions was 100, indicating no release.

Then, this coating substrate was stuck on a polyethylene foam of 1 mm in thickness (Asker C hardness 52, manufactured by Toray Industries, Inc.) via a double-tacked tape #5782 (Sekisui Chemical Co., Ltd.) under a loading of 1 kg/m$^2$, and the other side of the polyethylene foam was stuck on a double-tacked tape under a loading of 1 kg/m$^2$, to form a polishing pad. The adhesion strength between the coated substrate and the polyethylene foam was examined in a 180° peeling test with a tensile tester, indicating an adhesion of at least 1000 g/cm.

The polishing characteristics of the resulting polishing pad are shown in Table 5-12. It was confirmed that the resulting polishing pad has a high polishing rate, is very superior in planarization characteristics, and is excellent in uniformity.

Example 9-2

A polishing pad was prepared in the same manner as in Example 9-1 except that TAD2000 (glass transition temperature 20° C., ionic group 1020 eq/ton, solids content 30% by weight, manufactured by Toyo Boseki Co., Ltd.) was used in place of the aqueous dispersion of polyester resin TAD3000, and ABS resin was used in place of the polycarbonate as the substrate coated. The result is shown in Table 5-12, and it was confirmed that the resulting polishing pad has a high polishing rate, is very superior in planarization characteristics, and is excellent in uniformity.

Example 9-3

A polishing pad was prepared in the same manner as in Example 9-1 except that MD1200 (glass transition temperature 67° C., ionic group 300 eq/ton, solids content 34% by weight, manufactured by Toyo Boseki Co., Ltd.) was used in place of the aqueous dispersion of polyester resin TAD1000, acryl resin was used in place of the polycarbonate as the substrate coated, and the drying temperature and drying time were changed to 80° C. and 40 minutes, respectively. The result is shown in Table 5-12, and it was confirmed that the resulting polishing pad has a high polishing rate, is very superior in planarization characteristics, and is excellent in uniformity.

Example 9-4

A polishing pad was prepared in the same manner as in Example 9-1 except that after the polycarbonate substrate was coated, the coating surface was coated again to a thickness of about 400 μm. The thickness of the obtained coating was about 700 μm, and the number of remaining regions in a crosscut tape test was 100, indicating no change in the coating. It was confirmed that the resulting polishing pad when used in polishing has a high polishing rate, is very superior in planarization characteristics, and is excellent in uniformity.

Example 9-5

A polishing pad was prepared in the same manner as in Example 9-1 except that a polyurethane foam (Asker C hardness, 55) was used in place of the polyethylene foam as the cushion layer attached to the resin substrate. It was confirmed that the resulting polishing pad when used in polishing has a high polishing rate, is very superior in planarization characteristics, and is excellent in uniformity.

Reference Example 1-1

When a polishing pad was prepared in the same manner as in Example 9-1 except that the aqueous dispersion of polyester resin TAD3000 was not used, the surface of the polishing layer had significant cracking after drying. When this polishing pad was used in polishing, a part of the coating was removed, and a large number of scratches were observed on a wafer polished.

Reference Example 1-2

When a polishing pad was prepared in the same manner as in Example 9-1 except that the aqueous dispersion of polyester resin TAD1000 was not used, a good coating was obtained but the surface was slightly sticky. When this polishing pad was used in polishing, a wafer was stuck on the surface of the polishing pad, to cause significant vibration during polishing, resulting in removal of the wafer from the wafer holder.

Reference Example 1-3

A polishing pad was prepared in the same manner as in Example 9-1 except that the resin substrate was stuck on the polyethylene foam by applying no or less loading. The adhesion between the resin substrate and the polyethylene foam in the prepared polishing pad, as determined in a 180° peeling test, indicated that the adhesion was as low as 400 g/cm. When this polishing pad was examined in a polishing test, the resin substrate coated with fine abrasive grains was released from the polyethylene foam layer after treatment of a few wafers, thus making polishing impossible.

Reference Example 1-4

A polishing pad was prepared in the same manner as in Example 9-1 except that the amount of the cerium oxide powder (average particle diameter 1.5 μm, manufactured by Bicowhiskey) was changed to 500 parts by weight. The resulting polishing layer was very poor in adhesion and coating strength, and when the substrate material was bent, the coating was removed, and the polyethylene foam layer could not be laminated.

Example 10-1

35 parts by weight of an aqueous dispersion of polyester resin TAD1000 (glass transition temperature of 65° C., ionic group 816 eq/ton, solids content 30% by weight, manufactured by Toyo Boseki Co., Ltd.), 45 parts by weight of an aqueous dispersion of polyester resin TAD300 (glass transition temperature of 30° C., ionic group 815 eq/ton, solids content 30% by weight, manufactured by Toyo Boseki Co., Ltd.), 3.5 parts by weight of a crosslinking agent Simel 325 (Mitsui SciTech) and 0.7 part by weight of a defoaming agent Surfinol DF75 (Nisshin Chemical Kogyo) were introduced into a flask equipped with a stirring blade and mixed under stirring, and 95 parts by weight of cerium oxide powder (average particle diameter of 0.2 μm, manufactured by Bicowhiskey) were added successively thereto, and the mixture was stirred so as to be homogeneous. The resulting coating solution in a paste form was applied by a table-type die coater onto a polycarbonate plate of 0.4 mm in thickness (Mitsubishi Engineering Plastics) to form a coating of about 400 μm in thickness. The resulting resin plate was dried for about 20 minutes in a hot-air oven at 110° C., then cooled and removed. The resulting coating had a thickness of about 350 μm on the polycarbonate plate, and it was confirmed by observing its section under a scanning electron microscope that the fine particles of cerium oxide were dispersed uniformly without aggregation. When the resulting coating was examined in a crosscut tape test, the number of remaining regions was 100, indicating no release.

Then, this coating substrate was stuck on a polyethylene foam of 1 mm in thickness (Asker C hardness 52, manufactured by Toray Industries, Inc.) via a double-tacked tape #5782 (Sekisui Chemical Co., Ltd.) under a loading of 1 kg/m$^2$, and the other side of the polyethylene foam was stuck on a double-tacked tape under a loading of 1 kg/m$^2$, to form a polishing pad. The adhesion strength between the coated substrate and the polyethylene foam was examined in a 180° peeling test with a tensile tester, indicating an adhesion of at least 1000 g/cm. The polishing pad was subjected to grinding with a rotating whetstone to form latticed grooves with a groove width of 1 mm, a groove pitch of 6.2 mm and a depth of 400 μm on the surface.

The polishing characteristics of the resulting polishing pad are shown in Table 5-12. It was confirmed that the resulting polishing pad has a high polishing rate, is very superior in planarization characteristics, and is excellent in uniformity.

Example 10-2

A polishing pad was prepared in the same manner as in Example 10-1 except that TAD2000 (glass transition temperature of 20° C., ionic group 1020 eq/ton, solids content 30% by weight, manufactured by Toyo Boseki Co., Ltd.) was used in place of the aqueous dispersion of polyester resin TAD3000, and ABS resin was used in place of the polycarbonate as the substrate coated. The resulting polishing pad was subjected to grinding with an ultrahigh hardness bite to form latticed grooves with a groove width of 2 mm, a groove pitch of 10 mm and a depth of 0.5 mm on the surface. The results are shown in Table 5-12, and it was confirmed that the resulting polishing pad has a high polishing rate, is very superior in planarization characteristics, and is excellent in uniformity.

Example 10-3

A polishing pad was prepared in the same manner as in Example 10-1 except that MD1200 (glass transition temperature of 67° C., ionic group 300 eq/ton, solids content 34% by weight, manufactured by Toyo Boseki Co., Ltd.) was used in place of the aqueous dispersion of polyester resin TAD1000, acryl resin was used in place of the polycarbonate as the substrate coated, drying was carried out at a temperature of 80° C. for 5 minutes, and the sample was pressed at a pressure of 5 kg/cm$^2$ against a polytetrafluoroethylene resin mold prepared so as to form a groove width of 1.5 mm, a groove pitch of 8 mm and a groove depth of 300 μm, and then dried at a temperature of 80° C. for 35 minutes. The results are shown in Table 1, and it was confirmed that the resulting polishing pad has a high polishing rate, is very superior in planarization characteristics, and is excellent in uniformity.

Example 10-4

A polishing pad was prepared in the same manner as in Example 10-1 except that after the polycarbonate substrate was coated, the coated surface of the substrate was coated again to a thickness of about 400 μm. The thickness of the obtained coating was about 700 μm, and the polishing pad was subjected to grinding with a rotating whetstone to form latticed grooves with a groove width of 1 mm, a groove pitch of 6.2 mm and a depth of 700 μm on the surface. When the resulting coating was examined in a crosscut tape test, the number of remaining regions was 100, indicating no change in the coating. It was confirmed that the resulting polishing pad when used in polishing has a high polishing rate, is very superior in planarization characteristics, and is excellent in uniformity.

Example 10-5

A polishing pad was prepared in the same manner as in Example 10-1 except that a polyurethane foam (Asker C hardness, 55) was used in place of the polyethylene foam as the cushion layer stuck on the resin substrate. The surface of this polishing pad was provided by a $CO_2$ gas laser with concentric circle-shaped grooves having a width of 0.3 mm, a depth of 0.3 mm and a pitch of 3 mm. It was confirmed that the resulting polishing pad when used in polishing has a high polishing rate, is very superior in planarization characteristics, and is excellent in uniformity.

Reference Example 2-1

A polishing pad was prepared in the same manner as in Example 10-1 except that the procedure of forming grooves was not conducted. The resulting polishing pad was used in polishing, a wafer could be excellently polished for first few minutes, but the vibration of the wafer became increasingly significant, and finally the wafer unable to be maintained was removed.

Reference Example 2-2

When a polishing pad was prepared in the same manner as in Example 10-1 except that the aqueous dispersion of polyester resin TAD3000 was not used and finally grooves were not formed, the surface of the polishing layer exhibited significant cracking after drying. When the polishing pad was used in polishing, a part of the coating was removed, and a large number of scratches were observed on the wafer polished.

Reference Example 2-3

When a polishing pad was prepared in the same manner as in Example 10-1 except that the aqueous dispersion of polyester resin TAD1000 was not used and finally grooves were not formed, a good coating was obtained but the surface was slightly sticky. When the polishing pad was used in polishing, a wafer was stuck on the surface of the polishing pad, to cause significant vibration during polishing, and the wafer was finally removed from the wafer holder.

Reference Example 2-4

A polishing pad was prepared in the same manner as in Example 10-1 except that the resin substrate was stuck, with no or less loading, on the polyethylene foam to prepare a polishing pad, and finally grooves were not formed. The adhesion between the resin substrate and the polyethylene foam in the prepared polishing pad, as determined in a 180° peeling test, indicated that the adhesion was as low as 400 g/cm. When this polishing pad was examined in a polishing test, the resin substrate coated with fine abrasive grains was released from the polyethylene foam layer after treatment of a few wafers, thus making polishing impossible.

Reference Example 2-5

A polishing pad was prepared in the same manner as in Example 10-1 except that the amount of the cerium oxide powder (average particle diameter 1.5 μm, manufactured by Bicowhiskey) was changed to 500 parts by weight, and finally grooves were not formed. The resulting polishing layer was very poor in adhesion and coating strength, and when the substrate material was bent, the coating was removed, and the polyethylene foam layer could not be laminated.

The polishing pads obtained in Examples 9 to 10, Reference Examples 1 to 2 and Comparative Examples 1 to 4 were evaluated as follows. The results are shown in Table 5-12.

(Evaluation of Polishing Characteristics)

As the polishing machine, SPP600S (Okamoto Kosaku Kikai) was used in evaluation of polishing characteristics. The thickness of an oxidized coating was measured by an interference film thickness measuring machine (manufactured by Otsuka Denshisha). For polishing, a solution (pH 11) of KOH in ultra-pure water was added as a chemical solution at a flow rate of 150 mg/min. during polishing for the Examples, while slurry SemiSperse-12 manufactured by Capot was dropped for the Reference Examples and Comparative Examples. The polishing loading was 350 g/cm$^2$, the number of revolutions of the polishing platen was 35 rpm, and the number of revolutions of the wafer was 30 rpm.

(Evaluation of Planarization Characteristics)

0.5 μm thermally oxidized coating was deposited on a 8-inch silicon wafer and subjected to predetermined patterning, and 1 μm oxidized coating of p-TEOS was deposited thereon, to prepare a wafer having a pattern with an initial difference in step height of 0.5 μm. This wafer was polished under the above-described conditions, and after polishing, each difference in step height was measured to evaluate planarization characteristics. For planarization characteristics, two differences in step height were measured. One difference is a local difference in step height, which is a difference in step height in a pattern having lines of 270 μm in width and spaces, 30 μm each, arranged alternately, and the other difference is an abrasion loss in the concaves of spaces in a pattern having lines of 30 μm in width and spaces of 270 μm arranged alternately. The average polishing rate was the average of those in the 270 μm lines and 30 μm lines.

(Evaluation of Scratch)

The number of scratches of 0.2 μm or more on the surface of the oxidized coating on the 6-inch silicon wafer after polishing was evaluated by a wafer surface measuring device WM2500 manufactured by Topcon.

TABLE 5-12

| | | | Planarization | | Scratch (number of scratches | |
|---|---|---|---|---|---|---|
| | | Polishing rate (Å/min) | Local difference in step height (Å) | Abrasion loss in concave (Å) | of 0.2 μm or more) | Remark |
| Example 9 | 1 | 14000 | 5 | 1470 | 13 | |
| | 2 | 12500 | 6 | 1500 | 10 | |
| | 3 | 14500 | 4 | 1400 | 20 | |
| | 4 | 14000 | 5 | 1475 | 12 | |
| | 5 | 14200 | 5 | 1465 | 14 | |
| Reference Example 1 | 1 | 9000 | 4 | 1300 | 153 | |
| | 2 | — | — | — | — | cannot be polished |
| | 3 | 14000 | 5 | 1475 | 13 | cannot be polished |
| | 4 | 20000 | 4 | 1350 | 250 | |
| Example 10 | 1 | 14500 | 5 | 1470 | 8 | |
| | 2 | 13000 | 6 | 1500 | 6 | |
| | 3 | 15000 | 4 | 1400 | 13 | |
| | 4 | 14500 | 5 | 1475 | 6 | |
| | 5 | 14700 | 5 | 1465 | 7 | |
| Reference Example2 | 1 | 14000 | 5 | 1470 | 13 | wafer vibration |
| | 2 | 9000 | 4 | 1300 | 153 | wafer vibration |
| | 3 | — | — | — | — | cannot be polished |
| | 4 | 14000 | 5 | 1475 | 13 | cannot be polished |
| | 5 | 20000 | 4 | 1350 | 250 | wafer vibration |
| Comparative Example 5-1 | | — | — | — | — | not moldable |
| Comparative Example 5-2 | | 2000 | 35 | 2505 | 56 | wafer vibration |
| Comparative Example 5-3 | | — | — | — | — | not moldable |
| Comparative Example 5-4 | | 1200 | 56 | 3200 | 80 | wafer vibration |

INDUSTRIAL APPLICABILITY

The polishing pad of this invention can be used as a polishing pad effecting stable planarizing processing, at high polishing rate, materials requiring surface flatness at high level, such as a silicon wafer for semiconductor devices, a memory disk, a magnetic disk, optical materials such as optical lens and reflective mirror, a glass plate and metal. The polishing pad of this invention is suitable for use in the step of planarizing particularly a silicon wafer, a device (multi-layer substrate) having an oxide layer, metal layer etc. formed on a silicon wafer, and a silicon wafer before lamination and formation of such layers. The cushion layer of this invention is useful as a cushion layer for the polishing pad. Further, the polishing pad of this invention contains abrasive grains in the polishing pad, and thus can be manufactured at low costs without using expensive slurry. Further, the abrasive grains in the pad are not aggregated, and thus scratches are hardly generated. According to this invention, there can be obtained a polishing pad achieving a high polishing rate and being excellent in planarization and uniformity.

What is claimed is:

1. A photolithographic method of forming a polishing layer for a polishing pad, comprising:

(1) forming a sheet molding from a curing composition containing at least an initiator and an energy ray-reactive compound to be cured with energy rays, (2) exposing the sheet molding to energy rays to induce modification thereof, to change the solubility of the sheet molding in a solvent, and (3) developing the sheet molding after irradiation with energy rays, to partially remove the curing composition with a solvent thereby forming a concave and convex pattern at least one surface.

2. The method of forming a polishing layer according to claim 1, wherein step (1) involves laminating an energy ray-permeable substrate on at least one side of the sheet molding.

3. The method of forming a polishing layer according to claim 1, wherein step (2) involves layering a pattern film (masking material) having energy ray-permeable regions and impermeable regions and irradiating the sheet via the pattern film with energy rays.

4. The method of forming a polishing layer according to claim 1, wherein the energy ray-curing composition comprises a photo-initiator, a solid polymer compound and a liquid light-reactive compound.

5. The method of forming a polishing layer according to claim 1, wherein the transmittance of the sheet molding at the wavelength of energy rays causing modification is 1% or more.

6. A method of producing a polishing pad provided with a polishing layer comprising a polishing surface layer and a backside layer, both of which are formed continuously into one body and which are made of a same curing composition to be cured with energy rays, said method comprising forming the curing composition into a sheet molding, exposing the sheet molding with energy rays via masking materials arranged respectively on the surface forming the polishing surface layer and the surface forming the backside layer, and developing the sheet molding by dissolving and removing the uncured curing composition, thereby forming as a result of the developing step a concave and convex pattern thereon.

7. A method of producing a polishing pad provided with a polishing layer wherein the polishing layer is provided with a polishing surface layer and a backside layer formed continuously into one body made of a same curing composition, and the hardness of the polishing surface layer is higher than the hardness of the backside layer, and the difference in hardness in Shore D hardness is 3 or more, said method comprising the sheet-forming step of forming a sheet molding of the curing composition to be cured with energy rays and the curing step of forming the difference in hardness by applying energy rays.

* * * * *